US006523926B1

(12) United States Patent
Mitsuzawa et al.

(10) Patent No.: US 6,523,926 B1
(45) Date of Patent: Feb. 25, 2003

(54) ADJUSTMENT OF PRINTING POSITION DEVIATION

(75) Inventors: Toyohiko Mitsuzawa, Nagano-ken (JP); Shuji Yonekubo, Nagano-ken (JP); Koichi Otsuki, Nagano-ken (JP); Kazushige Tayuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 205 days.

(21) Appl. No.: 09/685,041

(22) Filed: Oct. 10, 2000

(30) Foreign Application Priority Data

Feb. 10, 1999 (JP) ..... 11-032163
Aug. 18, 1999 (JP) ..... 11-231280
Jan. 31, 2000 (JP) ..... 2000-021987

(51) Int. Cl.[7] ..... B41J 2/01
(52) U.S. Cl. ..... 347/19
(58) Field of Search ..... 347/19, 37, 15, 347/43

(56) References Cited

U.S. PATENT DOCUMENTS 5,049,898 A 9/1991 Arthur et al.
5,477,244 A 12/1995 Shibata et al.
6,039,430 A * 5/2000 Helterline et al. ..... 347/19

FOREIGN PATENT DOCUMENTS

| | | |
|---|---|---|
| EP | 0 622 211 | 11/1994 |
| EP | 0 772 145 | 5/1997 |
| EP | 0 858 049 | 8/1998 |
| EP | 0 869 007 | 10/1998 |
| EP | 0 875 379 | 11/1998 |
| EP | 0 895 869 | 2/1999 |
| JP | 63-153151 | 6/1988 |
| JP | 5-069625 | 3/1993 |
| JP | 5-104722 | 4/1993 |
| JP | 06-024049 | 2/1994 |
| JP | 09-048120 | 2/1997 |
| JP | 9-104113 | 4/1997 |
| JP | 10-86376 | 4/1998 |
| JP | 10-202851 | 8/1998 |
| JP | 10-250054 | 9/1998 |
| JP | 10-286966 | 10/1998 |
| JP | 11-20204 | 1/1999 |
| JP | 11-005301 | 1/1999 |
| JP | 11-005343 | 1/1999 |
| JP | 11-231739 | 8/1999 |
| JP | 2000-963 | 1/2000 |
| JP | 2000-62156 | 2/2000 |
| JP | 2000-296608 | 10/2000 |
| JP | 2000-296609 | 10/2000 |
| JP | 2000-318145 | 11/2000 |

* cited by examiner

*Primary Examiner*—Craig Hallacher
(74) *Attorney, Agent, or Firm*—Oblon, Spivak, McClelland, Maier & Neustadt, P.C.

(57) ABSTRACT

During printing, print head characteristics are taken into consideration to alleviate positional deviation of dots in a main scanning direction and improve image quality. The print head unit is provided with readable head identification information that is set in accordance with characteristics relating to positional deviation of dots to be formed by the print head in a main scanning direction. In accordance with this head identification information, adjustment values are determined for reducing printing positional deviation in the main scanning direction, and these adjustment values are used to adjust the position of dots in the main scanning direction.

28 Claims, 43 Drawing Sheets

| Head ID | Δ (μm) |
|---|---|
| 1 | −35.0 |
| 2 | −17.5 |
| 3 | 0 |
| 4 | +17.5 |

Test pattern for determining reference correction value

Adjusted based on reference correction value (K only)

Adjusted based on reference correction value (K + C)

Adjusted based on reference + relative correction values (K + C)

Dots adjusted for positional deviation were K dots and C dots (relative correction value $\Delta = -\delta c$)

Unadjusted

Adjusted based on reference correction value (K only)

Adjusted based on reference correction value (K + C)

Adjusted based on reference + relative correction values (K + C)

Dots adjusted for positional deviation were C dots
(relative correction value $\Delta = -2\delta c$)

W1
W2

ODRV1~6
(Forward)
ΔT1

ODRV1
(Reverse)
ΔT2

ODRV2
(Reverse)
ΔT3

ODRV3
(Reverse)
ΔT4

ODRV4
(Reverse)
ΔT5

ODRV5
(Reverse)
ΔT6

ODRV6
(Reverse)

Unadjusted

Adjusted based on reference correction value (K only)

Adjusted based on reference correction value (K + C)

Adjusted based on reference + relative correction values (K + C)

Adjusted only during forward pass (relative correction value $\Delta_{92b} = -2\delta c$)

Unadjusted

Adjusted based on reference correction value (K only)

Adjusted based on reference correction value (K + C)

Adjusted based on reference + relative correction values (K + C)

Adjusted during forward and reverse passes
(relative correction value $\Delta_{92b} = -\delta c$)

Before adjustment

After adjustment
(adjustment only during reverse pass)

Fig.30(a) K dot forward data
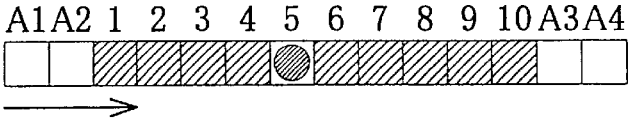
Fig.30(b) K dot reverse data
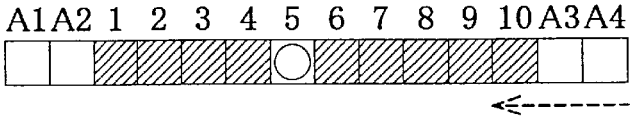
Fig.30(c) C dot forward data
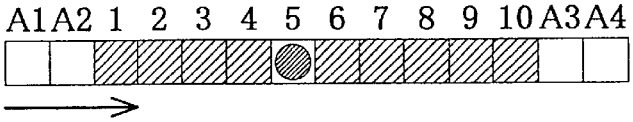
Fig.30(d) C dot reverse data
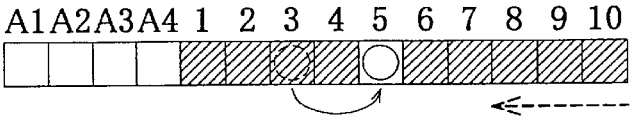
Fig.30(e) LC dot forward data
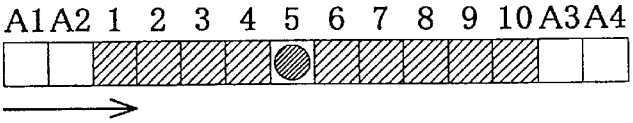
Fig.30(f) LC dot reverse data
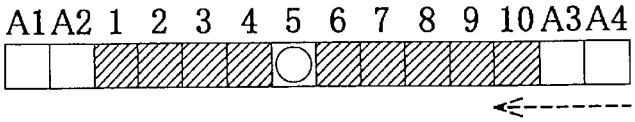

Before adjustment

After adjustment
(adjustment during forward and reverse passes)

Fig.32(a) K dot forward data
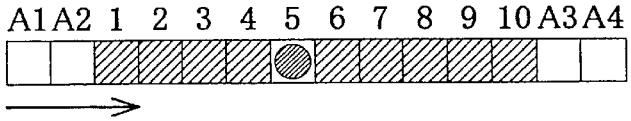
Fig.32(b) K dot reverse data
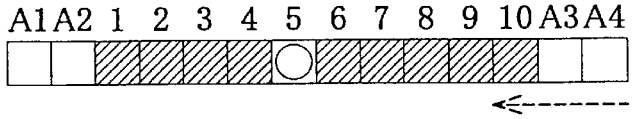
Fig.32(c) C dot forward data
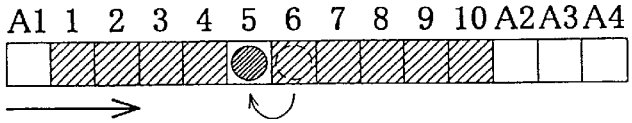
Fig.32(d) C dot reverse data
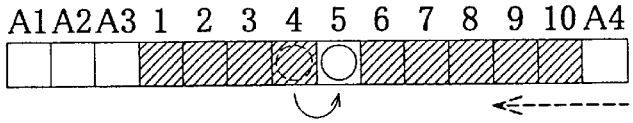
Fig.32(e) LC dot forward data
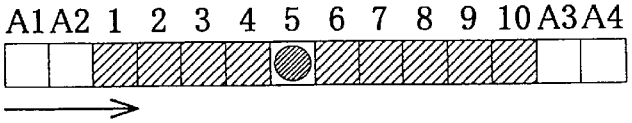
Fig.32(f) LC dot reverse data
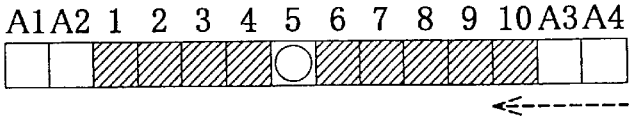

Waveforms of base drive signal in third embodiment

Test pattern for determining relative correction values

Relative correction value for small dots: $\Delta S = (\delta S - \delta L)$
Relative correction value for medium dots: $\Delta M = (\delta M - \delta L)$ Unadjusted (large dots)

Adjusted based on reference correction value (large dots only)

Adjusted based on reference correction value (large + small dots)

Adjusted based on reference + relative correction values (large + small dots)

Dots corrected for positional deviation were small dots

Measurement of intra-row point of impact error

Intra-row point of impact error Ea = max(| δ i|)

Measurement of intra-row point of impact error

Intra-row point of impact error Eb = max(εi)

Print head pass/fail judgement (2)

*Fig.46*

Head ID relating to inter-row deviation

| Range of inter-row deviation δ [μm] | Representative value [μm] | Nozzle row number | | | | | |
|---|---|---|---|---|---|---|---|
| | | 1 | 2 | 3 | 4 | 5 | 6 |
| −30 ~ −25 | −27.5 | A | A | A | A | A | A |
| −25 ~ −20 | −22.5 | B | B | B | B | B | B |
| −20 ~ −15 | −17.5 | C | C | C | C | C | C |
| −15 ~ −5 | −12.5 | D | D | D | D | D | D |
| −10 ~ −5 | −7.5 | E | E | E | E | E | E |
| −5 ~ 0 | −2.5 | F | F | F | F | F | F |
| 0 ~ 5 | 2.5 | G | G | G | G | G | G |
| 5 ~ 10 | 7.5 | H | H | H | H | H | H |
| 10 ~ 15 | 12.5 | I | I | I | I | I | I |
| 15 ~ 20 | 17.5 | J | J | J | J | J | J |
| 20 ~ 25 | 22.5 | K | K | K | K | K | K |
| 25 ~ 30 | 27.5 | L | L | L | L | L | L |

Head ID relating to inter-row deviation = FJHGEC

ADJUSTMENT OF PRINTING POSITION DEVIATION

TECHNICAL FIELD

This invention relates to a technology for printing images on a print medium during main scanning, and particularly relates to a technology for correcting positional deviation of dots printed in a main scanning direction.

BACKGROUND ART

In recent years, color printers that emit ink of a plurality of colors from a head are coming into widespread use as computer output devices. In recent years, such color printers have been devised as multi-tone printers able to print a pixel using a plurality of types of dots having mutually differing sizes. Multi-tone printers use relatively small-volume ink droplets to form relatively small dots within a pixel area, and relatively large-volume ink droplets to form relatively large dots within a pixel area. Like other prior printers, such multi-tone printers can also perform so-called "bi-directional printing," in order to increase the printing speed.

A problem that readily arises in bidirectional printing is that of deviation in printing position between forward and reverse printing passes in the main scanning direction, caused by backlash in the main scanning drive mechanism, and warping of the platen that supports the print medium from below, and the like. As a technology for resolving this positional deviation, for example, there is known that which is described in Patent Laid-open Gazette No. H05-69625, disclosed by the present applicants. With this prior technology, the amount of positional deviation (printing deviation) in the main scanning direction is registered beforehand, and this positional deviation amount is used as a basis for correcting the printing position during forward and reverse passes.

However, in addition to backlash in the main scanning drive mechanism and warping of the platen, print head characteristics have a major effect on positional deviation during bi-directional printing. That is, depending on the print head characteristics, dots formed by ink emitted from each nozzle may be subject to deviation in the main scanning direction. Conventionally, however, not much consideration had been given with respect to the effect that print head characteristics have on positional deviation arising during forward and reverse passes.

The above problem of positional deviation of dots in a main scanning direction is not limited to bi-directional printing, but also exists in unidirectional printing. In unidirectional printing, the problem becomes positional deviation between dots formed with different inks, or between dots formed with different rows of nozzles. Again, conventionally not much consideration had been given with respect to the effect that head characteristics have on positional deviation during unidirectional printing.

This invention was accomplished to resolve the above problems of the prior art, and has as its object to improve image quality by taking into consideration print head characteristics in alleviating positional deviation of dots in a main scanning direction.

DISCLOSURE OF THE INVENTION

For at least partially resolving the above problems, a first apparatus of this invention is a printing apparatus that prints on a print medium during main scanning, that includes a print head unit having a print head for printing dots at each pixel position on the print medium; a main scanning drive section that effects main scanning by moving at least one of the print medium and the print head unit; a sub-scanning drive section that effects sub-scanning by moving at least one of the print medium and the print head unit; a head drive section that applies drive signals to the print head to effect printing on the print medium; and a control section for controlling printing. The control section includes a printing position adjustment section that uses an adjustment value for reducing positional deviation of dots in a main scanning direction to adjust positioning of dots in a main scanning direction. Also, the print head unit is provided with readable head identification information that is set in accordance with characteristics relating to positional deviation of dots to be formed by the print head in a main scanning direction. The printing position adjustment section determines the adjustment value according to the head identification information.

In this way, adjustment value for correcting positional deviation are determined according to head identification information set in accordance with characteristics relating to positional deviation of the print head, so by taking print head characteristics into consideration, positional deviation of dots in a main scanning direction can be alleviated, improving image quality.

Moreover, the printing apparatus has a bidirectional printing function for printing in both the forward and reverse pass directions; and the printing position adjustment section may use the adjustment value to adjust the position of dots in the main scanning direction during bidirectional printing.

Also, the printing apparatus has a unidirectional printing function for printing during either one of forward pass and reverse pass; and the printing position adjustment section may use the adjustment value to adjust the position of dots in the main scanning direction during unidirectional printing.

In the above printing apparatus, the print head includes a plurality of nozzles; and a plurality of emission drive elements for emitting ink droplets from the plurality of respective nozzles; the plurality of emission drive elements may be divided into a plurality of groups. The head drive section can be provided with a base drive signal generator that generates a plurality of base drive signals corresponding to each of the plurality of groups; and a drive signal supply section that shape the plurality of base drive signals in response to given printing signals and supply the drive signals to the emission drive elements. At this time, it is preferable for the base drive signal generator to use the adjustment value supplied from the printing position adjustment section to output the plurality of base drive signals that have been individually phase adjusted.

In this way, by using a plurality of base drive signals corresponding to the plurality of groups that have been individually phase adjusted, it is possible to reduce on a group by group basis printing positional deviation caused by variations in the operating characteristics of the groups of emission drive elements.

In the above printing apparatus, the plurality of emission drive elements can be divided into groups corresponding to plural groups of emission drive elements, each group of emission drive elements corresponding to a plurality of nozzles arrayed in the sub-scanning direction.

This makes it possible to readily decrease positional deviation of dots in a main scanning direction.

In the above printing apparatus, also, the plurality of emission drive elements can be divided into groups according to type of ink emitted by the corresponding nozzles.

This makes it possible to decrease positional deviation of dots produced in a main scanning direction according to type of ink emitted from nozzles.

Also in the above printing apparatus, the printing position adjustment section preferably includes a first memory for storing a reference correction value for correcting printing positional deviation in a main scanning direction with respect to designated reference dots formed by the print head; a second memory for storing a relative correction value prepared beforehand for correcting the reference correction value; and an adjustment value determination section that determines the adjustment value by using the relative correction value to correct the reference correction value; with the relative correction value being determined in accordance with the head identification information.

Since, in this way, adjustment value for correcting positional deviation can be determined by using reference and relative correction values, it makes it possible to use printing modes adapted to various printing conditions to improve image quality by alleviating printing positional deviation in a main scanning direction.

Moreover, head identification information can be stored in non-volatile memory provided in the print head unit. Alternatively, head identification information can be displayed on an outer surface of the print head unit.

A second apparatus of this invention is a printing control apparatus that generates printing data to be supplied to a printing section that performs printing, the printing section including a print head unit having a print head for printing dots at each pixel position on the print medium; a main scanning drive section that effects main scanning by moving at least one of the print medium and the print head unit; a sub-scanning drive section that effects sub-scanning by moving at least one of the print medium and the print head unit; a head drive section that applies drive signals to the print head to effect printing on the print medium in response to given printing data; and a control section for controlling printing. The print head unit is provided with readable head identification information that is set in accordance with characteristics relating to positional deviation of dots formed in a main scanning direction by the print head. The printing control apparatus includes a printing data generation section that generates the printing data, which includes dot data representing dots to be formed at each pixel position on each main scanning line on the print medium, and adjustment data for adjusting, in pixel units, the printing position of dots to be formed in accordance with the dot data in a main scanning direction; and the printing data generation section includes an adjustment data determination section that determines the adjustment data to reduce positional deviation of dots in a main scanning direction in accordance with the head identification information.

Thus, positional deviation of dots in a main scanning direction can be alleviated and image quality improved also by generating and supplying to the printing section printing data that includes adjustment data determined in accordance with head identification information.

In the above printing control apparatus, the printing data can include, as the adjustment data, a prescribed number of adjustment pixel data corresponding to a prescribed number of pixels, and the adjustment data determination section can be arranged to distribute the prescribed number of adjustment pixel data to opposite ends of the dot data.

If the prescribed number of adjustment pixel data are thus distributed to opposite ends of the dot data, positional deviation of dots in a main scanning direction can be readily decreased. Moreover, distribution to opposite ends of the dot data is also meant to include a state in which all adjustment pixel data is distributed to either one end of the dot data, with no adjustment pixel data being distributed to the other end.

The recording medium of this invention is a computer-readable recording medium on which is recorded a computer program for generating printing data for a computer equipped with a printing apparatus that includes a print head unit having a print head for printing dots at each pixel position on the print medium; a main scanning drive section that effects main scanning by moving at least one of the print medium and the print head unit; a sub-scanning drive section that effects sub-scanning by moving at least one of the print medium and the print head unit; a head drive section that applies drive signals to the print head to effect printing on the print medium; a control section for controlling printing; the print head unit being provided with readable head identification information that is set in accordance with characteristics relating to positional deviation of dots to be formed by the print head in a main scanning direction; a computer-readable recording medium on which is recorded a function of generating the printing data that includes dot data representing dots to be formed at each pixel position on each main scanning line on the print medium, and adjustment data for adjusting, in pixel units, the printing position of dots to be formed in accordance with the dot data in a main scanning direction; and a function of determining the adjustment data to reduce positional deviation of dots in a main scanning direction in accordance with the head identification information.

Execution by a computer of the computer program recorded on the recording medium of this invention provides the same function and advantage as when a printing control apparatus of the invention is used, improving image quality by alleviating printing positional deviation in a main scanning direction.

A flexible disk, or CD-ROM, opto-magnetic disk, IC card, ROM cartridge, punched cards, printed material on which bar codes or other such symbols are printed, a computer internal storage device (memory such as RAM or ROM) as well as an external storage device and various other computer-readable media can be utilized as the "recording medium" of this invention.

The present invention can be realized in various modes such as a printing apparatus, printing method, a printing control apparatus, printing control method, a computer program for realizing the functions of the apparatuses and methods thereof, a recording medium on which the computer program is recorded, data signals embodied in a carrier wave including the computer program, and so forth.

BRIEF DESCRIPTION OF THE DRAWINGS

FIGS. 30(*a*)–30(*f*) are diagrams for explaining the printing data when the adjustment shown in FIGS. 29(A),(B) is performed.

FIGS. 32(*a*)–32(*f*) are diagrams for explaining the printing data when the adjustment shown in FIGS. 31(A),31(B) is performed.

FIG. 46 illustrates the setting of head ID data relating to inter-row deviation.

BEST MODE FOR CARRYING OUT THE INVENTION

Various embodiments of the present invention will be explained in the following order.

A. Apparatus configuration:

B. Generation of printing positional deviation between nozzle rows:

C. First embodiment (correction of printing positional deviation between nozzle rows (1)):

D. Second embodiment (correction of printing positional deviation between nozzle rows (2)):

E. Third embodiment (correction of printing positional deviation between nozzle rows (3)):

F. Fourth embodiment (correction of printing positional deviation between nozzle rows (4)):

G. Fifth embodiment (correction of printing positional deviation between dots of different sizes):

H. Sixth embodiment (setting of head ID based on pre-assembly check)

Figure 1:
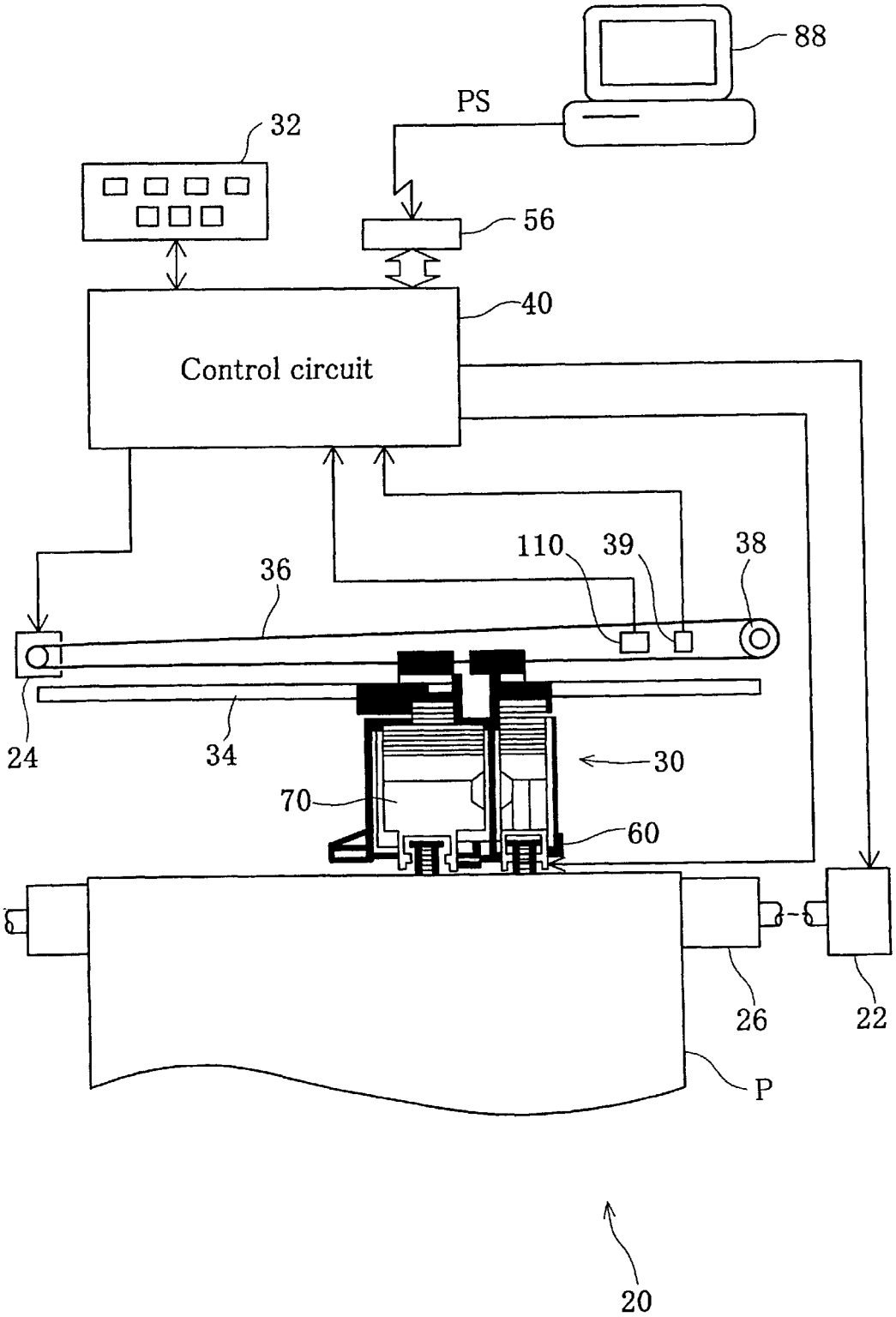
FIG. 1 shows the general configuration of a printing system equipped with a printer 20 of the first embodiment.

I. Modifications:

A. Apparatus Configuration:

FIG. 1 shows the general configuration of a printing system provided with an inkjet printer 20, constituting a first embodiment of the invention. The inkjet printer 20 includes a sub-scanning feed mechanism that uses a paper feed motor 22 to transport the printing paper P in sub-scanning direction, a main scanning mechanism that uses a carriage motor 24 to effect reciprocating movement of a carriage 30 in the axial direction (main scanning direction) of a platen 26, a head drive mechanism that drives a print head unit 60 (also referred to as a print head assembly) mounted on the carriage 30 and controls ink emission and dot formation, and a control circuit 40 that controls signal traffic between a control panel 32 and the feed motor 22, the carriage motor 24 and the print-head unit 60. The control circuit 40 is connected to a computer 88 via a connector 56.

The sub-scanning feed mechanism that transports the paper P includes a gear-train (not shown) that transmits the rotation of the feed motor 22 to platen 26 and paper transport rollers (not shown). The main scanning feed mechanism that reciprocates the carriage 30 includes a slide-shaft 34 that slidably supports the carriage 30 and is disposed parallel to the shaft of the platen 26, a pulley 38 connected to the carriage motor 24 by an endless drive belt 36, and a position sensor 39 for detecting the starting position of the carriage 30.

Figure 2:
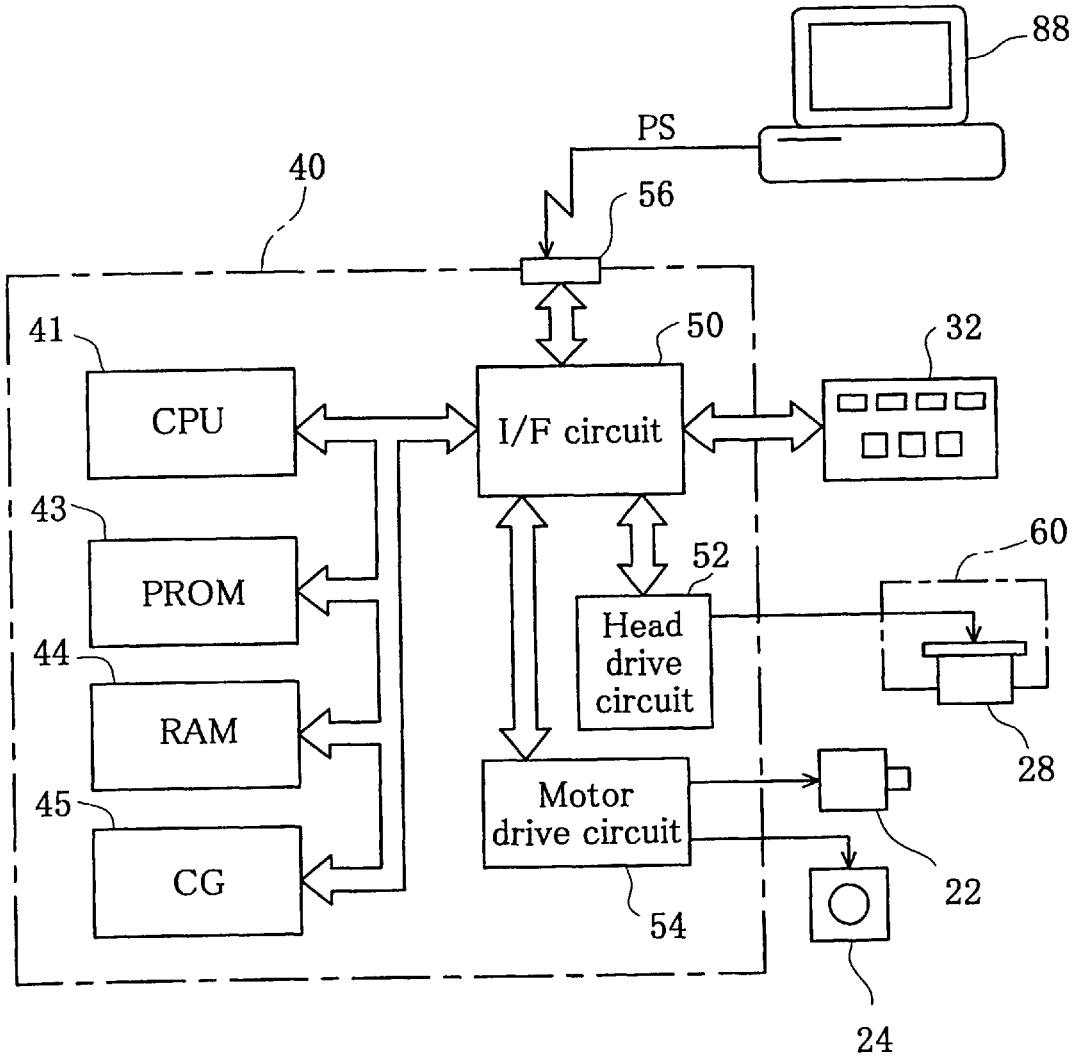
FIG. 2 is a block diagram showing the configuration of a control circuit 40 of the printer 20.

FIG. 2 is a block diagram showing the configuration of the inkjet printer 20 centering on the control circuit 40. The control circuit 40 is configured as an arithmetical logic processing circuit that includes a CPU 41, a programmable ROM (PROM) 43, RAM 44, and a character generator (CG) 45 in which is stored a character dot matrix. The control circuit 40 is also provided with an interface (I/F) circuit 50 for interfacing with external motors and the like, a head drive circuit 52 that is connected to the I/F circuit 50 and drives the print head unit 60 to emit ink, and a motor drive circuit 54 that drives the feed motor 22 and the carriage motor 24. The I/F circuit 50 incorporates a parallel interface circuit and, via the connector 56, can receive print signals PS from the computer 88.

Figure 3:
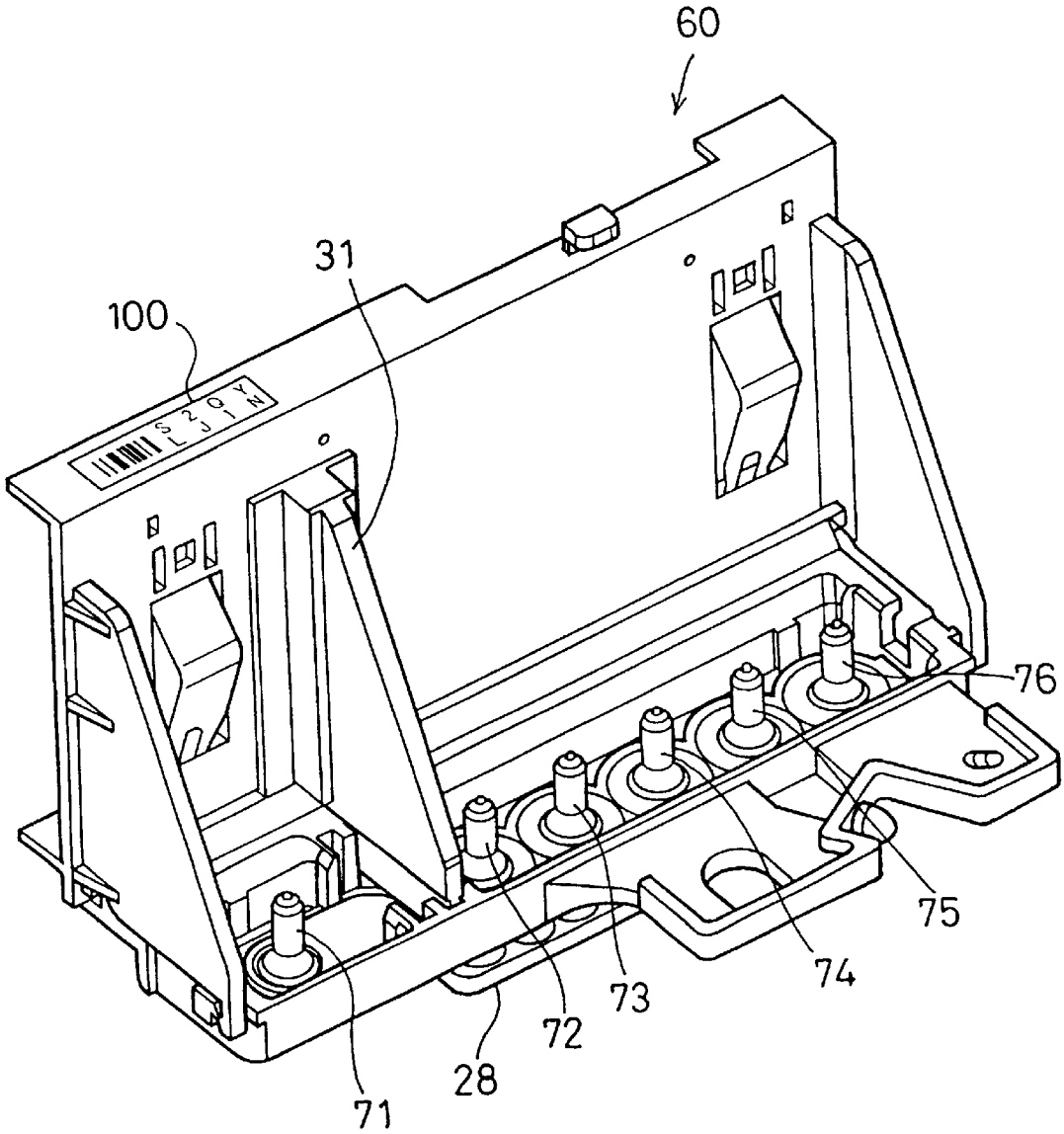
FIG. 3 is a perspective view of a print head unit 60.

FIG. 3 is a diagram illustrating a specific configuration of the print head unit 60 and ink emitting mechanism. As can be seen, the print head unit 60 is L-shaped, and can hold black and colored ink cartridges (not shown). The print head unit 60 is provided with a divider plate 31 to allow both cartridges to be installed.

An ID seal 100 is provided on the top edge of the print head unit 60. The ID seal 100 displays head identification information (referred to as head ID) pertaining to characteristics of the print head unit 60. Details of the head ID provided by the ID seal 100 are described later.

The print head unit 60 constituted by the print head 28 and the ink cartridge holders is so called since it is removably installed in the printer 20 as a single component. That is, when a print head 28 is to be replaced, it is the print head unit 60 itself that is replaced.

The bottom part of the print head unit 60 is provided with ink channels 71 to 76 via which ink from ink tanks is supplied to the print head 28. When black and colored ink cartridges are pressed down onto the print head unit 60, the ink channels 71 to 76 are inserted into the respective ink chambers of the cartridges.

Figure 4:
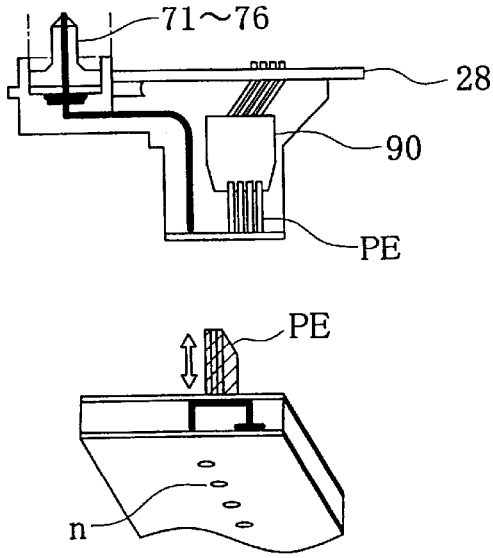
FIG. 4 illustrates the ink emission structure of the print head.

FIG. 4 illustrates the mechanism used to emit ink. When ink cartridges are installed on the print head unit 60, ink from the cartridges is drawn out via the ink channels 71 to 76 and channeled to the print head 28 provided on the underside of the print head unit 60.

For each color, the print head 28 has a plurality of nozzles n arranged in a line, and an actuator circuit 90 for activating a piezoelectric element PE with which each nozzle n is provided. The actuator circuit 90 is a part of the head drive circuit 52 (FIG. 2), and controls the switching on and off drive signals supplied from a drive signal generator (not shown). Specifically, for each nozzle, in accordance with a print signal PS supplied from the computer 88 the actuator circuit 90 latches on (ink is emitted) or off (ink is not emitted), and applies a drive signal to piezoelectric elements PE only in respect of nozzles that are switched on.

Figure 5A:
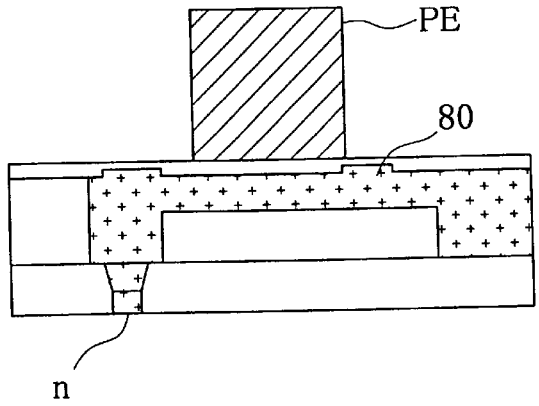
FIGS. 5(A) and 5(B) illustrate the arrangement whereby ink particles Ip are emitted by the expansion of a piezoelectric element PE.
Figure 5B:
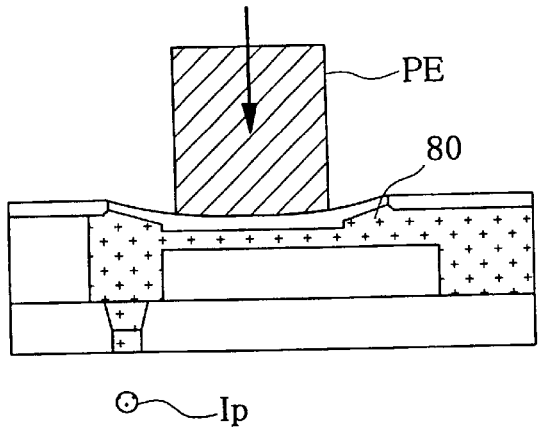

FIGS. 5(A) and 5(B) illustrate the principle based on which a nozzle n is driven by the piezoelectric element PE. The piezoelectric element PE is provided at a position where it is in contact with an ink passage 80 via which ink flows to the nozzle n. In this embodiment, when a voltage of prescribed duration is applied across the electrodes of the piezoelectric element PE, the piezoelectric element PE rapidly expands, deforming a wall of the ink passage 80, as shown in FIG. 5(B). This reduces the volume of the ink passage 80 by an amount corresponding to the expansion of the piezoelectric element PE, thereby expelling a corresponding amount of ink in the form of a particle Ip that is emitted at high speed from the nozzle n. Printing is effected by these ink particles Ip soaking into the paper P on the platen 26.

Figure 6:
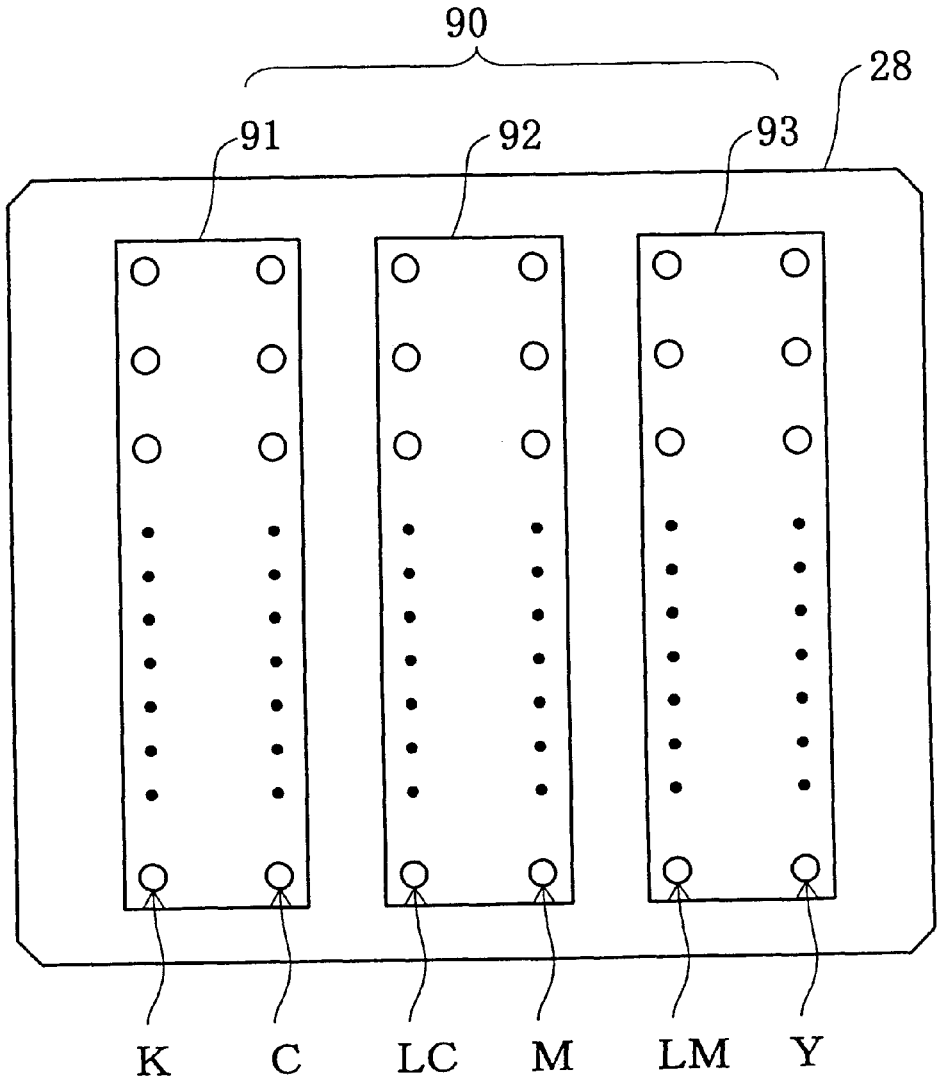
FIG. 6 is a diagram illustrating the positional relationship between the rows of nozzles in the print head 28 and the actuator chips.

FIG. 6 is a diagram illustrating the positional relationship between the rows of nozzles in the print head 28 and the actuator chips. The printer 20 prints using inks of the six colors black (K), dark cyan (C), light cyan (LC), dark magenta (M), light magenta (LM) and yellow (Y), and has a row of nozzles for each color. Dark cyan and light cyan are cyan inks of different density having more or less the same hue. This is also the case with respect to dark magenta and light magenta.

The actuator circuit 90 is provided with a first actuator chip 91 that drives the row of black ink nozzles K and the row of dark cyan ink nozzles C, a second actuator chip 92 that drives the row of light cyan ink nozzles LC and the row of dark magenta ink nozzles M, and a third actuator chip 93 that drives the row of light magenta ink nozzles LM and the row of yellow ink nozzles Y.

Figure 7:
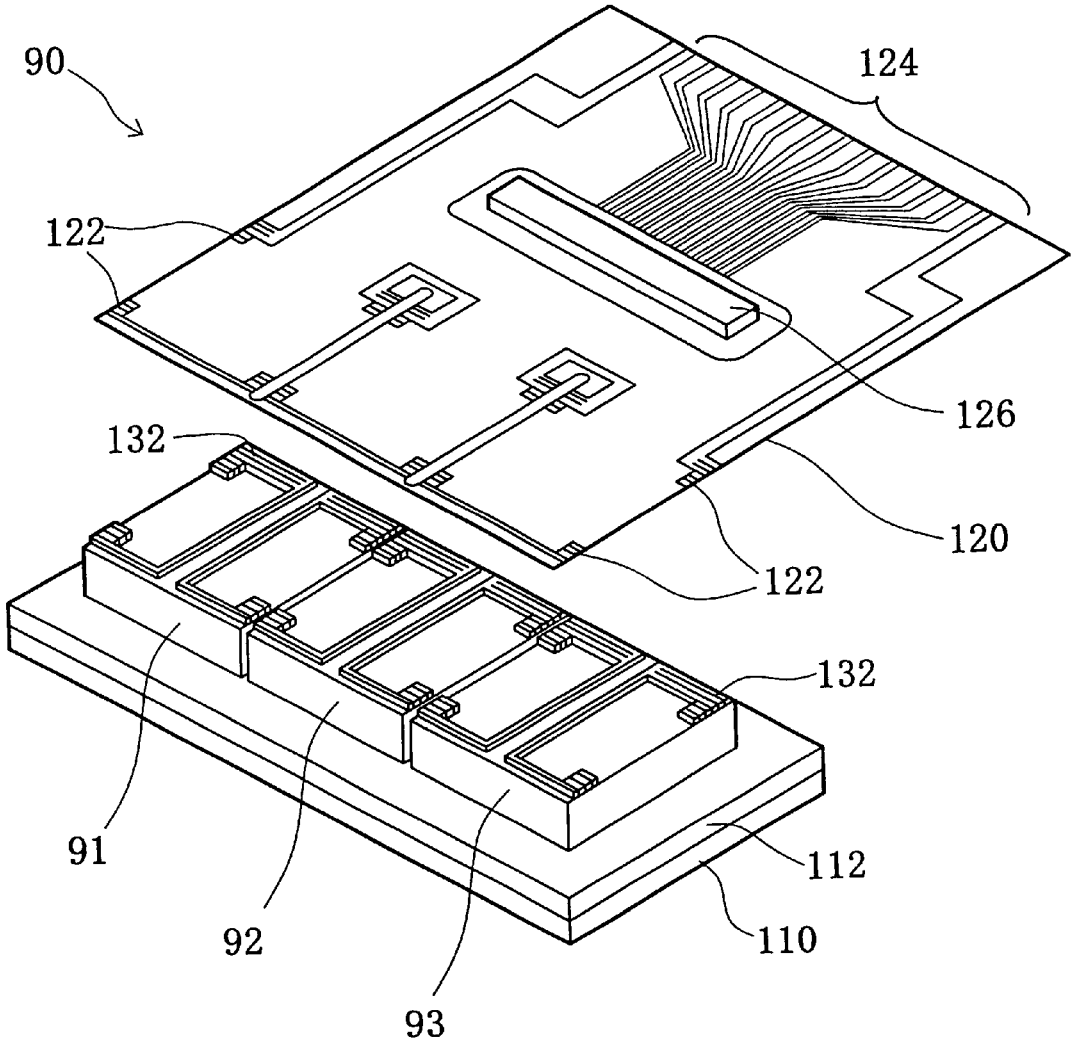
FIG. 7 is an exploded perspective view of the actuator circuit 90.

FIG. 7 is an exploded perspective view of the actuator circuit 90. Using adhesive, the three actuator chips 91 to 93 are bonded to the top of a laminated assembly comprised of a nozzle plate 110 and a reservoir plate 112. A contact terminal plate 120 is affixed over the actuator chips 91 to 93. Formed on one edge of the contact terminal plate 120 are terminals 124 for forming electrical connections with an external circuit (specifically the I/F circuit 50 of FIG. 2). Provided on the underside of the contact terminal plate 120 are internal contact terminals 122 for connecting the actuator chips 91 to 93. A driver IC 126 is provided on the contact terminal plate 120. The driver IC 126 has circuitry for latching print signals supplied from the computer 88, and an analogue switch for switching drive signals on and off in accordance with the print signals. The connecting wiring between the driver IC 126 and the terminals 122 and 124 is not shown.

Figure 8:
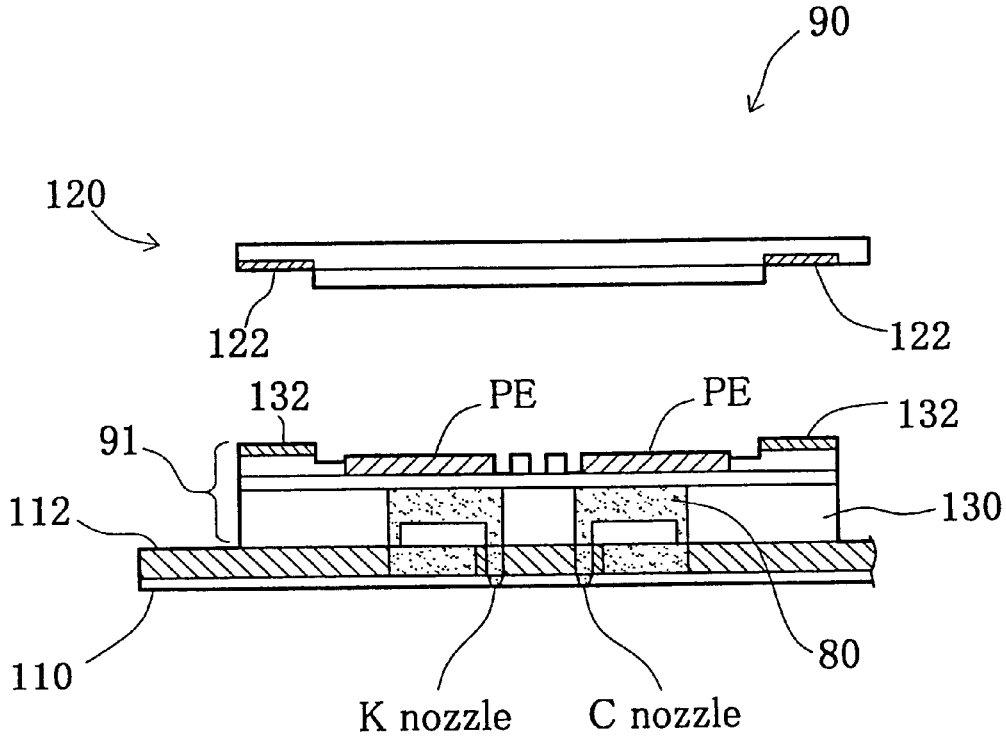
FIG. 8 is a partial cross-sectional view of the actuator circuit 90.

FIG. 8 is a partial cross-sectional view of the actuator circuit 90. This only shows the first actuator chip 91 and the terminal plate 120 in cross-section. However, the other actuator chips 92 and 93 have the same structure as that of the first actuator chip 91.

The nozzle plate 110 has nozzle openings for the inks of each color. The reservoir plate 112 is shaped to form a reservoir space to hold the ink. The actuator chip 91 has a ceramic sintered portion 130 that forms the ink passage 80 (FIG. 5), and on the other side of the upper wall over the ceramic sintered portion 130, piezoelectric elements PE and terminal electrodes 132. When the contact terminal plate 120 is affixed onto the actuator chip 91, electrical contact is formed between the contact terminals 122 on the underside of the contact terminal plate 120 and the terminal electrodes 132 on the upper side of the actuator chip 91. The connecting wiring between the terminal electrodes 132 and the piezoelectric element PE is not shown.

B. Generation of Printing Positional Deviation Between Nozzle Rows:

In the first through forth embodiments described below, printing positional deviation arising between rows of nozzles during bi-directional printing is adjusted. Before describing the embodiments, an explanation will be given concerning the printing positional deviation arising between nozzle rows.

Figure 9:
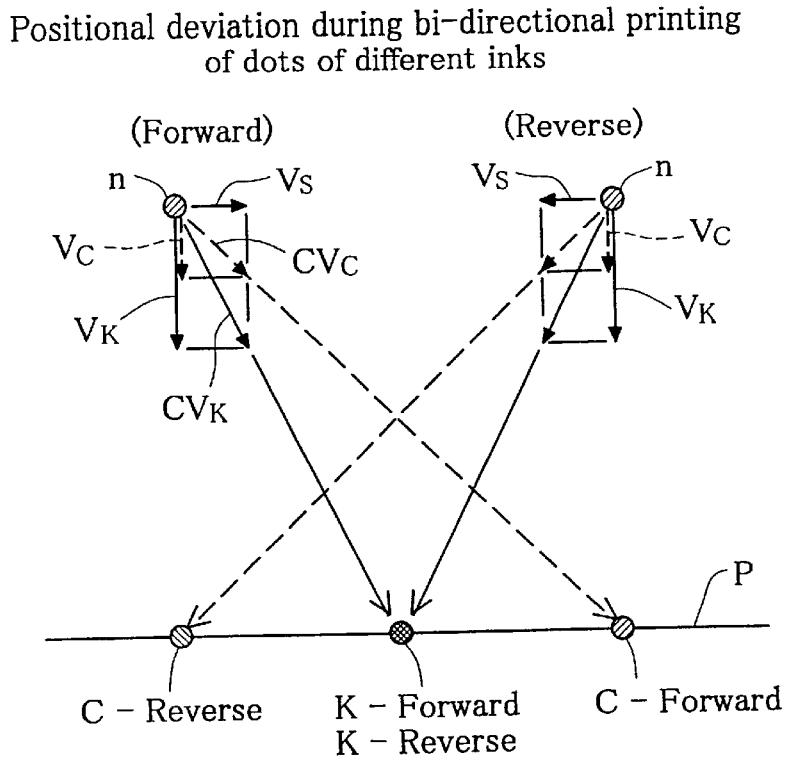
FIG. 9 illustrates positional deviation arising between rows of nozzles during bidirectional printing.

FIG. 9 illustrates positional deviation arising between rows of nozzles during bi-directional printing. Nozzle n is moved horizontally bi-directionally over the paper P with ink being emitted during forward and reverse passes to thereby form dots on the paper P. The drawing shows emission of black ink K and that of cyan ink C. $V_K$ is the emission velocity of black ink K emitted straight down, and $V_C$ is the emission velocity of cyan ink C, which is lower than $V_K$. The composite velocity vectors $CV_K$, $CV_C$ of the respective inks are given by the result of the downward emission velocity vector and the main scanning velocity $V_S$ of the nozzle n. Black ink K and cyan ink C have different downward emission velocities $V_K$ and $V_C$, so the magnitude and direction of the composite velocities $CV_K$ and $CV_C$ also differ.

In the example of FIG. 9, correction is applied so that positional deviation during bi-directional printing is reduced to zero with reference to black dots. However, since the composite velocity vector $CV_C$ of cyan ink C is different from the composite velocity vector $CV_K$ of black ink K, if the same emission timing is used for black ink K and cyan ink C, the result will be major deviation in the position of the printed cyan dots. Also, it can be seen that the relative positional relationship between black dots and cyan dots during a forward pass is reversed during the reverse pass.

Figure 10:
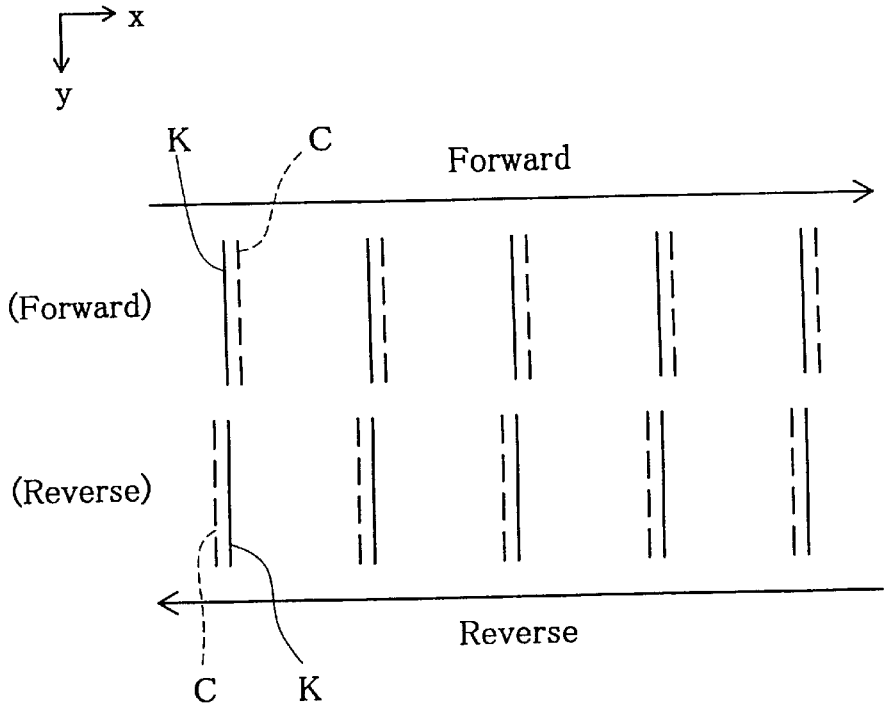
FIG. 10 is a plan view illustrating the printing positional deviation of FIG. 9.

FIG. 10 is a plan view illustrating the printing positional deviation of FIG. 9. The vertical lines in the sub-scanning direction y indicate printing in black ink K and cyan ink C. The vertical lines in black ink K printed during a forward pass are in alignment with the vertical lines printed during the reverse pass at positions in the main scanning direction x. On the other hand, the vertical lines printed in cyan ink on a forward pass are printed to the right of the black ink lines, and on the reverse pass are printed to the left of the black lines.

Thus, when positional deviation is corrected just with respect to printing by the row of black ink nozzles, there have been cases in which, with respect to other rows of nozzles, positional deviation could not be properly corrected.

The velocity of ink droplets emitted from the nozzles depends on the types of factors listed below.

(1) Manufacturing tolerance of the actuator chips.

(2) Physical qualities of the ink (viscosity, for example).

(3) Mass of ink.droplets.

When the main factor affecting ink droplet emission velocity is the manufacturing tolerance of the actuator chips, the ink droplets emitted by the same actuator chip are emitted at substantially the same velocity. Therefore, in correcting for positional deviation in the main scanning direction in such a case, it is preferable to effect such correction on a nozzle group by group basis, for each group of nozzles driven by different actuators.

When the physical properties of the ink or the mass of the ink droplets have a major effect on emission velocity, it is preferable to correct for positional deviation of dots printed in the main scanning direction ink by ink or by nozzle row.

Figure 11:
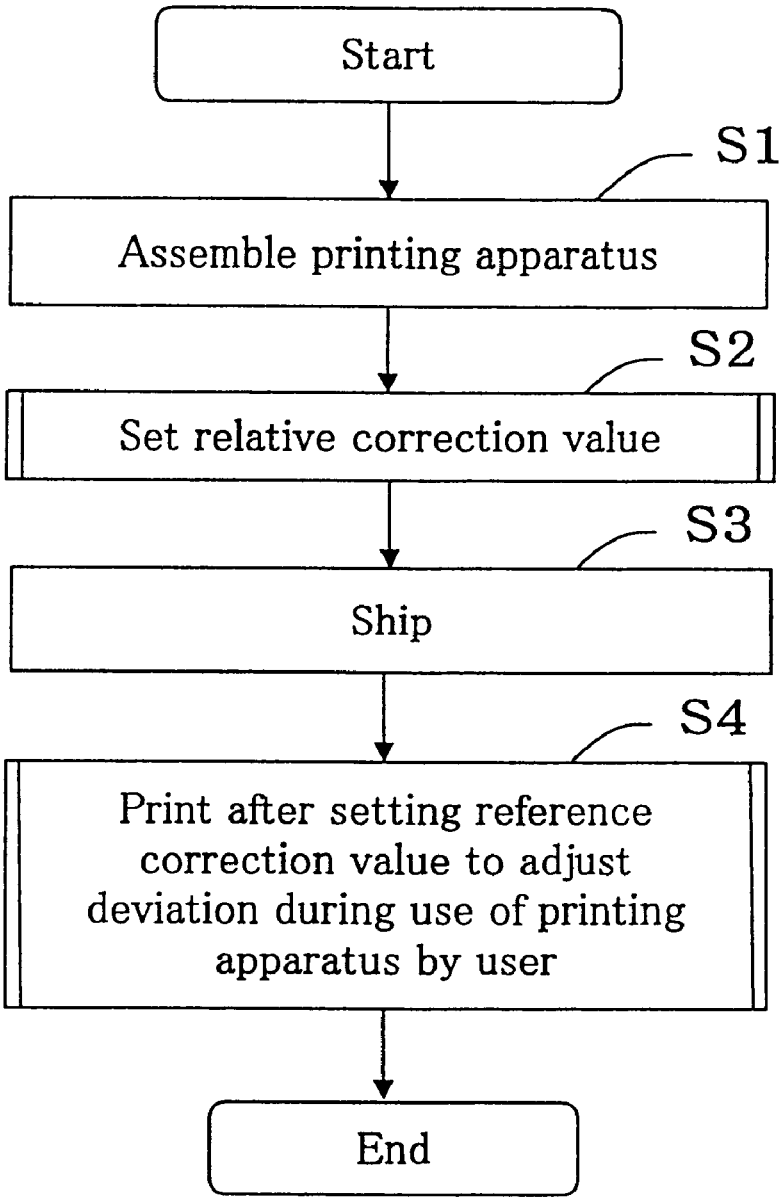
FIG. 11 is a flow chart of the overall processing by the first embodiment.

C. First Embodiment (Correction of Printing Positional Deviation Between Nozzle Rows (1)):

FIG. 11 is a flow chart of the process steps in a first embodiment of the invention. In step S1, the printer 20 is assembled on the production line, and in step S2 an operator sets relative correction values for correcting positional deviation in the printer 20. In step S3 the printer 20 is shipped from the factory, and in step S4, the purchaser of the printer 20 prints after setting a reference correction value for correcting positional deviation during use. Steps S2 and S4 will be each described in more detail below.

Figure 12:
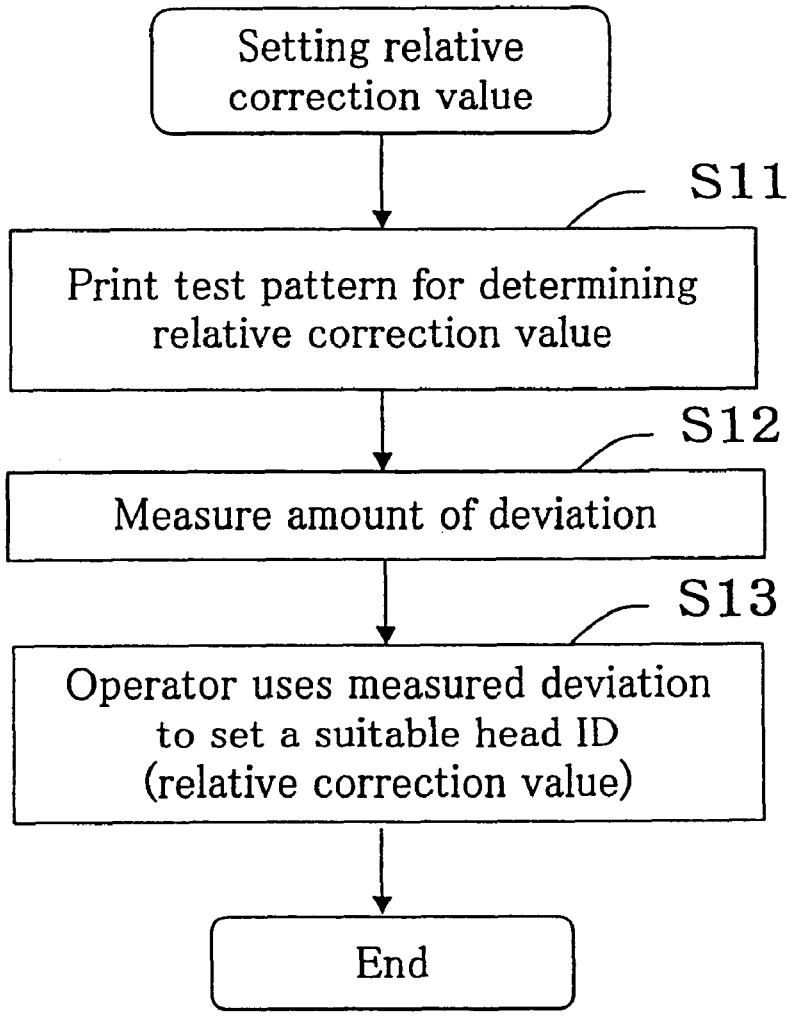
FIG. 12 is a flow chart showing the details of the step S2 procedure of FIG. 11.
Figures 13, 14:
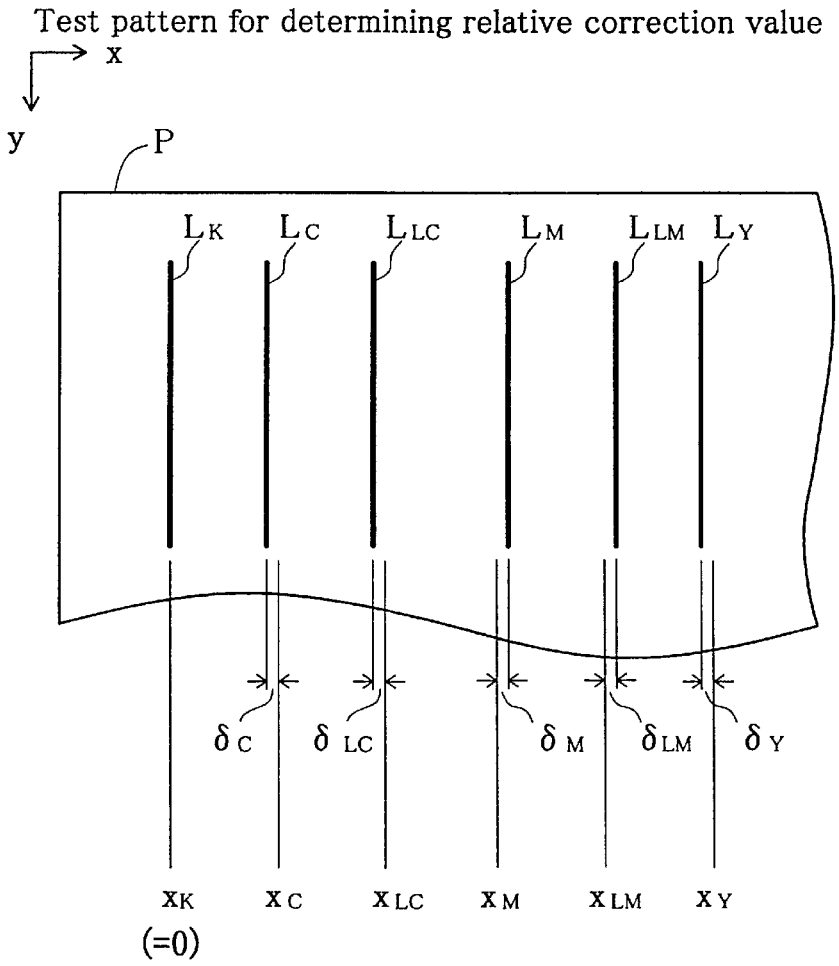
FIG. 13 is an example of a test pattern used to determine a relative correction value.
FIG. 14 shows the relationship between the relative correction value Δ and head ID.

FIG. 12 is a flow chart showing details of the step S2 of FIG. 11. In step S11, a test pattern (test pattern of relative positional deviation) is printed to determine relative correction values. FIG. 13 shows an example of a test pattern for determining relative correction value. The test pattern consists of the six vertical lines $L_K$, $L_C$, $L_{LC}$, $L_M$, $L_{LM}$, $L_Y$ formed in the sub-scanning direction y in the six colors K, C, LC, M, LM, Y. The six lines were printed by ink emitted from the six rows of nozzles simultaneously while moving the carriage 30 at a set speed. In each main scanning pass the dots were formed spaced apart by just the nozzle pitch in the sub-scanning direction, so in order to print the vertical lines as shown in FIG. 13, ink was emitted at the same timing during a plurality of main scanning passes.

The test pattern does not have to be composed of vertical lines, but may be any pattern of straight lines of dots printed at intervals. This also applies to test patterns for determining a reference correction value described later.

In step S12 of FIG. 12, the amounts of deviation between the six vertical lines of FIG. 13 are measured. This can be measured by, for example, using a CCD camera to read the test pattern and using image processing to measure the positions of the lines $L_K$, $L_C$, $L_{LC}$, $L_M$, $L_{LM}$, $L_Y$ in the main scanning direction x. The six vertical lines are formed simultaneously by the emission of ink from the six rows of nozzles, so if the ink is considered as being emitted at the same velocity from the six sets of nozzles, the spacing of the six lines should be the same as the spacing of the rows of nozzles.

The x coordinates $X_K$, $X_C$, $X_{LC}$, $X_M$, $X_{LM}$, $X_Y$ shown in FIG. 13 indicate the ideal coordinates of the lines in accordance with the design pitches of the nozzle rows while the x coordinate value $X_K$ of the black ink line $L_K$ is used as a reference. Thus, the positions denoted by the x coordinates $X_K$, $X_C$, $X_{LC}$, $X_M$, $X_{LM}$, $X_Y$ will be also referred to hereinafter as the design positions. The amount of deviation $\delta_C$, $\delta_{LC}$, $\delta_{LM}$, $\delta_{LM}$, $\delta_Y$ of the five lines relative to the design position is measured. When the deviation is to the right of the design position the deviation amount $\delta$ is taken as a plus value, and a minus value when the deviation is to the left of the design position.

In step S13, the measured deviation amounts are used as a basis for an operator to determine a suitable head ID and set the head ID in the printer 20. The head ID indicates the suitable relative correction value to use for correcting the measured deviations. As shown by the following equation (1), for example, the suitable relative correction value $\Delta$ can be set at a value that is the negative of the average deviation value $\delta ave$ of the lines other than the reference line $L_K$.

$$\Delta = -\delta ave = -\Sigma \delta i/(N-1) \quad (1)$$

where $\Sigma$ denotes the arithmetical operation of obtaining the sum deviation $\delta i$ of all lines other than the reference black ink line, and N denotes the total number of vertical lines, which is to say, the number of rows of nozzles.

FIG. 14 shows the relationship between relative correction value $\Delta$ and head ID. In this example, when the relative correction value $\Delta$ is −35.0 $\mu$m the head ID is set at 1, and the head ID is incremented by 1 for every 17.5 $\mu$m increase in the relative correction value $\Delta$. Here, 17.5 $\mu$m is the minimum value by which the printer 20 can be adjusted for deviation in the main scanning direction. As this minimum adjustable value, there may be used a value that is the equivalent of the dot pitch in the main scanning direction. With respect to a printing resolution of 1440 dpi in the main scanning direction, for example, the dot pitch is approximately 17.5 $\mu$m (=25.4 mm/1440), so that can be used as the minimum adjustable value. It is also possible to use a minimum adjustable value that is smaller than the dot pitch.

The head ID thus determined is stored in the PROM 43 (FIG. 2) in the printer 20. In this embodiment, a seal 100 showing the head ID is also provided on the top of the print head unit 60 (FIG. 3). It is also possible to provide the driver IC 126 (FIG. 7) in the print head unit 60 with a non-volatile memory, such as a programmable ROM, and store the head ID in the non-volatile memory. The advantage of either method is that when the print head unit 60 is used in another printer 20, it enables the suitable head ID for that print head unit 60 to be used in the printer.

The determination of the relative correction value of step S2 can be carried out in the assembly step prior to the installation of the print head unit 60 into the printer 20, with a special inspection apparatus for testing the print head unit 60. In this case, the head ID can be stored in the PROM 43 during the subsequent installation of the print head unit 60 in the printer 20. In this case, the head ID can be stored in the PROM 43 by using a special reader to read the head ID seal 100 on the print head unit 60 or an operator can use a keyboard to manually key in the head ID. Alternatively, the head ID stored in non-volatile memory in the print head unit 60 can be transferred to the PROM 43.

The relative correction value $\Delta$ may be given by the average of the light cyan and light magenta deviation amounts, as in equation (2).

$$\Delta=-(\delta_{LC}+\delta_{LM})/2 \quad (2)$$

Light cyan and light magenta are used far more than other inks in halftone regions of color images (especially in the image density range of approximately 10 to 30% for cyan and/or magenta), so the positional precision of dots printed in these colors has a major effect on the image quality. Thus, using the average deviation of dots printed in light cyan and light magenta to determine the relative correction value $\Delta$ makes it possible to decrease the positional deviation, thereby improving the quality of the color images.

When using equation (2), it is enough just to measure the deviation $\delta$ from the black ink dots for light cyan and light magenta.

As shown in the flow chart of FIG. 11, the printer 20 is shipped after the head ID has been set in the printer 20. When the printer 20 is to be used, positional deviation during bi-directional printing is adjusted using the head ID.

Figure 15:
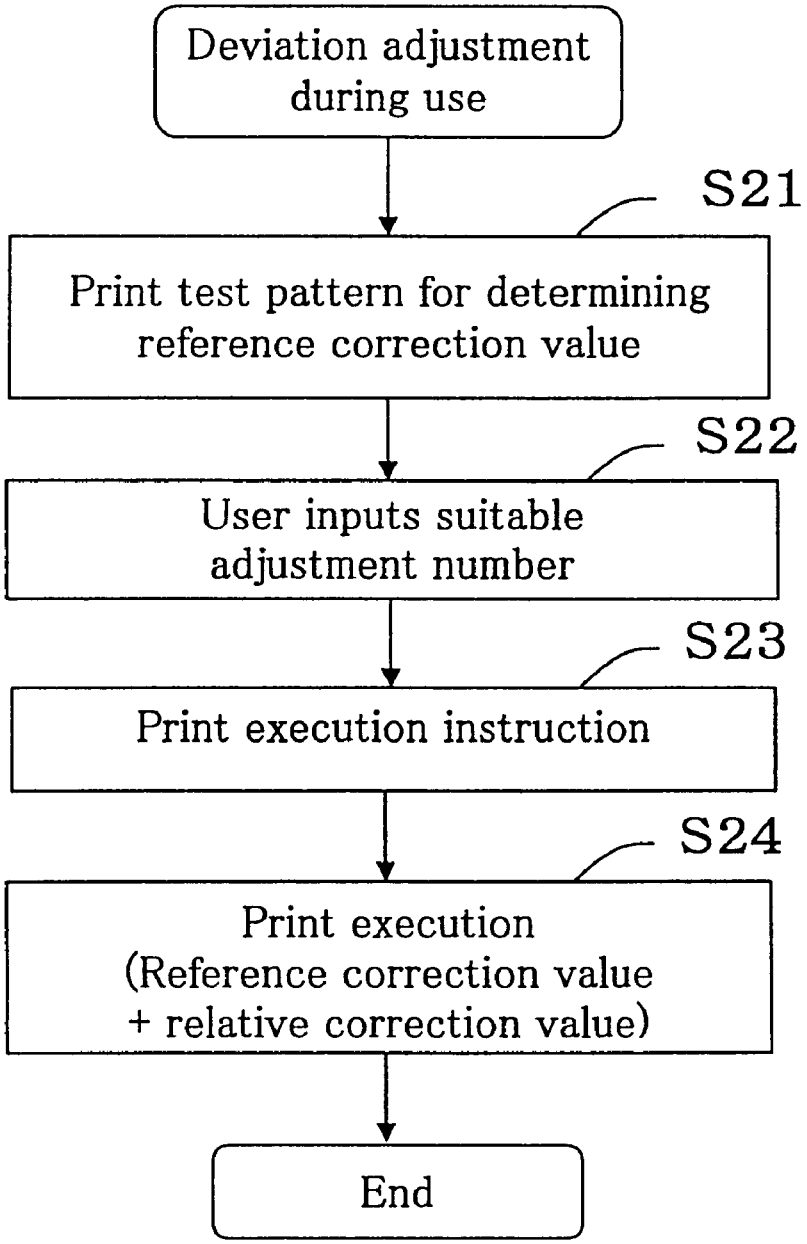
FIG. 15 is a flow chart showing the details of the step S4 procedure of FIG. 11.
Figure 16:
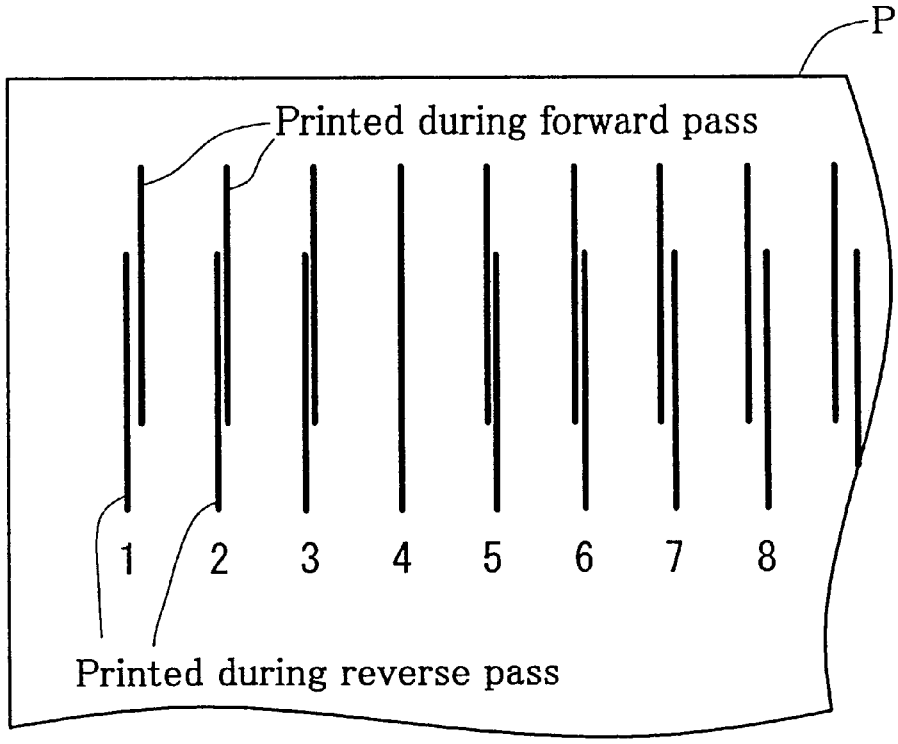
FIG. 16 is an example of a test pattern used to determine a reference correction value.

FIG. 15 is a flow chart of the deviation adjustment procedure carried out when the printer is used by the user. In step S21 the printer 20 is instructed to print out a test pattern (test pattern of reference positional deviation) to determine a reference correction value. FIG. 16 shows an example of a test pattern for determining reference correction value. The test pattern consists of a number of vertical lines printed in black ink during forward and reverse passes. The lines printed during the forward pass are evenly spaced, but on the reverse pass the position of the lines is sequentially displaced along the main scanning direction in units of one dot pitch. As a result, multiple pairs of vertical lines are printed in which the positional deviation between lines printed during the forward and reverse passes increases by one dot pitch at a time. The numbers printed below the pairs of lines are deviation adjustment numbers denoting correction information required to achieve a preferred corrected state. A preferred corrected state refers to a state in which, when the printing position (and printing timing) during forward and reverse passes has been corrected using an appropriate reference correction value, the positions of dots formed during forward passes coincide with the positions of dots formed during reverse passes with respect to the main scanning direction. Thus, the preferred corrected state is achieved by the use of an appropriate reference correction value. In the example of FIG. 16, the pair of lines with the deviation adjustment number 4 are in a preferred corrected state.

The test pattern for determining the reference correction value is formed by a reference row of nozzles which has been used for determining the relative correction value. Therefore, when the row of magenta ink nozzles is used as the reference nozzle row in place of the row of black ink nozzles used for determining the relative correction value, the test pattern for determining the reference correction value is also formed using the row of magenta ink nozzles.

The user inspects the test pattern and uses a printer driver input interface screen (not shown) on the computer 88 to input the deviation adjustment number of the pair of vertical lines having the least deviation. The deviation adjustment number is stored in the PROM 43 of the printer 20.

Figure 17:
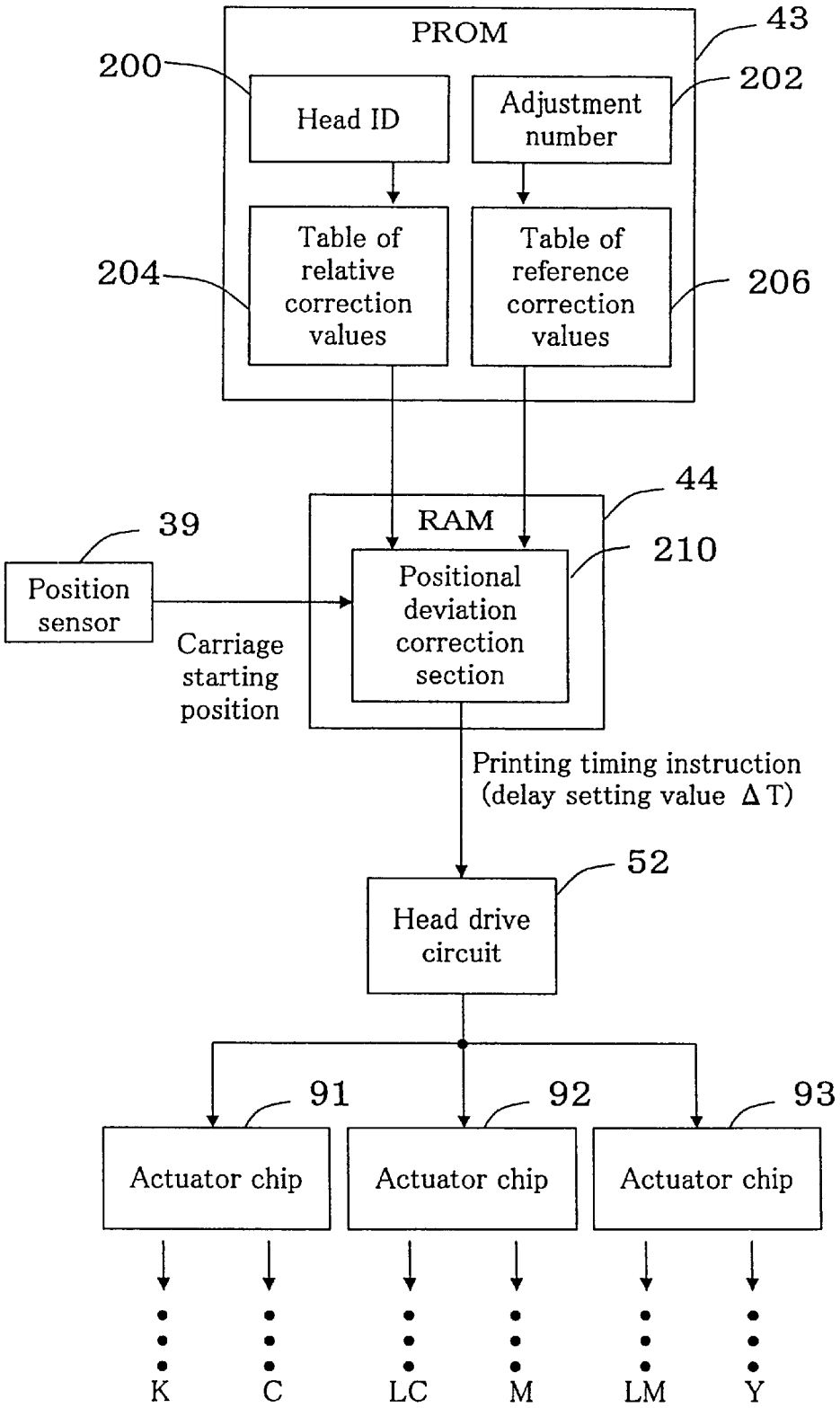
FIG. 17 is a block diagram of the main configuration involved in the correction of deviation arising during bi-directional printing in the case of the first embodiment.

Next, in step S23, the user instructs to start the printing, and in step S24, bi-directional printing is carried out while using the reference and relative correction values to correct deviation. FIG. 17 is a block diagram of the main configuration involved in the correction of deviation during bi-directional printing in the case of the first embodiment. The PROM 43 in the printer 20 has a head ID storage area 200, an adjustment number storage area 202, a relative correction value table 204 and a reference correction value table 206. A head ID indicating the preferred relative correction value is stored in the head ID storage area 200, and a deviation adjustment number indicating the preferred reference correction value is stored in the adjustment number storage area 202. The relative correction value table 204 is one such as that shown in FIG. 14, which shows the relationship between head ID and relative correction value $\Delta$. The reference correction value table 206 is a table showing the relationship between deviation adjustment number and reference correction value. The reference correction value table 206 is a table storing the relationship between the amount of positional deviation of reverse pass lines on the test pattern (FIG. 16) (that is, reference correction value) and deviation adjustment number.

The RAM 44 in printer 20 is used to store a computer program that functions as a positional deviation correction section (adjustment value determination section) 210 for correcting positional deviation during bi-directional printing. The positional deviation correction section 210 reads out from the relative correction value table 204 a relative correction value corresponding to the head ID stored in the PROM 43, and also reads out from the reference correction value table 206 a reference correction value corresponding to the deviation adjustment number. During a reverse pass, when the positional deviation correction section 210 receives from the position sensor 39 (FIG. 1) a signal indicating the starting position of the carriage 30, it supplies the head drive circuit 52 with a printing timing signal (delay setting $\Delta T$) that corresponds to a composite correction value of the relative and reference correction values. The head drive circuit 52 supplies common drive signals to the three actuator chips 91–93, whereby the positioning of dots printed during the reverse pass is adjusted in accordance with the timing supplied from the positional deviation correction section 210 (that is, by a delay setting ΔT). As a result, on the reverse pass, the printing positions of the six rows of nozzles are all adjusted by the same correction amount. When relative and reference correction amounts are both set at values that are integer multiples of the dot pitch in the main scanning direction, the printing position (meaning the printing timing) also is adjusted in dot pitch units in the main scanning direction. The composite correction value is obtained by adding the reference and relative correction values.

Figure 18A:
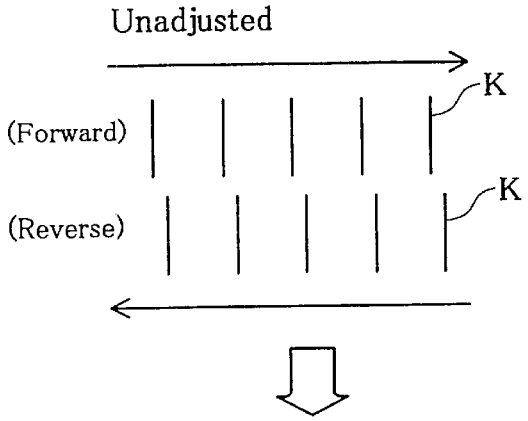
FIGS. 18(A)–18(D) illustrate the correction of positional deviation using reference and relative correction values, when black dots and cyan dots have been selected as the target dots.
Figure 18B:
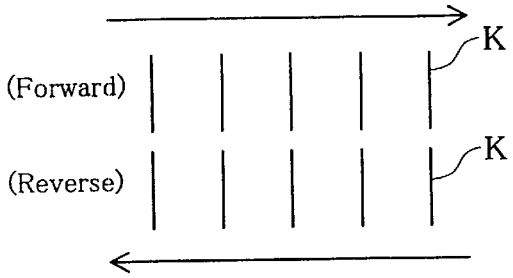
Figure 18C:
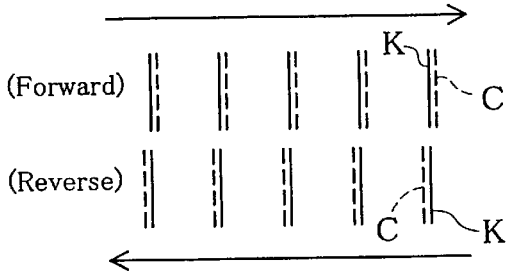
Figure 18D:
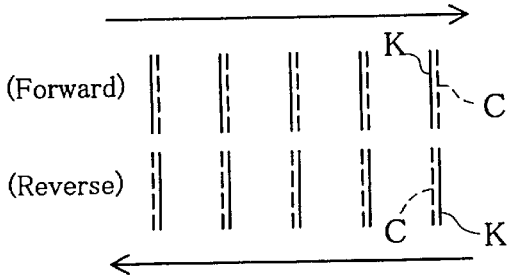

FIGS. 18(A)–18(D) illustrate the correction of positional deviation using reference and relative correction values. FIG. 18(A) shows deviation between vertical lines of black ink dots printed during forward and reverse passes without correction of the positional deviation. FIG. 18(B) shows the result of the positional deviation correction of the black lines using a reference correction value. Thus, correction using the reference correction value eliminated positional displacement of the black-dot lines during bi-directional printing. FIG. 18(C) shows the result of lines printed in cyan as well as black, using the same adjustment as in FIG. 18(B). As in FIG. 10, there is no deviation of the black lines, but there is quite a lot of deviation of the cyan lines. FIG. 18(D) shows black lines and cyan lines printed after correction based on a reference correction value and after also applying a relative correction value $\Delta(=-\delta_C)$ to the cyan dots. This reduced deviation of the cyan dots, and slightly causes the deviation of the black dots. The overall result is that positional deviations of both black dots and cyan dots are decreased to be at about the same degree. This reason is that common correction value is used to correct printing position of the six rows of nozzles during reverse pass. In the example of FIG. 18(D), black dots and cyan dots were selected as the target dots to be subjected to positional correction, and correction of positional deviation is applied to those two types of dots.

Figure 19A:
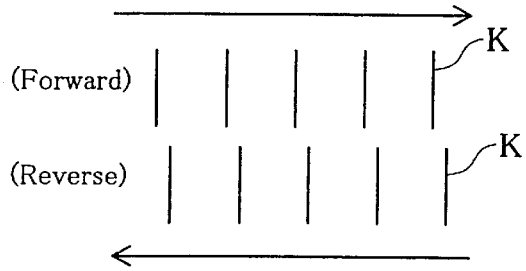
FIGS. 19(A)–19(D) illustrate the correction of positional deviation using reference and relative correction values, when only cyan dots have been selected as the target dots.
Figure 19B:
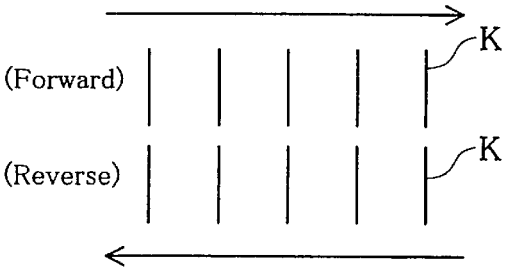
Figure 19C:
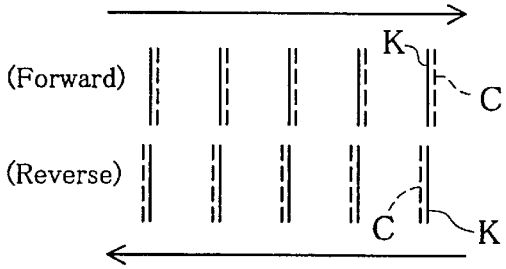
Figure 19D:
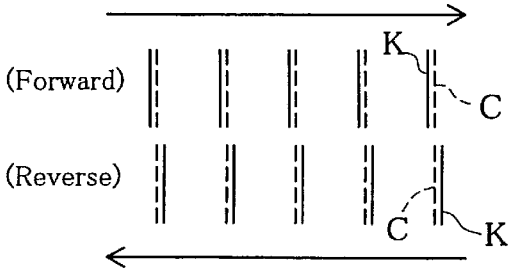

FIGS. 19(A)–19(D) illustrate correction of positional deviation applied to cyan dots only. The reference correction value used in FIGS. 19(A) to 19(C) were the same as those applied in FIGS. 18(A) to 18(C), while the value used in FIG. 19(D) differed from that used in FIG. 18(D). In the case of FIG. 19(D), the relative correction value Δ is an inversion of twice the deviation amount $\delta_C$ of the cyan dots, exactly $-2\delta_C$, determined with the test pattern shown in FIG. 13. While this increases the deviation of the black dots, it reduces positional deviation of cyan dots to virtually to zero.

As can be understood from the examples shown in FIGS. 18(A)–18(D) and FIGS. 19(A)–19(D), when the deviation amount δ of specific dots in the test pattern for determining relative correction values is used as the relative correction value Δ, both the specified dots and the reference dots (black dots) become the target dots for positional deviation correction, thereby making it possible to reduce positional deviation of these target dots. When twice the deviation amount δ of specific dots of the test pattern for determining the relative correction value is used as the relative correction value Δ, only the specific dots are targeted for the positional deviation correction, making it possible to reduce the positional deviation of the target dots. Specifically, using the relative correction value $\Delta(=-(\delta_{LC}+\delta_{LM})/2)$ of equation (2) makes it possible to reduce positional deviations to be at the same degree in respect of three types of dots, black, light cyan and light magenta. Moreover, when the double value is used as the relative correction value, it is possible to reduce positional deviations to be at the same degree in respect of two types of dots, light cyan and light magenta. Similarly, when the relative correction value $\Delta(=-\delta ave)$ of equation (1) is used, it becomes possible to reduce positional deviations to be at the same degree in respect of all six types of dots. Also, when the double value is used as the relative correction value, it is possible to reduce positional deviations to be at the same degree in respect of all types of dots other than the black dots.

As revealed by FIG. 18(D) and FIG. 19(D), adjusting positional deviation based on the reference and relative correction values improves the quality of the color images by preventing the positional deviation of the dots of colored inks from becoming excessively large.

In monochrome printing colored inks are not used, so there is no need for the type of positional adjustment correction using relative correction values as shown in FIG. 18(D) and FIG. 19(D). Thus, in the case of monochrome printing it is preferable to apply deviation correction using just a reference correction value, as shown in FIG. 18(B). Thus, it is preferable to use a configuration whereby when the computer 88 instructs the printer control circuit 40 (specifically, the positional deviation correction section 210 shown in FIG. 17) to print in monochrome, just a reference correction value is used to correct positional deviation during bi-directional printing, and when the instruction is to print in color, both a reference correction value and a relative correction value are used to correct positional deviation during bi-directional printing.

When it becomes necessary, for whatever reason, to replace the print head unit 60, the head ID of the new print head unit 60 is written into the PROM 43 in the control circuit 40 of the printer 20. This can be done in a number of ways. One way is for the user to use the computer 88 to input the head ID displayed on the head ID seal 100 attached to the print head unit 60 to the PROM 43. Another method is for control circuit 40 to retrieve the head ID from the non-volatile memory of the driver IC 126 (FIG. 7) and write it into the PROM 43. Thus storing in the PROM 43 the head ID of the new print head unit 60 ensures that positional deviation during bi-directional printing will be corrected using the suitable head ID (that is, the suitable relative correction value) for that print head unit 60.

As described in the foregoing, in accordance with this first embodiment a relative correction value is set for correcting positional deviation arising during bi-directional printing, with the row of black ink nozzles forming the reference for adjustment carried out in respect of the other rows of nozzles. Thus, this relative correction value and the reference correction value for black ink nozzles are used to correct positional deviation during bi-directional printing, thereby making it possible to improve the quality of the printed color images. An advantage is that a user does not have to make adjustments to correct positional deviation in respect of all inks, but only has to adjust for positional deviation in respect of the reference row of nozzles to achieve improved image quality during bi-directional printing of color images. In the case of monochrome printing, it is only necessary to use a reference correction value to correct for positional deviation during bi-directional printing, which is advantageous in that there is no degradation in the monochrome printing.

Figure 20:
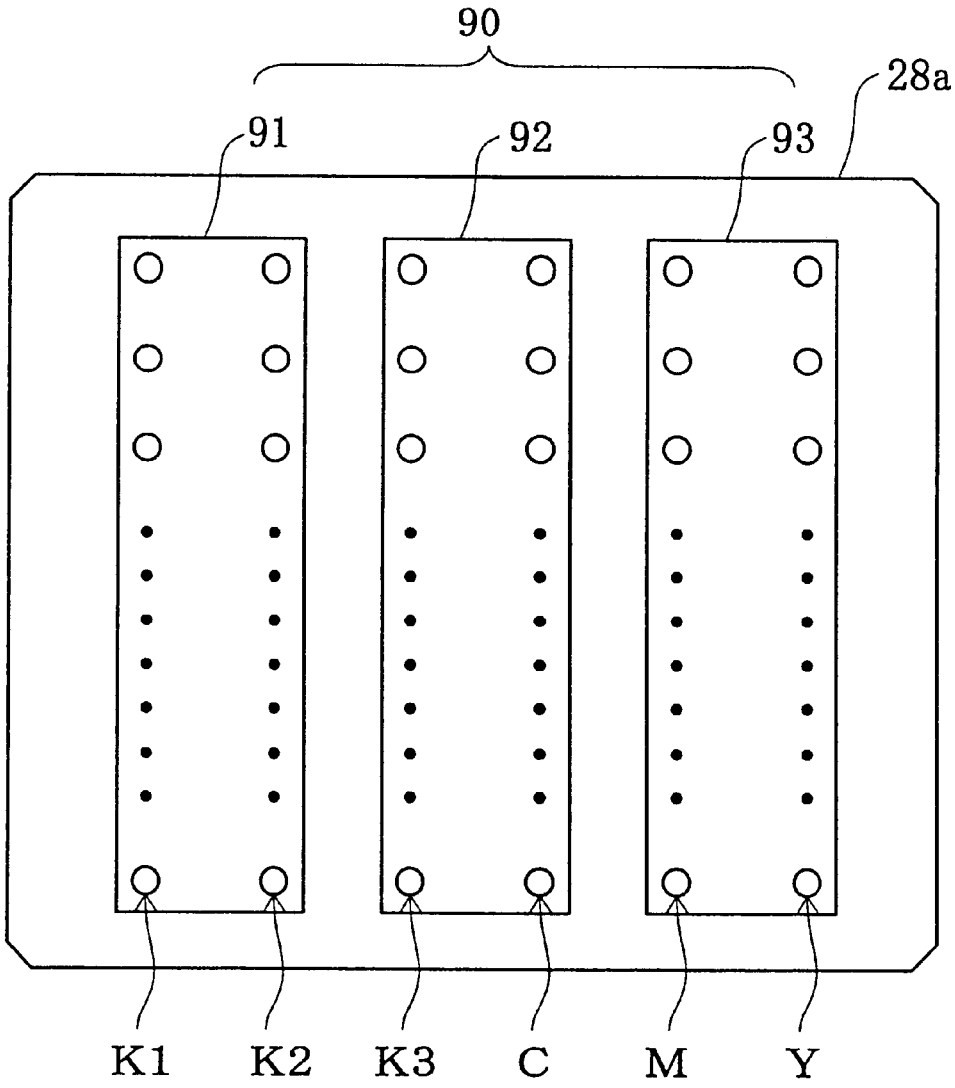
FIG. 20 illustrates the configuration of another print head 28*a*.

FIG. 20 illustrates another configuration of print head nozzles. In this example, print head 28*a* is provided with three rows of black (K) ink nozzles K1 to K3, and one row each of cyan (C), magenta (M) and yellow (Y) ink nozzles. During monochrome printing, the three rows of black ink nozzles can all be used, enabling high-speed printing. During color printing, the two rows of black ink nozzles K1 and K2 of the actuator chip 91 are not used, with printing being performed using the one row of black ink nozzles K3 of actuator chip 92, together with the rows of cyan, magenta and yellow ink nozzles C, M and Y.

When printing in color using this head, the average of the cyan and magenta deviation amounts, or a value that is twice that value, as derived by equations (3a) and (3b), may be used as the relative correction value Δ during bi-directional color printing.

$$\Delta=-(\delta_C+\delta_M)/2 \quad (3a)$$

$$\Delta=-(\delta_C+\delta_M) \quad (3b)$$

$\delta_C$ and $\delta_M$ are relative deviation amounts for cyan and magenta measured from the vertical lines in the test pattern for determining the relative correction value (FIG. 13) while using the third row K3 of black ink nozzles as a reference.

When performing four-color printing without light inks, it is possible to improve the quality of the color images by using the average of the cyan and magenta deviation amounts to determine the head ID. The reason that yellow is disregarded is that yellow dots are not very noticeable, so that even if there is some deviation of yellow dots during bi-directional printing, this does not have any major effect on the image quality. However, the relative correction value may be determined based on the average of the cyan, magenta and yellow deviation amounts. That is to say, the relative correction value may be determined that is based on the average of the deviation amounts of all the rows of nozzles other than the reference row.

The relative correction value ΔK for non-reference black ink nozzle rows K1 and K2 with respect to the reference black ink nozzle row K3 may be obtained, in accordance with equation (4).

$$\Delta K=-(\delta_{K1}+\delta_{K2})/2 \quad (4)$$

where $\delta_{K1}$ is the deviation amount relevant to the first row K1 and $\delta_{K2}$ is the deviation amount relevant to the second row K2.

Positional deviation arising during bi-directional monochrome printing using the three rows of black ink nozzles can be decreased by correcting deviation during bi-directional printing using relative correction value ΔK in respect of rows K1 and K2 and the reference correction value in respect of the reference row K3 (determined in FIG. 15). That is, when printing in monochrome using multiple rows of black ink nozzles, it is desirable to correct positional deviation during bi-directional printing by using a reference correction value in respect of a specific reference row of black ink nozzles, and a relative correction value in respect of the other rows of black ink nozzles.

Figure 21:
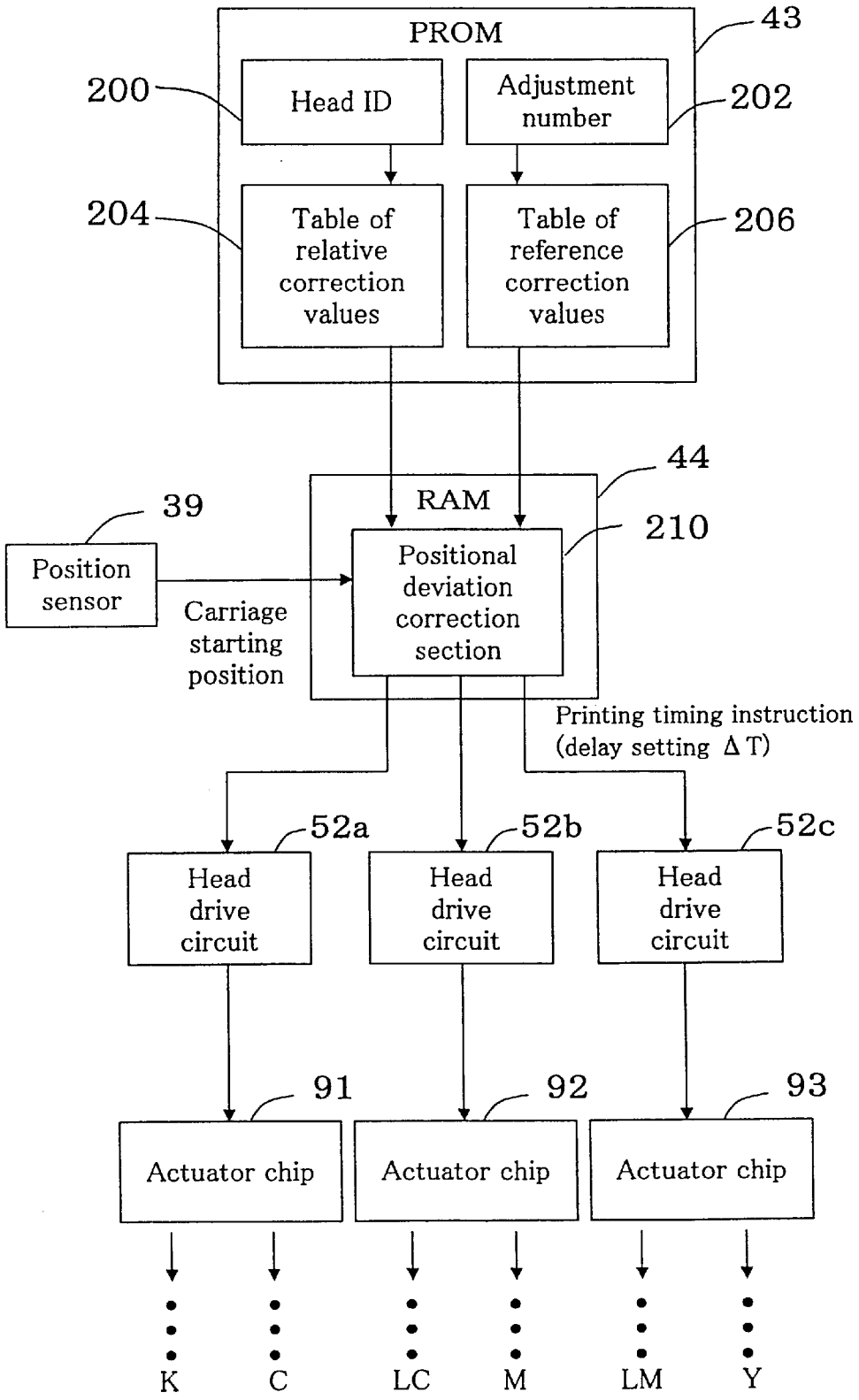
FIG. 21 is a block diagram of a control circuit 40*a* used in a second embodiment.

D. Second Embodiment (Correction of Printing Positional Deviation Between Nozzle Rows (2)):

FIG. 21 is a block diagram of the main configuration involved in the correction of deviation during bi-directional printing in the second embodiment. The difference compared to the configuration of FIG. 17 is that the head drive circuits 52*a*, 52*b* and 52*c* to drive three actuator chips 91, 92 and 93 are provided independently. Thus, printing timing signals from the positional deviation correction section 210 can be independently applied to the head drive circuits 52*a*, 52*b* and 52*c*. Therefore, correction of positional deviation during bi-directional printing can also be effected on an actuator chip by chip basis.

In this second embodiment, too, the row K of black ink nozzles of the first actuator chip 91 is used as the reference. Thus, as in the first embodiment, the reference correction value is determined using a test pattern printed using the row K of black ink nozzles.

In this second embodiment a relative correction value is determined for each actuator chip. That is, as the relative correction value $\Delta_{91}$ for the first actuator chip 91, there can be used a value that is the negative of the deviation amount $\delta_C$ of the vertical lines printed using the row C of dark cyan nozzles, as per equation (4a).

$$\Delta_{91}=-\delta_C \quad (4a)$$

Also, as the relative correction values $\Delta_{92}$, $\Delta_{93}$ for the second and third actuator chips 92 and 93, there can be used values that are each the negative of the average deviation of the nozzle rows of each actuator chip, as per the following equations (4b) and (4c).

$$\Delta_{92}=-(\delta_{LC}+\delta_M)/2 \quad (4b)$$

$$\Delta_{93}=-(\delta_{LM}+\delta_Y)/2 \quad (4c)$$

Also, the relative correction values $\Delta_{92}$ and $\Delta_{93}$ for the second and third actuator chips 92 and 93 may be determined from the amount of printing positional deviation of one specific nozzle row from the reference nozzle row. In such a case, equations (5b) and (5c) can be used in place of equations (4b) and (4c).

$$\Delta_{92}=-\delta^{LC} \quad (5b)$$

$$\Delta_{92}=-\delta_{LM} \quad (5c)$$

The head ID representing the three relative correction values $\Delta_{9l}$, $\Delta_{92}$ and $\Delta_{93}$ are stored in the PROM 43 of the printer 20. The positional deviation correction section 210 is supplied with the relative correction values $\Delta_{92}$, $\Delta_{92}$ and $\Delta_{93}$ corresponding to this head ID. Instead of equations (4a) to (5c), a value that is twice the value of the right-side term of the equations can be used as the relative correction value.

The second embodiment described above is characterized in that a relative correction value can be independently set for each actuator chip. This makes it possible to correct the relative positional deviation from the row of reference nozzles on an actuator chip by chip basis, enabling the positional deviation during bidirectional printing to be further decreased. Also, in the type of printer in which one actuator chip is used to drive three rows of nozzles, a relative correction value can be set independently for each three rows of nozzles.

From the viewpoint of improving the image quality of halftone regions, it is preferable to select light cyan dots and light magenta dots as target dots for positional deviation adjustment to reduce the positional deviation of those dots. However, when color printing is performed using M types of ink (where M is an integer at least 2), dots of specific inks having a relatively low density (which is to say, particular inks other than black) among the M types of dots can be selected as the target dots and the working principle of the first and second embodiments can be applied to reduce the positional deviation of those target dots.

E. Third Embodiment (Correction of Printing Positional Deviation Between Nozzle Rows (3)):

In the first embodiment (FIG. 6), the print head 28 is provided with one actuator chip per two rows of nozzles. Therefore, as shown in FIGS. 18(D) and 19(D), when using the first actuator chip 91, black ink K and cyan ink C lines printed in a forward pass cannot coincide with black ink K and cyan ink C lines printed in a reverse pass. That is, positional deviation of two types of lines printed using a single actuator chip is reduced, but even after adjustment, there is deviation of at least one of the lines. This is also the case in the second embodiment. In this embodiment, the relationship between the nozzle rows and actuator chips is contrived to further decrease positional develop.

Figure 22:
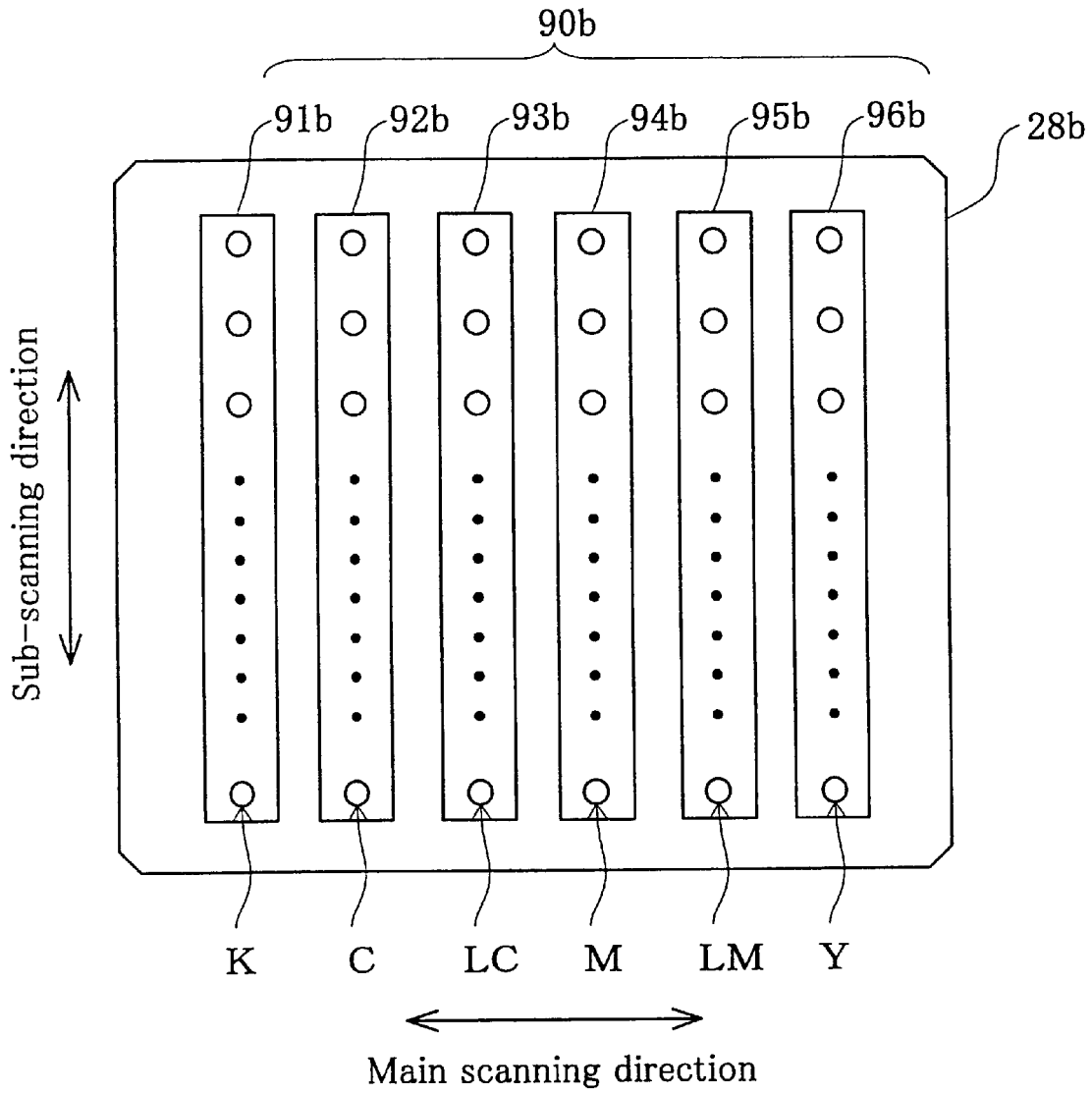
FIG. 22 is a diagram for explaining correspondence between plural rows of nozzles and plural actuator chips in a print head 28*b* of a third embodiment.

FIG. 22 is a diagram for explaining the correspondence between plural rows of nozzles and plural actuator chips in the print head 28*b* of the third embodiment. The actuator circuit 90*b* of the print head 28*b* is provided with 6 actuator chips 91*b*–96*b* to drive the 6 respective nozzle rows K, C, LC, M, LM, Y.

Figure 23:
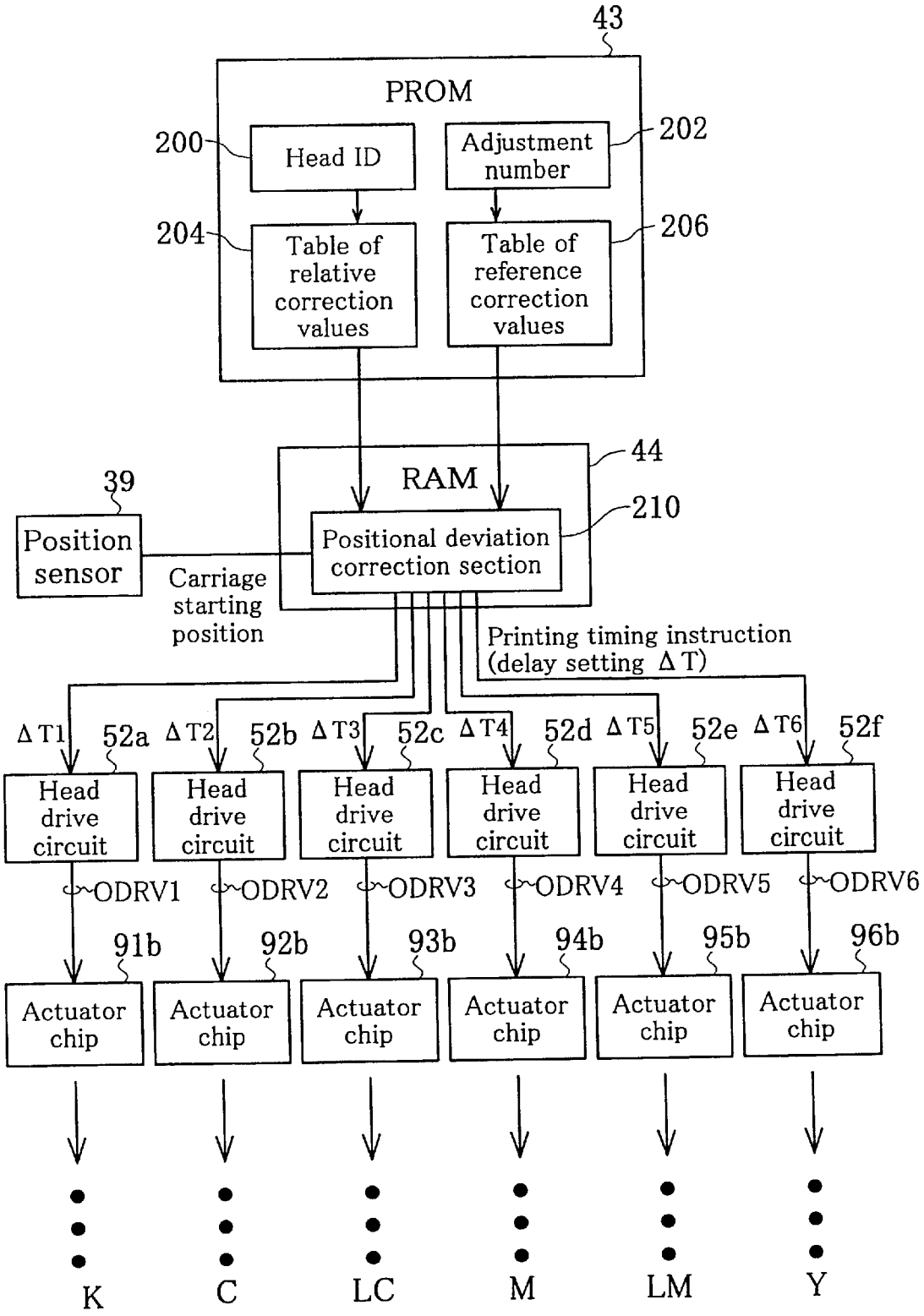
FIG. 23 is a block diagram showing the main configuration involved in correction of deviation during bi-directional printing in a third embodiment.

FIG. 23 is a block diagram showing the main configuration involved in correction of deviation during bi-directional printing in the third embodiment. In this embodiment, 6 head drive circuits 52*a*–52*f* for driving the 6 actuator chips 91*b*–96*b* (FIG. 22) are independently provided. However, in this embodiment, unlike the case of FIG. 21, an actuator chip is provided for each row of nozzles, so there is a head drive circuit provided for each row of nozzles. The positional deviation correction section 210 independently provides to each of the head drive circuits 52*a*–52*f* a print timing instruction (delay setting value ΔT) adapted for each of the actuator chips 91*b*–96*b* that corresponds to a correction value that is a composite of the relative and reference correction values.

In the third embodiment too, the black nozzle row K of the first actuator chip 91*b* can be used as the reference nozzle row. Therefore, as in the first embodiment, the reference correction value is determined from a test pattern (FIG. 16) printed using the black nozzle row K. A relative correction value is determined for each of the actuator chips that drive the nozzle rows. That is, the relative correction values $\Delta_{92b}$–$\Delta_{92b}$ of the second to sixth actuator chips 92*b*–96*b* are determined using the individual deviation amounts $\delta_C$, $\delta_{LC}$, $\delta_M$, $\delta_{LM}$, $\delta_Y$ of the vertical lines formed by each nozzle row, as shown in FIG. 13. Head IDs representing the five relative correction values $\Delta_{92b}$–$\Delta_{92b}$ are read out from a non-volatile memory (not shown) of the print head unit 60 and stored in the head ID storage area 200 in the PROM 43. The positional deviation correction section 210 determines delay setting values ΔT corresponding to the reference correction value and relative correction values $\Delta_{92b}$–$\Delta_{92b}$.

Based on the delay setting values ΔT, individually phase adjusted base drive signals ODRV1–ODRV6 are generated by the head drive circuits 52*a*–52*f* and supplied to the actuator chips 91*b*–96*b*. Thereby, positional deviation correction during bi-directional printing can be effected actuator chip by actuator chip, that is, nozzle row by nozzle row (FIG. 22).

Figures 24A, 24B, 24C, 24D, 24E, 24F, 24G:
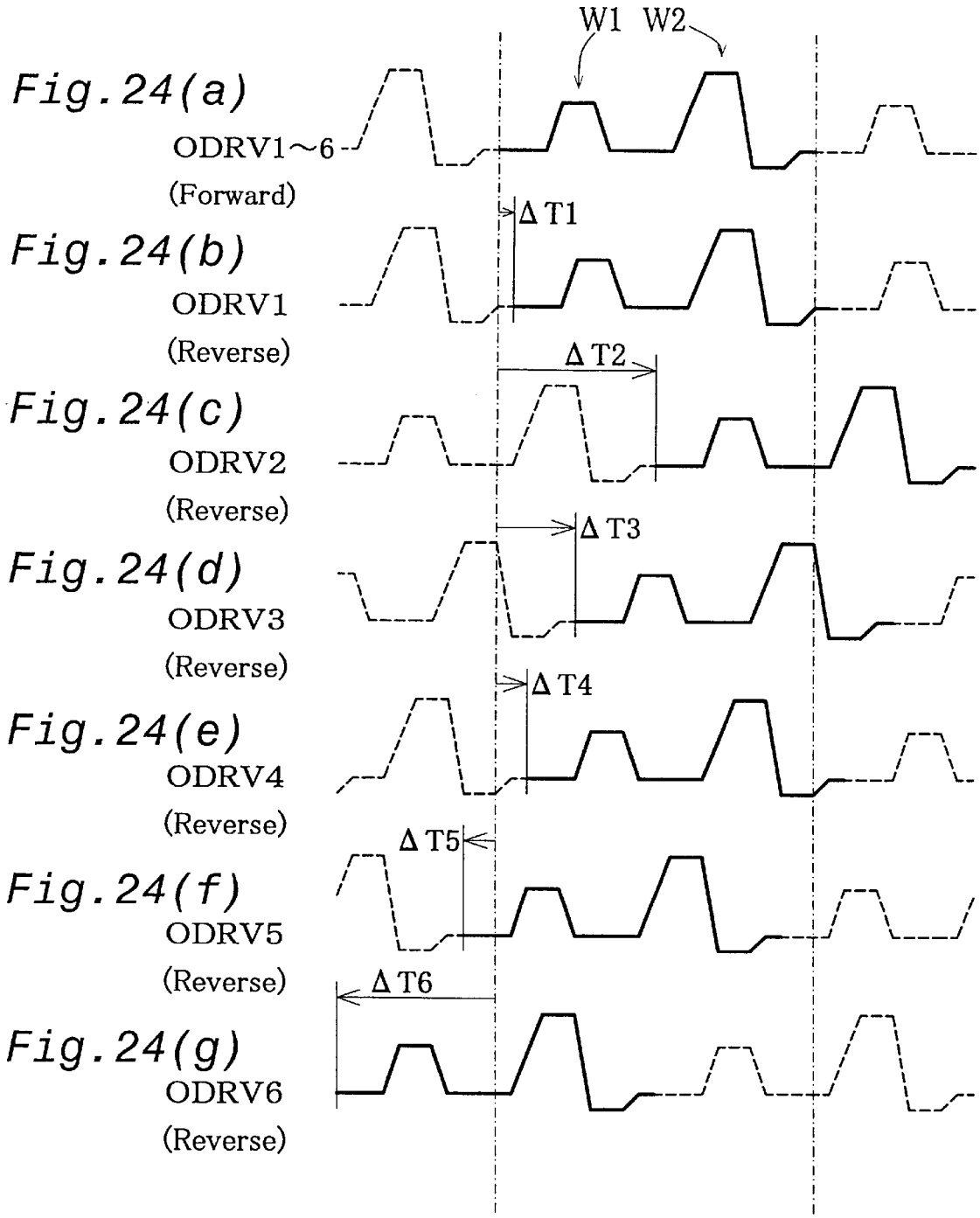
FIGS. 24(*a*)–24(*g*) are diagrams for explaining base drive signals ODRV1–ODRV6 output from head drive circuits 52*a*–52*f*.

FIGS. 24(*a*)–24(*g*) are diagrams for explaining the base drive signals ODRV1–ODRV6 output from the head drive circuits 52*a*–52*f*. The base drive signals ODRV1–ODRV6 each contain two pulses W1, W2 in a single pixel zone. The actuator chips 91*b*–96*b* (FIG. 23) use just the first pulse W1 to generate drive signals for forming small dots and just the second pulse W2 to generate drive signals for forming medium dots. Drive signals for forming large dots are generated by using both of the two pulses W1, W2.

During a forward pass, the head drive circuits 52*a*–52*f* generate the same base drive signals ODRV1–ODRV6 as shown in FIG. 24(*a*). During a reverse pass, the head drive circuits 52*a*–52*f* generate individually phase adjusted base drive signals ODRV1–ODRV6, as shown in FIGS. 24(*b*)–(*g*).

Specifically, the first base drive signal ODRV1 in the reverse pass (FIG. 24(*b*)) is deviated by a time ΔT1 with respect to the first base drive signal ODRV1 in the forward pass (FIG. 24(*a*)). This time ΔT1 is the amount of adjustment based on just the reference correction value. The second to sixth base drive signals ODRV2–ODRV6 (FIGS. 24(*c*)–(*g*)) in a reverse pass are deviated by respective times ΔT2–ΔT6 with respect to the second to sixth base drive signals ODRV2–ODRV6 (FIG. 24(*a*)). These times ΔT2–ΔT6 are the amounts of adjustment based on reference correction value and relative correction values. As can be understood from this explanation, the difference between the times ΔT2–ΔT6 and the time ΔT1 is the amount of the adjustment based on the relative correction value.

Thus using base drive signals ODRV1–ODRV6 that are individually phase adjusted makes it possible to form dots with a different timing for each of the actuator chips 91*b*–96*b* (each nozzle row), making it possible to considerably eliminate positional deviation of dots formed by each row of nozzles during forward and reverse passes in the main scanning direction. Since the times ΔT1–ΔT6 can be set using as the minimum unit a relatively short time such as the clock signal period or the like in the head drive circuit, it is possible to correct positional deviation to a quite high level of precision.

Figure 25A:
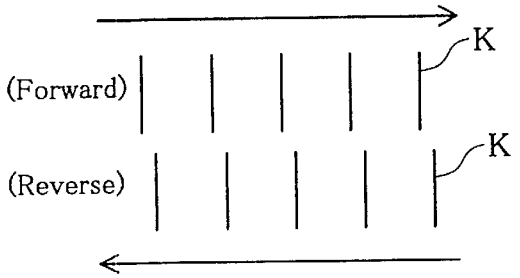
FIGS. 25(A)–25(D) are diagrams for explaining the content of positional deviation correction in the third embodiment.
Figure 25B:
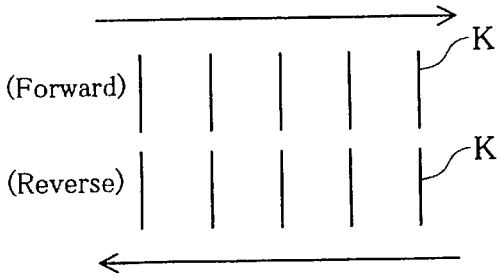
Figure 25C:
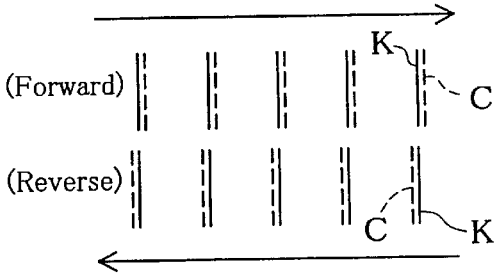
Figure 25D:
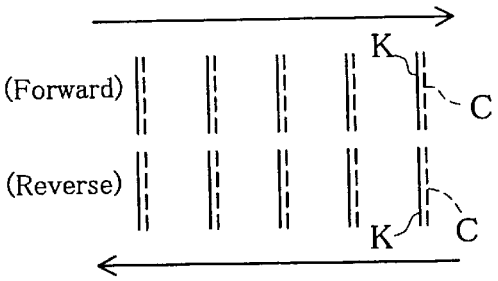

FIGS. 25(A)–25(D) are diagrams for explaining the content of positional deviation correction in the third embodiment. FIGS. 25(A)–(C) are the same as FIGS. 18(A)–(C) and FIGS. 19(A)–(C). FIG. 25(D) shows a black dot line and a cyan dot line that, in addition to being subjected to deviation adjustment based on reference correction values, has been subjected to deviation adjustment using relative correction value $\Delta_{92b}(=-2\delta_C)$ with respect to cyan dots. In FIG. 25(D), relative correction value based deviation adjustment is effected only with respect to reverse pass cyan dots. In this embodiment, as shown in FIG. 25(D), this also enables positional deviation of cyan dots to be eliminated with the positional deviation of the black dots remaining eliminated. Positional deviation relating to the other light cyan dots, magenta dots, light magenta dots, yellow dots can also be eliminated at the same time as the cyan dots.

Figure 26A:
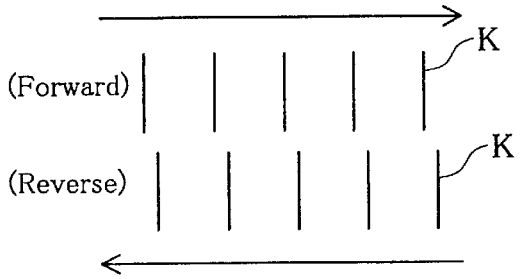
FIGS. 26(A)–26(D) are diagrams for explaining the content of another positional deviation correction in the third embodiment.
Figure 26B:
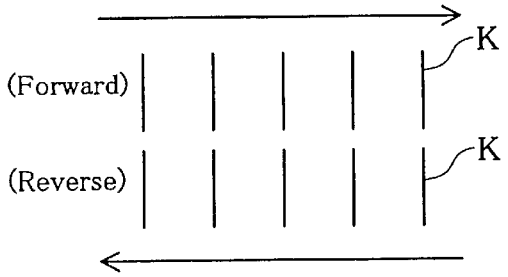
Figure 26C:
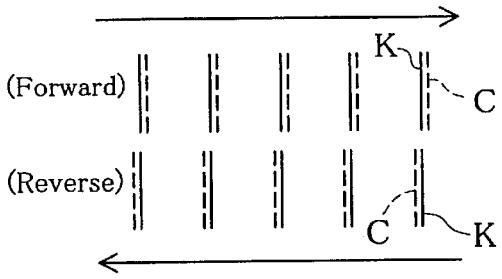
Figure 26D:
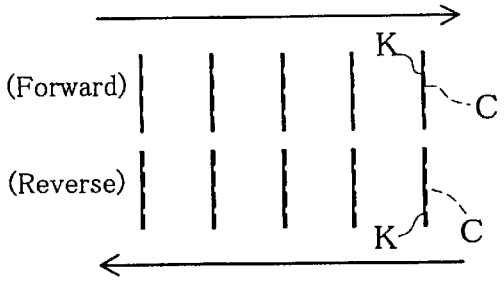

FIGS. 26(A)–26(D) are diagrams for explaining the content of another positional deviation correction in the third embodiment. FIGS. 26(A)–(C) are the same as FIGS. 25(A)–(C). FIG. 26(D) has been subjected to deviation adjustment using a different relative correction value $\Delta_{92b}(=-\delta_C)$ than FIG. 25(D). However, unlike FIG. 25(D), in FIG. 26(D) relative correction value based deviation correction is effected on cyan dots during both forward and reverse passes. Therefore, positional deviation of black dots and cyan dots can be eliminated, as shown in FIG. 26(D), and, moreover, the cyan dot line and the black dot line can be made to substantially coincide. Positional deviation relating to the other light cyan dots, magenta dots, light magenta dots, yellow dots can also be eliminated at the same time as the cyan dots, and these lines can also be made to substantially coincide with the black dot line.

A point that characterizes this embodiment is the ability to set relative correction values independently for each of the actuator chips provided to correspond with each row of nozzles. Since this enables adjustment of relative positional deviation of each nozzle row from the reference nozzle row, it is possible to considerably decrease positional deviation during bi-directional printing. Also, for improving image quality of halftone areas, elimination of positional deviation of just light cyan dots and/or light magenta dots can be used.

Figure 27:
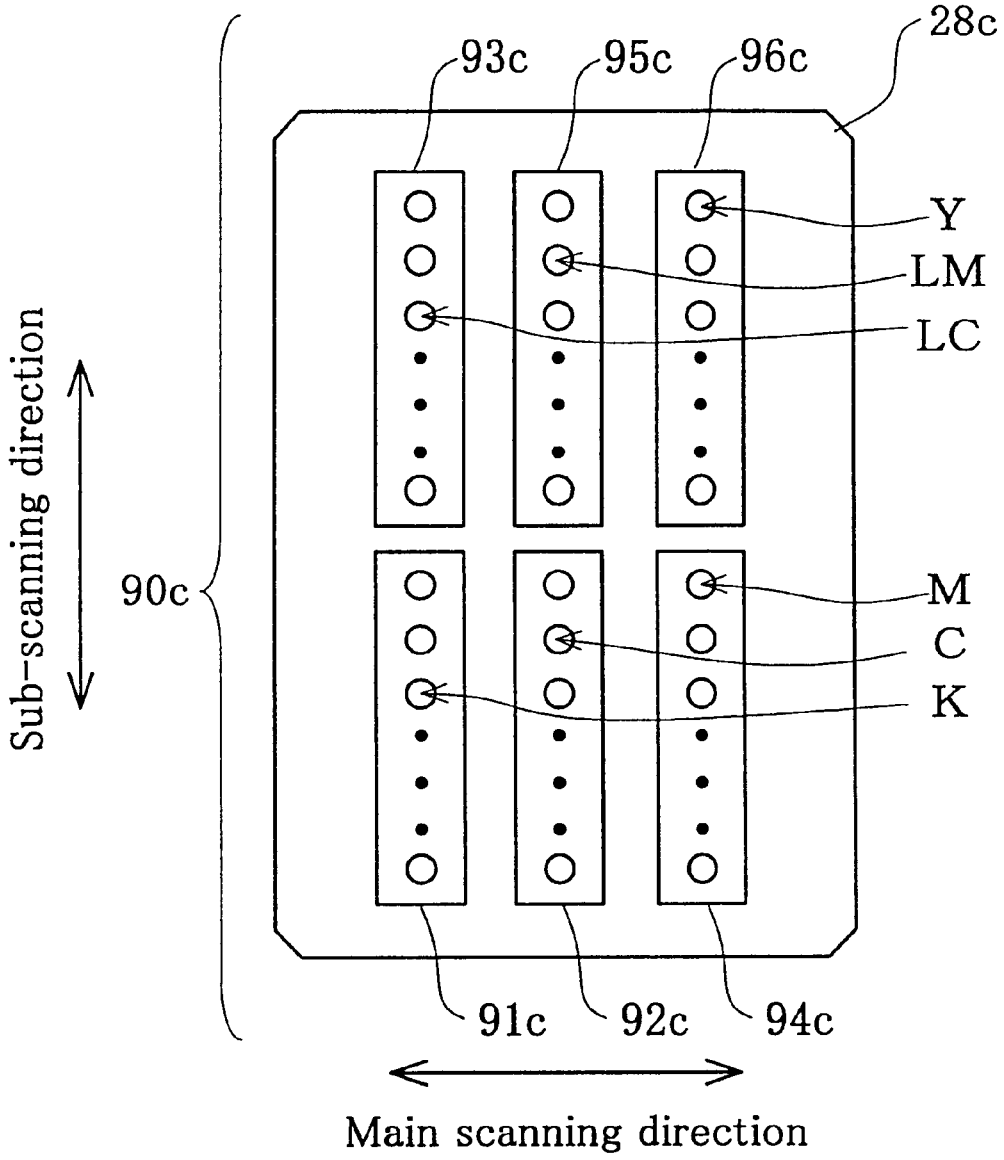
FIG. 27 is a diagram for explaining an example of a modification of the print head 28*b* of FIG. 22.

FIG. 27 is a diagram for explaining an example of a modification of the print head 28*b* of FIG. 22. As in FIG. 22, actuator circuit 90*c* of this print head 28*c* is provided with 6 actuator chips 91*c*–96*c* to drive the 6 respective nozzle rows K, C, LC, M, LM, Y. However, the way the 6 nozzle rows are arrayed differs from the print head 28*b* of FIG. 22.

That is, in FIG. 22 the 6 nozzle rows are arrayed in the main scanning direction, while in FIG. 27 they are arranged as two tiers in the sub-scanning direction, each of three nozzle rows arrayed in the main scanning direction.

When the rows of nozzles are arrayed in two tiers, as in FIG. 27, two nozzle rows K, LC arrayed in a straight line in the sub-scanning direction can be driven by a single actuator chip. However, as mentioned previously, positional deviation of dots printed in the main scanning direction arises not only from manufacturing tolerance of the actuator chips but also from the physical qualities of the ink (for example viscosity) and the mass of the ink droplets and the like. This being the case, it is preferable to provide an actuator chip for each row of nozzles, even when a plurality of rows of nozzles for different types of ink are arrayed in a straight line in the sub-scanning direction, as shown in FIG. 27.

As can be understood from the above explanation, it is preferable for the plurality of piezoelectric elements to be divided into groups corresponding to the plurality of nozzles arrayed in the sub-scanning direction. It is also preferable for the piezoelectric elements to be divided into groups for each type of ink emitted by the corresponding nozzles. In this embodiment, as shown in FIG. 22 and FIG. 27, the piezoelectric elements are divided into groups by different actuator chip. Also, each actuator chip is supplied with base drive signals that have been individually phase adjusted. The actuator chips shape the base drive signals and supply drive signals to the piezoelectric elements of each group. This makes it possible to considerably reduce deviation caused by variations in the operating characteristics of piezoelectric elements, or in other words, printing positional deviation in the main scanning direction arising from manufacturing tolerance of the actuator chips, and printing positional deviation in the main scanning direction arising from the fact that the nozzles emit different types of ink.

Moreover, as can be understood from the above explanation, the head drive circuits 52*a*–52*f* of this embodiment correspond to a base drive signal generator of the invention, and the 6 actuator chips 91*b*–96*b* correspond to the drive signal supply section of the invention.

F. Fourth Embodiment (Correction of Printing Positional Deviation Between Nozzle Rows (4)):

In the third embodiment, printing positional deviation between nozzle rows is corrected by adjusting the phase of base drive signals during forward and reverse passes, but deviation can also be corrected by adjusting the printing signals input to the printer 20.

Figure 28:
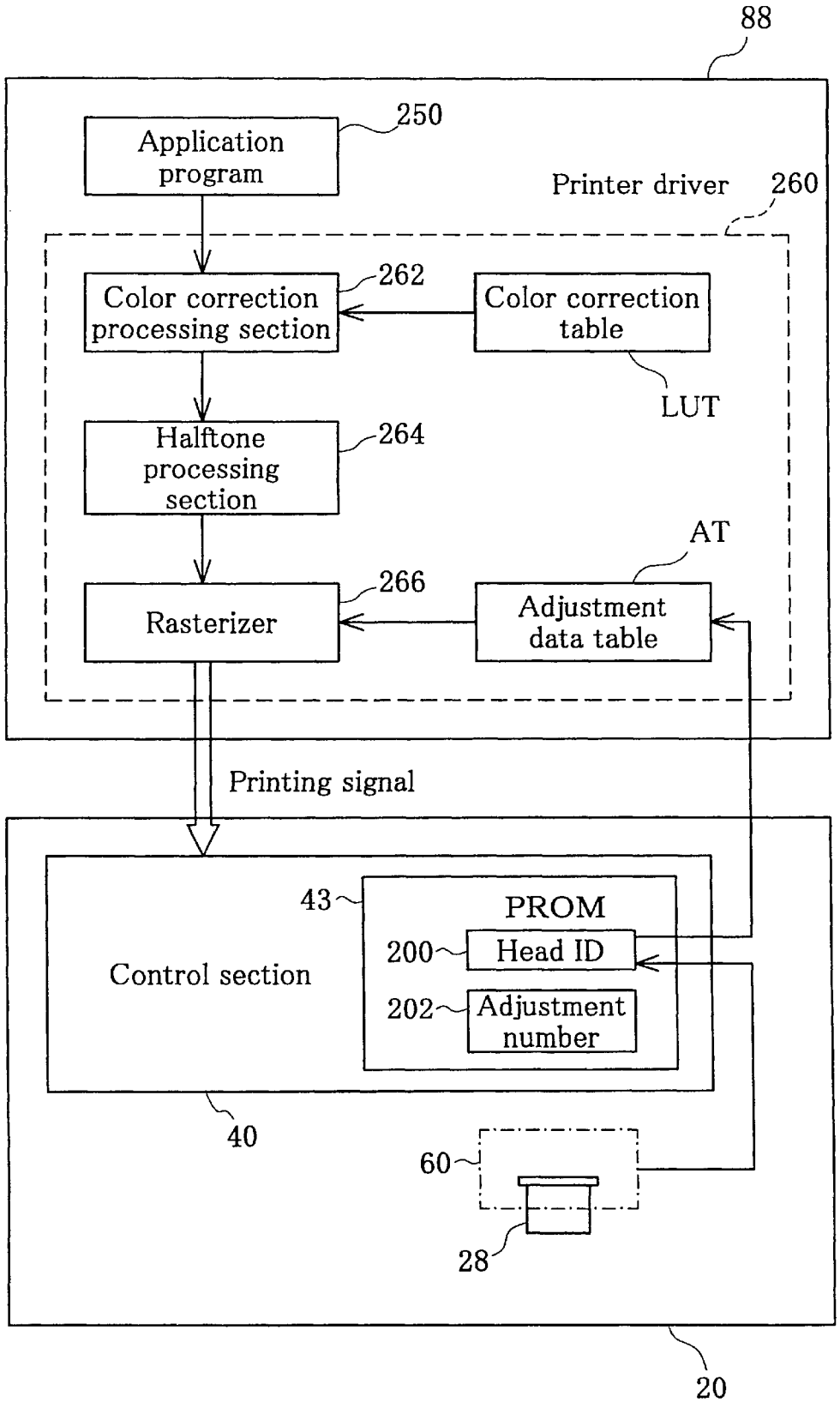
FIG. 28 is a diagram for explaining the internal processing of the computer 88 shown in FIG. 2.

FIG. 28 is a diagram for explaining the internal processing of the computer 88 shown in FIG. 2. In the computer 88, an application program 250 operates under a specific operating system. The operating system incorporates a printer driver 260. Image data generated by the application program is converted to printing signals by the printer driver 260 and supplied to the printer 20.

The printer driver 260 includes a color correction processing section 262, a color correction table LUT, a halftone processing section 264, a rasterizer 266 and an adjustment data table AT.

The color correction processing section 262 performs color correction processing that corrects color components of image data supplied from the application program 250 to color components corresponding to the ink used by the printer 20. Specifically, R, G, B tone value data (image data) is converted to tone value data (color correction image data) for each ink. This color correction processing is performed with reference to the color correction table LUT in which is stored the corresponding relationship between the color components of the image data and the color components of the ink used to express those colors.

The halftone processing section 264 performs halftone processing for expressing tone value data (color correction image data) of each ink as a dot printing density. Data output by the halftone processing section 264 represents the types of dots (small dot, medium dot, large dot) at each pixel position on the print medium.

The rasterizer 266 rearranges halftone processed data into an order suitable for transfer to the printer 20, and outputs printing signals (printing data). In the course of this, the rasterizer 266 adds adjustment data to the rearranged data. That is, the rasterizer 266 reads out head ID stored in the PROM 43 provided in the control circuit 40 of the printer 20, refers to the adjustment data table AT to determine the adjustment data corresponding to the head ID, and adds printing data. Also, the head ID is read out of a non-volatile memory, not shown, in the print head unit 60 and stored in the head ID storage area 200 of the PROM 43. Printing signals output from the printer driver 260 are transferred to the control circuit 40 of the printer 20. In this embodiment, positional deviation of dots formed during forward and reverse passes in a main scanning direction is adjusted by using the printing data to which this adjustment data has been added.

This embodiment has been explained assuming that there is no positional deviation with respect to the reference nozzle row K (that is, that the reference correction value based on the adjustment number stored in the adjustment number storage area 202 of the PROM 43 is zero). This embodiment has also been explained with respect to a case in which the phase of base drive signals output by the head drive circuit 52 (FIG. 2) is not adjusted with respect to either forward pass or reverse pass.

Figures 29A, 29B:
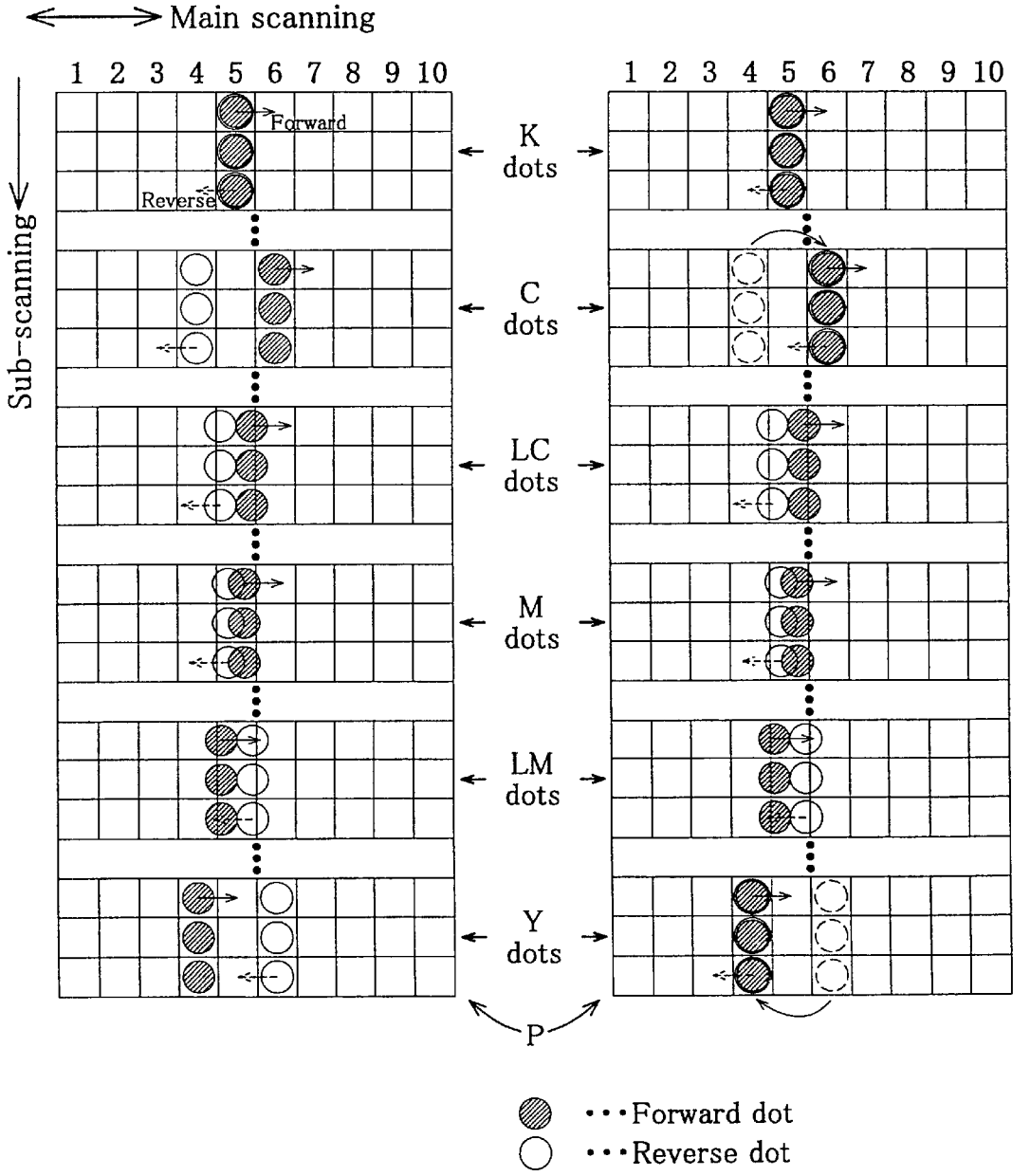
FIGS. 29(A) and 29(B) are diagrams for explaining the content of positional deviation correction in a fourth embodiment.

FIGS. 29(A) and 29(B) are diagrams for explaining the content of positional deviation correction in a fourth embodiment. FIGS. 29(A),(B) show dots emitted from each of the nozzle rows K, C, LC, M, LM, Y before and after adjustment. In the drawing, ○ marks that are hatched show forward dots formed during a forward pass, and ○ marks that are not hatched show reverse dots formed during a reverse pass. Symbols "1"–"10" in the drawing indicate the row number of each pixel on the paper P; all of the dots are dots that are to be formed on the paper P on the fifth row of the pixel positions. The following explanation focusses on these dots.

As shown in FIG. 29(A), prior to adjustment, only K dots are formed without positional deviation on the fifth row of the pixel positions during forward and reverse passes. Positional deviation is produced with respect to other dots, particularly with respect to C dots and Y dots which are deviated by the amount of one pixel between the forward and reverse passes. In this embodiment, the target is adjustment of positional deviation of the relatively large C dots and Y dots, and printing positional deviation is corrected in pixel units. In the case of FIG. 29(B), however, adjustment of positional deviation is effected only during a reverse pass. That is, with respect to C dots, reverse dots are formed on the sixth row of pixel positions, the same as forward dots prior to adjustment. Also, with respect to Y dots, reverse dots are formed on the fourth row of pixel positions, the same as forward dots prior to adjustment. Thus, positional deviation of C dots and Y dots in the main scanning direction can be eliminated. Other dots are not subject to adjustment, and so with respect thereto it is the same as FIG. 29(A).

FIGS. 30(*a*)–30(*f*) are diagrams for explaining the printing data when the adjustment shown in FIGS. 29(A),(B) is performed. However, of the 6 types of dots shown in FIGS. 29(A),(B), FIGS. 30(*a*)–(*f*) show raster data relating to K dots and C dots and LC dots of one main scanning pass. FIGS. 30(*a*),(*b*) show K dot forward data during a forward pass and reverse data during a reverse pass. Similarly, FIGS. 30(*c*),(*d*) show C dot forward data and reverse data, and FIGS. 30(*e*),(*f*) show LC dot forward data and reverse data.

As shown by FIGS. 30(*a*)–(*f*), each raster data includes dot data of 10 pixels and adjustment pixel data A1–A4 of 4 pixels. Dot data symbols "1"–"10" in the drawing correspond to the symbols showing the pixel position in FIG. 29(A),(B). That is, dot data is data that represents dots formed at each pixel position on each main scanning line on the paper P. The 4 adjustment pixel data A1–A4 are data representing non-formation of dots. ○ marks with hatching in the fifth row of dot data correspond to the forward dots shown in FIG. 29(B), and ○ marks that are not hatched correspond to the reverse dots shown in FIG. 29(B). During printing the forward data of FIGS. 30(*a*),(*c*),(*e*) are used in order starting from the data at the left end, and during printing the reverse data of FIGS. 30(*b*),(*d*),(*f*) are used in order starting from the data at the right end.

FIGS. 30(*a*),(*b*) are K dot forward data and reverse data, in which, as understood from FIGS. 29(A),(B), the K dots are not subject to adjustment and therefore are not adjusted. At this time, in both the forward data and reverse data, the two adjustment pixel data A1, A2 are distributed to the left end of the dot data of 10 pixels and the two adjustment pixel data A3, A4 are distributed to the right end. This is also the same with respect to the LC dot forward data and reverse data of FIGS. 30(*e*),(*f*).

FIGS. 30(*c*),(*d*) are C dot forward data and reverse data, in which, as understood from FIGS. 29(A),(B), the C dots are adjusted during reverse passes. Consequently, similarly to the K dots and LC dots, the two adjustment pixel data A1, A2 are distributed to the left end of the dot data and the two adjustment pixel data A3, A4 are distributed to the right end. With respect to reverse data, the four adjustment pixel data A1–A4 are distributed to the left end of the dot data and no adjustment pixel data is distributed to the right end. Thereby, as shown in FIGS. 29(A),(B), pixel positions of C dots formed during a reverse pass prior to adjustment (fourth row) can be shifted by the amount of two pixels to be changed to pixel positions of C dots formed during a forward pass (sixth row).

With respect also to Y dots, by generating raster data such as that shown in FIGS. 30(*c*),(*d*), pixel positions of Y dots formed during a reverse pass prior to adjustment (sixth row) can be shifted by the amount of two pixels to be changed to pixel positions of Y dots formed during a forward pass (fourth row), as shown in FIGS. 29(A),(B).

The above determination of the adjustment data is accomplished on the basis of the relationship between the head ID stored in the adjustment data table AT and the distribution ratio of a prescribed number (4, in this embodiment) of adjustment pixel data. In this way, positional deviation during forward and reverse passes of dots in the main scanning direction can be eliminated in pixel units.

Figures 31A, 31B:
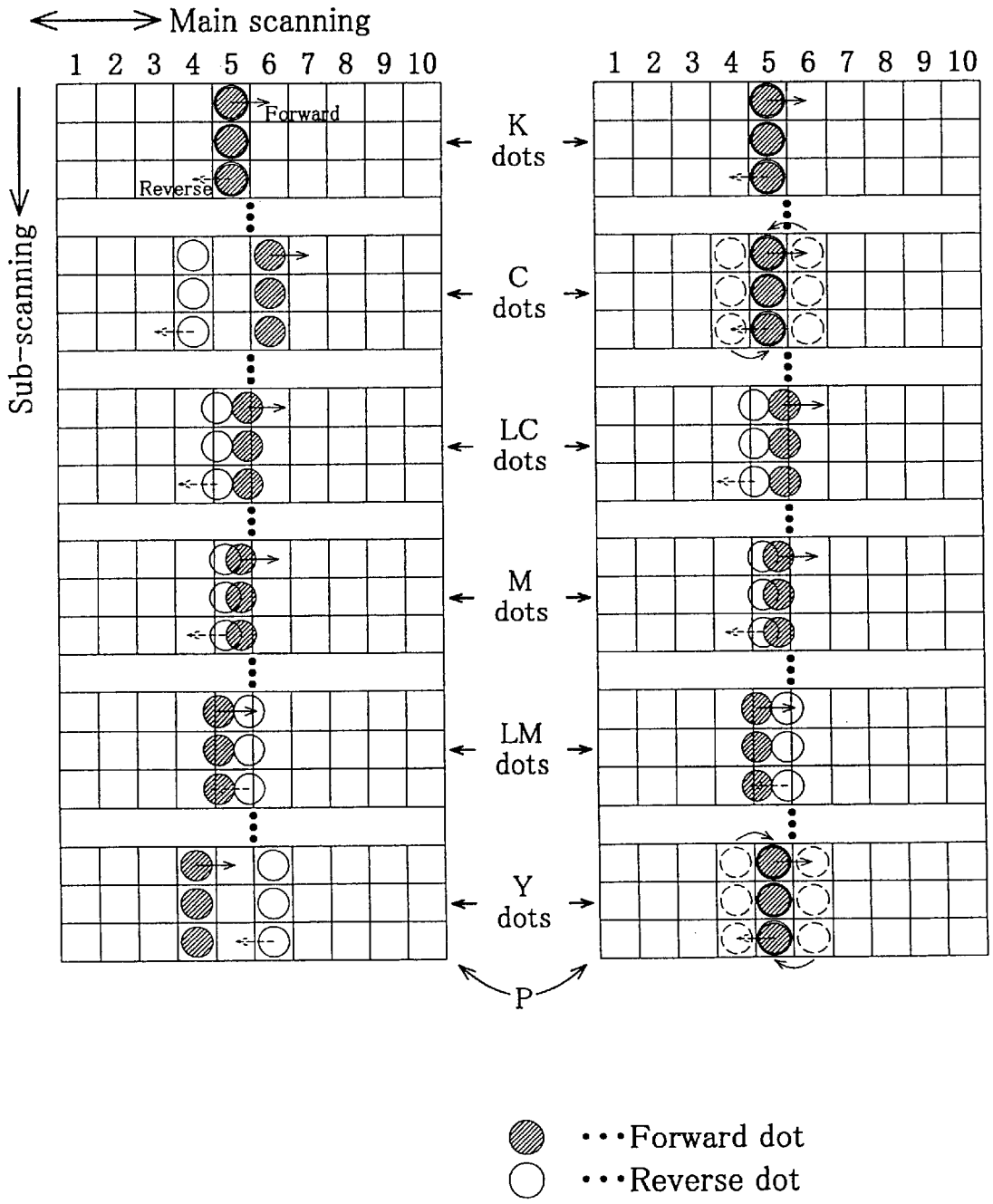
FIGS. 31(A) and 31(B) are diagrams for explaining an example of a modification of the positional deviation correction of the fourth embodiment.

FIGS. 31(A) and 31(B) are diagrams for explaining an example of a modification of the positional deviation correction of the fourth embodiment. Pre-adjustment FIG. 31(A) is the same as FIG. 29(A), and post-adjustment FIG. 31(B) is different from FIG. 29(B). That is, in FIG. 29(B), positional deviation is only corrected during a reverse pass, but in the case of FIG. 31(B), positional deviation is corrected with respect to both forward and reverse passes. Moreover, in FIG. 31(A),(B), positional deviation of the relatively large C dots and Y dots is corrected in pixel units. In the case of FIG. 31(B), adjustment is performed so that C dots and Y dots are formed at pixel positions on the fifth row during forward and reverse passes. The result is that positional deviation of C dots and Y dots in the main scanning direction is eliminated, and K dots and C dots and Y dots are formed at the same pixel positions on the fifth row.

FIGS. 32(*a*)–32(*f*) are diagrams for explaining the printing data when the adjustment shown in FIGS. 31(A),(B) is performed. However, similarly to FIGS. 30(A),(B), of the 6 types of dots shown in FIGS. 31(A),(B), FIGS. 32(*a*)–(*f*) show data of K dots and C dots and LC dots.

FIGS. 32 (*a*),(*b*) are K dot forward data and reverse data; as understood from FIGS. 31(A),(B), the K dots are not subject to adjustment and therefore are not adjusted. Therefore, as in the case of FIGS. 30(*a*),(*b*), in both the forward data and reverse data, the two adjustment pixel data A1, A2 are distributed to the left end of the dot data and the two adjustment pixel data A3, A4 are distributed to the right end. This is also the same with respect to the LC dot forward data and reverse data of FIGS. 32(*e*),(*f*).

FIGS. 32(*c*),(*d*) are C dot forward data and reverse data, in which, as understood from FIGS. 31(A),(B), the C dots are adjusted during forward and reverse passes. The one adjustment pixel data A1 is distributed to the left end of the dot data and the three adjustment pixel data A2–A4 are distributed to the right end. With respect to reverse data, relationship is the reverse to that of the forward data, with the three adjustment pixel data A1–A3 being distributed to the left end of the dot data and the one adjustment pixel data A4 being distributed to the right end. Thereby, as shown in FIGS. 31(A),(B), pixel positions of C dots formed during a forward pass prior to adjustment (fourth row) can be shifted by the amount of one pixel to be changed to pixel positions in the fifth row. Also, pixel positions of C dots formed during a reverse pass prior to adjustment (sixth row) can be shifted by the amount of one pixel to be changed to pixel positions in the fifth row.

With respect also to Y dots, by generating raster data such as that shown in FIGS. 32(*c*),(*d*), pixel positions of Y dots formed during a forward pass prior to adjustment (fourth row) can be shifted by the amount of one pixel to be changed to pixel positions on the fourth row, as shown in FIGS. 29(A),(B). Also, pixel positions of Y dots formed during a reverse pass prior to adjustment (sixth row) can be shifted by the amount of one pixel to be changed to pixel positions on the fifth row. This also enables positional deviation during forward and reverse passes of dots in the main scanning direction to be eliminated in pixel units.

In this way, the printer driver 260 (FIG. 28) prepares a prescribed number of adjustment pixel data for decreasing printing positional deviation during forward and reverse passes in the main scanning direction, distributes adjustment pixel data to both ends of the dot data in accordance with the head ID, and generates printing data. Moreover, distribution to both ends of the dot data is also meant to include a state in which all adjustment pixel data is distributed to either one end of the dot data, with no adjustment pixel data being distributed to the other end. If printing is effected using this printing data, there is no need to generate multiple types of base drive signal, as in the second and third embodiments, enabling printing positional deviation of dots in the main scanning direction to be readily decreased.

As can be understood from the foregoing explanation, the printer driver 260 of this embodiment corresponds to the printing data generation section of the invention, and the rasterizer 266 and adjustment data table AT correspond to the adjustment data determination section of the invention.

In this embodiment, printing positional deviation of dots printed in the main scanning direction is decreased by generating printing data in which a prescribed number of adjustment pixel data are distributed to both ends of the dot data. Instead of this, printing data can be generated that includes distribution data that shows the distribution ratio of the prescribed number of adjustment pixel data. In this case, distribution data for each ink can be included in the printing data header or the like. At this time, based on the distribution data, the printer 20 prepares the prescribed number of adjustment pixel data and performs the printing. In this way, by determining the prescribed number of adjustment pixel data and distribution data and the like in accordance with the head ID, and printing using printing data that includes adjustment data thus determined, it is possible to reduce printing positional deviation during forward and reverse passes in the main scanning direction.

This fourth embodiment has been explained assuming that there is no positional deviation with respect to the reference nozzle row K (that is, that the reference correction value is zero), but even when there is positional deviation with respect to the reference nozzle row, positional deviation of dots in the main scanning direction can be adjusted by using printing data that includes adjustment data. In this case, the adjustment data can be determined using adjustment number stored in the adjustment number storage area 202 and the head ID stored in the head ID storage area 200 of the PROM 43 (FIG. 2).

Also, while the fourth embodiment has been explained with respect to a case in which the phase of base drive signals output from the head drive circuit 52 (FIG. 2) is not adjusted, printing data containing adjustment data can be used, and the phase of the base drive signals can be adjusted. For example, the phase of base drive signals can be adjusted in accordance with an adjustment number that indicates the reference correction value, and printing data can be generated that includes adjustment data based on head ID that indicates the relative correction value.

G. Fifth Embodiment (Correction of Printing Positional Deviation Between Dots of Different Sizes):

In the first through forth embodiments described in the foregoing, printing positional deviation between rows of nozzles is corrected. In the fifth embodiment described below, printing positional deviation between dots of different sizes is corrected.

Figure 33A:
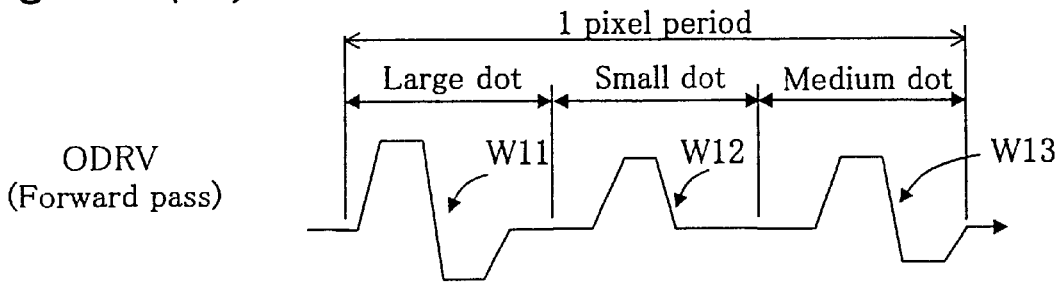
FIGS. 33(*a*) and 33(*b*) show the waveforms of a base drive signal ODRV used in a fifth embodiment.
Figure 33B:
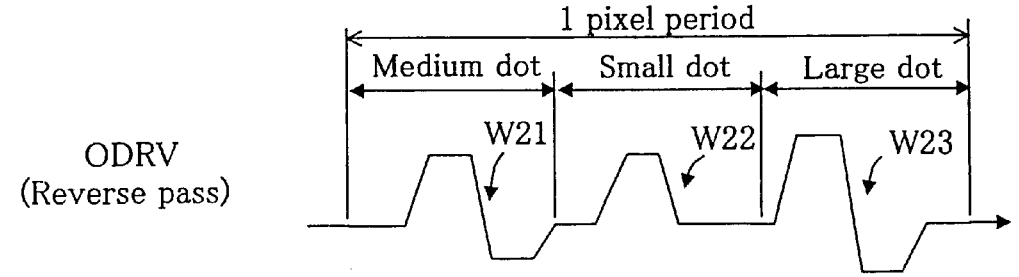

FIGS. 33(*a*) and 33(*b*) illustrate the waveform of a base drive signal ODRV that is supplied from the head drive circuit 52 (FIG. 2) to the print head 28. During a forward pass, in a single pixel period, the base drive signal ODRV generates a large dot waveform W11, a small dot waveform W12 and a medium dot waveform W13, in that order. And during a reverse pass, in a single pixel period, a medium dot waveform W21, a small dot waveform W22 and a large dot waveform W23 are generated, in that order. During a forward pass or a reverse pass, any one of the three waveforms can be selectively used to print a large, small or medium dot at a pixel position.

Figure 34:
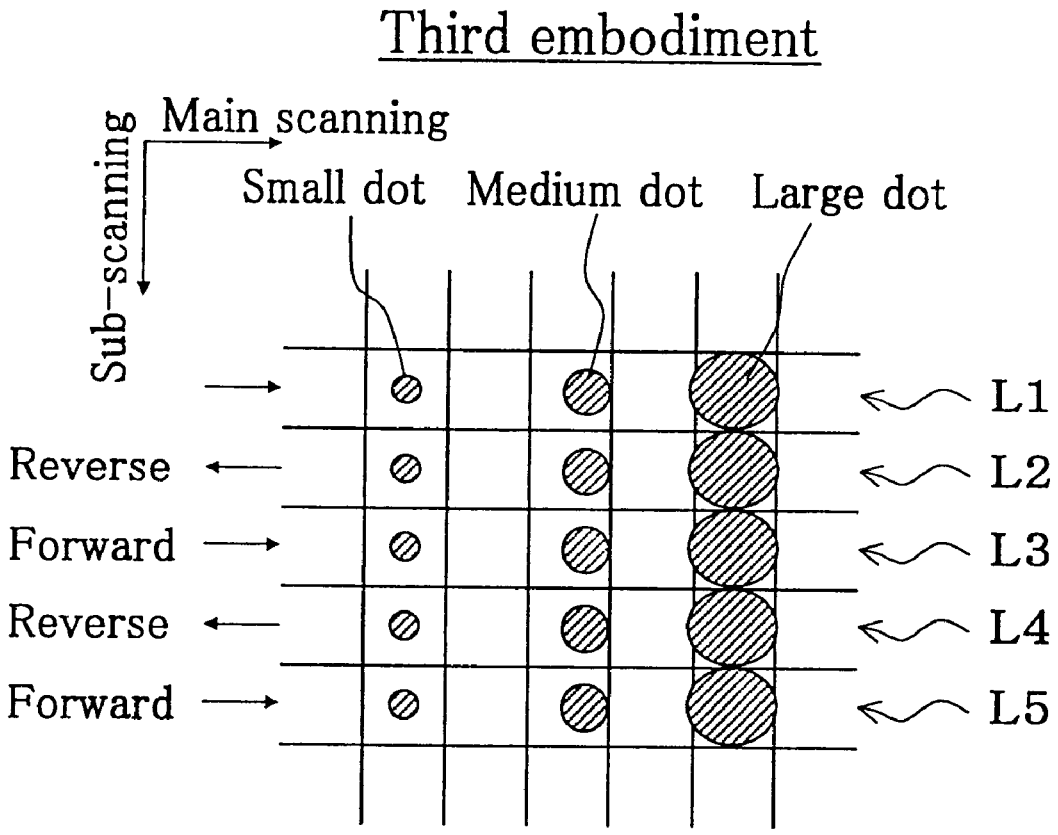
FIG. 34 shows the three types of dots formed in the fifth embodiment.

The different orders of the large, medium and small dot waveforms in the forward and reverse passes substantially match the dot positions in the main scanning direction. FIG. 34 shows the three types of dots formed using the base drive signals ODRV shown in FIG. 33. The grid of FIG. 34 shows pixel areas; that is, each square of the grid corresponds to the area of a single pixel. The dot inside each pixel area is printed by ink droplets emitted by the print head 28 as the print head 28 is moved in the main scanning direction. In the example of FIG. 34, odd numbered raster lines L1, L3, L5 are printed on a forward pass and even numbered raster lines L2, L4 are printed on a reverse pass. By adjusting the amount of ink emitted on a pixel by pixel basis, at each pixel position it is possible to form dots of any of the three different sizes.

Small dots formed in either a forward pass or a reverse pass are located more or less in the center of a pixel region. Medium dots are formed on the right side of a pixel region, while large dots take up substantially the whole of a pixel region. Using the base drive signals ODRV shown in FIGS. 33(*a*) and 33(*b*) makes it possible to obtain a substantial match between the point of impact of ink droplets emitted during a forward pass and the point of impact of ink droplets emitted during the reverse pass. In practice, of course, some positional deviation will arise between dots printed bi-directionally, which is why it is necessary to make positional adjustments.

Figure 35:
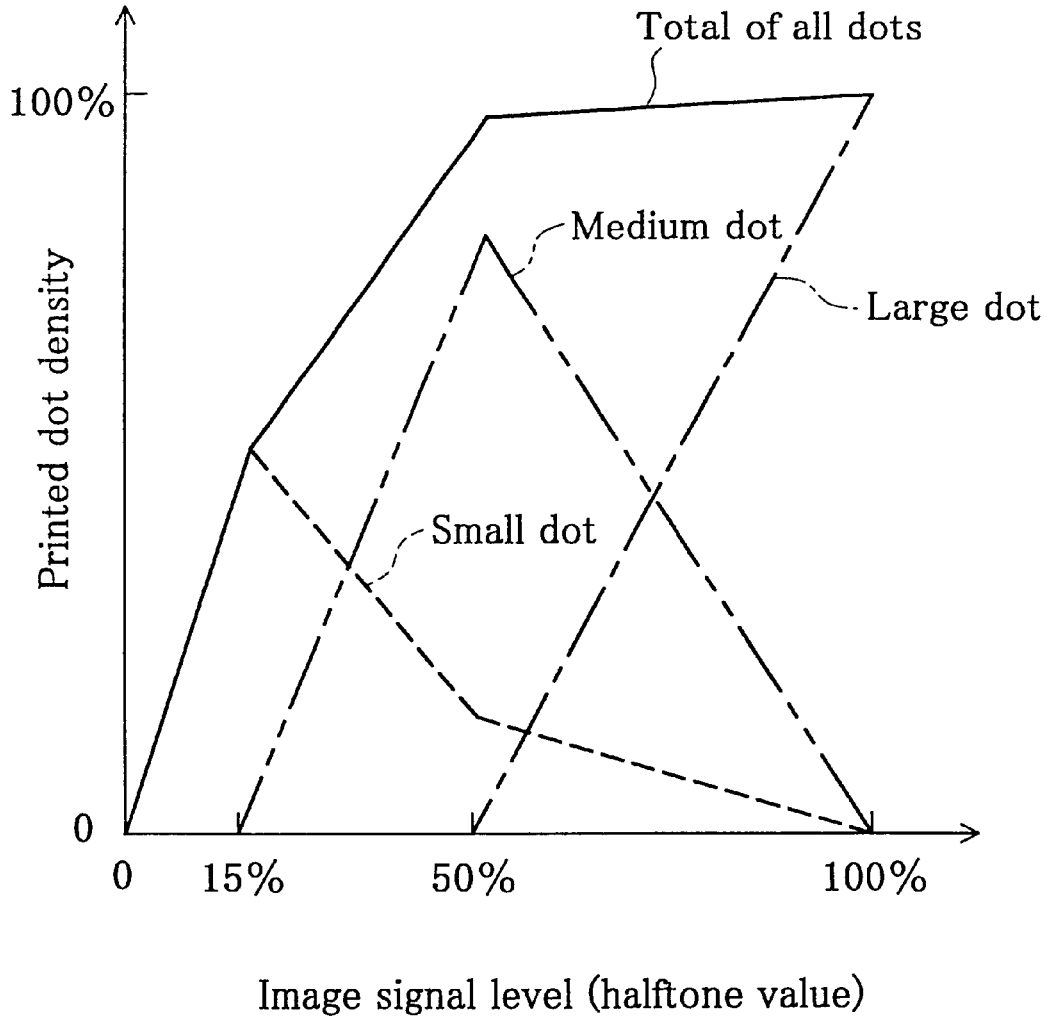
FIG. 35 is a graph illustrating a method of reproducing halftones using the three types of dots.

FIG. 35 is a graph illustrating a method of reproducing halftones using the three types of dots. In FIG. 35 the horizontal axis is the relative image signal level and the vertical axis is the printed dot density. Here, printed dot density refers to the proportion of the pixel positions in which dots are formed. For example, in a region containing 100 pixels in which dots are formed at 40 pixel positions, the printed dot density is 40%. The image signal level corresponds to a halftone value indicating image density tone (density level).

In the graph of FIG. 35, in a halftone range in which the image signal level is from 0% to 16%, the printed dot density of small dots increases linearly from 0% to approximately 50% with the increase in image signal level. As a result, at an image portion in which the image signal level is approximately 16%, small dots are formed at about half the dot positions. In a halftone range in which the image signal level is from approximately 16% to approximately 50%, the printed dot density of small dots decreases linearly from approximately 50% to approximately 15% with the decrease in image signal level, while the printed dot density of medium dots increases linearly from 0% to approximately 80%. In a halftone range in which the image signal level is from approximately 50% to 100%, the printed dot density of small and medium dots decreases linearly down to 0% with the increase in image signal level, while the printed dot density of large dots increases linearly from 0% to 100%. Thus, by using one through three types of dots to print each portion of the image in accordance with the image signal level of that image portion, it is possible smoothly to linearly reproduce the density level of an image.

Deviation between printing positions on a forward pass and printing positions on the reverse pass are readily noticeable in halftone regions where the tone range is up to approximately 50% (especially in a range of approximately 10% to approximately 50%). Deviation between the printing positions on a forward pass and the printing positions on the reverse pass in the case of medium and small dots, which are used extensively in halftone regions, tends to be readily noticeable in images in halftone regions.

A problem that arises when a test pattern for adjusting positional deviation arising in bi-directional printing is printed using medium or small dots is that a user finds it difficult to perceive positional deviation in the test pattern. Therefore, a test pattern that is to be used for adjustment by a user should be printed using large dots. In the fifth embodiment, taking all this into consideration, when a user is to be making the adjustments, the reference correction value for correcting positional deviation is set using a test pattern printed using large dots. Moreover, correcting this reference correction value using a relative correction value determined beforehand makes it possible to effect adjustment during printing that reduces printing positional deviation of small and medium dots.

The process sequence used in the fifth embodiment is the same as that used in the first embodiment described with reference to FIGS. 11, 12 and 15. However, the test pattern used to determine relative correction values differs from that used in the first embodiment.

Figure 36:
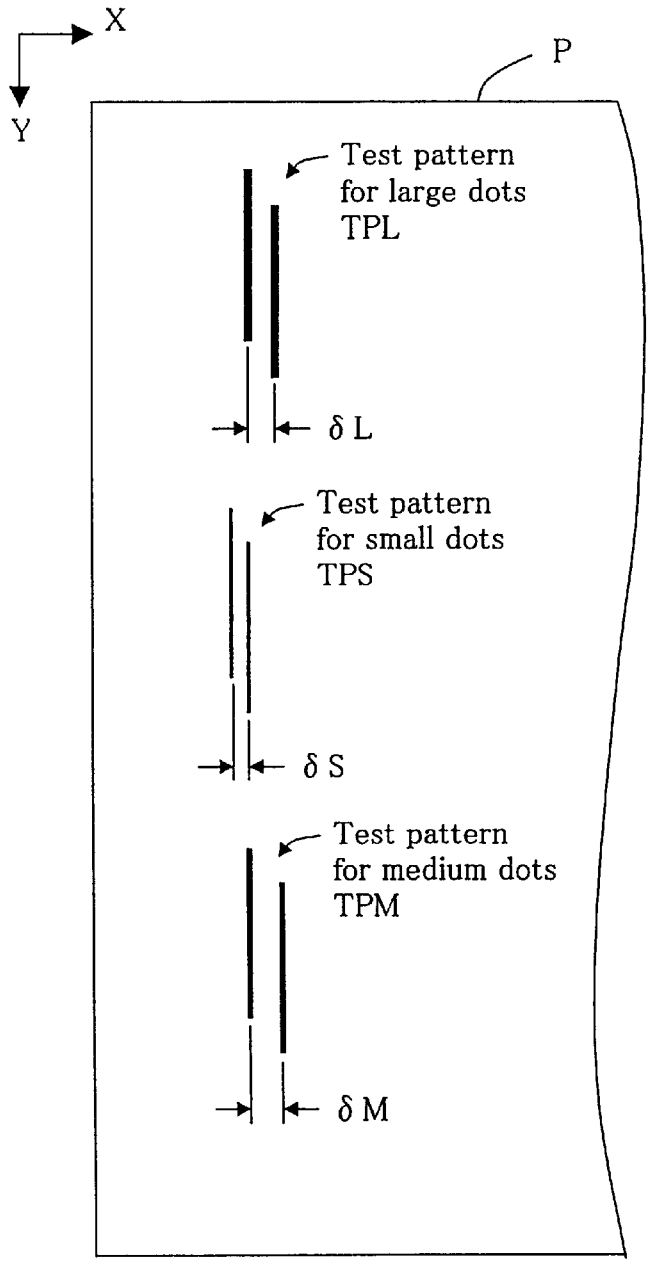
FIG. 36 shows an example of a test pattern used for determining relative correction values in the fifth embodiment.

FIG. 36 shows an example of a test pattern for determining relative correction values. The test pattern printed on paper P includes a test pattern TPL for large dots, a test pattern TPS for small dots and a test pattern TPM for medium dots. The three test patterns TPL, TPS and TPM each comprise a pair of vertical lines formed in black ink in forward and reverse passes by the printer. To facilitate accurate measurement of the lines, it is desirable to form the lines as straight lines one dot in width.

In the fifth embodiment, the deviation measurement of step S12 (FIG. 12) is carried out by measuring the amount of deviation δL, δS and δM between the lines of the test patterns TPL, TPS and TPM of FIG. 25 printed on a forward pass and the lines printed on the reverse pass. This can be done by using a CCD camera, for example, to read the test pattern images and processing the images to measure the positions of the lines in the main scanning direction x.

In step S13, the deviation amounts δL, δS and δM thus measured are used to determine relative correction values which are then stored in PROM 43 in the printer 20. The relative correction value is the differential between the amount of deviation with respect to reference dots and the amount of deviation with respect to dots other than the reference dots. When large dots are used as the reference dots, relative correction value ΔS for small dots and relative correction value ΔM for medium dots are given by the following equations (6a) and (6b).

$$\Delta S=(\delta S-\delta L) \tag{6a}$$

$$\Delta M=(\delta M-\delta L) \tag{6b}$$

Instead of relative correction values ΔS, ΔM, the three deviation amounts δL, δS, δM may be stored in the printer PROM 43. Thus, it does not matter as long as information is stored in the PROM that substantially represents the relative correction value. It is not necessary to store relative correction values for all the other dots other than the reference dots in the PROM 43, so long as there is at least one such value stored therein (ΔS, for example).

The test patterns for each of the dots may be comprised of multiple pairs of vertical lines. In such a case, the average positional deviation of the pairs of vertical lines for each type of dot can be employed as the printing positional deviation amount for the dots concerned. Instead of vertical lines, a pattern can be used comprised of straight lines formed by dots printed intermittently.

Moreover, a part of the test pattern may be printed in chromatic color ink, meaning a color other than black, such as magenta, light magenta, cyan, light cyan, and so forth. For example, the large dot test pattern TPL could be printed in black ink and the small and medium test patterns TPS and TPM could be printed in color. In a color image, small and medium chromatic color dots have a major effect on the quality of halftone image portions. This means that the quality of halftone image portions of color images can be improved by using a relative correction value for small or medium dots of chromatic color ink.

In the fifth embodiment, the test pattern for determining reference correction values (test pattern of reference positional deviation), shown in FIG. 16, consists of multiple pairs of vertical lines printed with large dots of black ink during forward and reverse passes.

Test patterns for determining reference correction values are formed using the reference dots employed to determine relative correction values. This means that if the reference dots used in determining relative correction values are large magenta dots instead of large black dots, the test pattern for determining reference correction values will also be formed using large magenta dots.

A test pattern that is to be used for adjustment of the positional deviation by a user should be printed using largest dots as the reference dots. This is advantageous in that it makes it easier for the user to perceive positional deviation in the test pattern, thereby enabling more accurate adjustment.

Figure 37A:
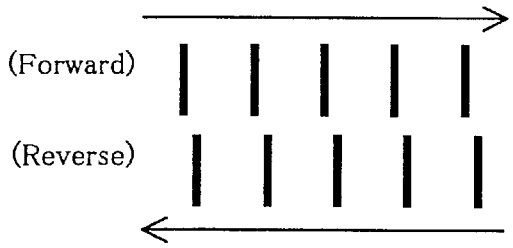
FIGS. 37(A)–37(D) illustrate the positional deviation correction implemented in the fifth embodiment.
Figure 37B:
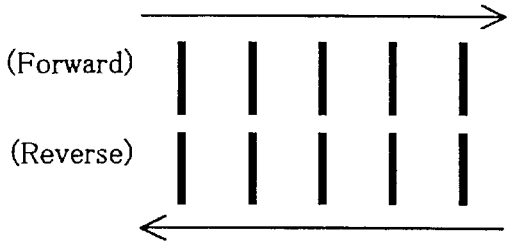
Figure 37C:
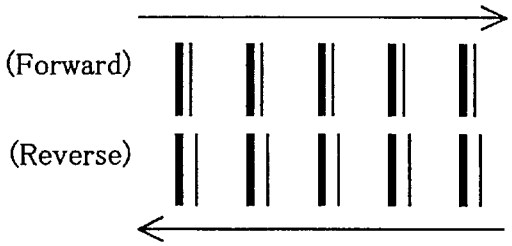
Figure 37D:
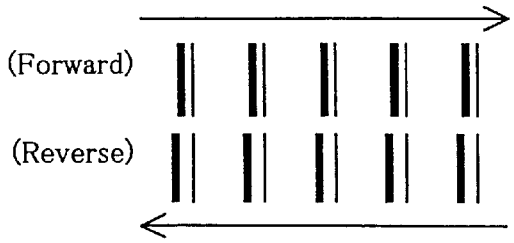

In the fifth embodiment, too, positional adjustment is implemented using the same configuration shown in FIG. 17 or FIG. 21. FIGS. 37(A)–37(D) illustrate the positional deviation adjustment implemented in the fifth embodiment. FIG. 37(A) shows deviation between vertical lines formed of large dots (reference dots) printed during forward and reverse passes without the adjusting to correct the positional deviation. FIG. 37(B) shows the hypothetical result of using a reference correction value to correct the positional deviation of the large dots. Thus, correction using the reference correction value eliminated positional deviation of the large dots arising during bi-directional printing. FIG. 37(C) shows vertical lines formed of large dots and lines formed of small dots, using the same adjustment condition as that used with respect to FIG. 37(B). In FIG. 37(C), deviation of the large dots has been eliminated but deviation of the small dots has not. In color images, the image quality of halftone regions is particularly critical, and positional deviation of small dots has a greater effect on the image quality than that of large dots. FIG. 37(D) shows vertical lines formed of large dots that have been subjected to deviation adjustment based on the reference correction value and the relative correction value ΔS for small dots. In FIG. 37(D), positional deviation of the small dots is reduced, while deviation of the large dots has increased slightly. Thus, as revealed by FIG. 37(D), deviation of small dots can be decreased, thereby improving the quality of halftone regions of color images, by using a reference correction value and a relative correction value.

When medium dots have a greater effect on image quality than small dots, positional deviation can be corrected by using a relative correction value ΔM for medium dots. When small dots and medium dots have roughly the same effect on image quality, positional deviation can be corrected using a value that is the average Δave of the relative correction values for small and medium dots, given by equation (7).

$$\Delta ave=\{(\delta S-\delta L)+(\delta M-\delta L)\}/2=\{(\delta S+\delta M)/2\}-\delta L \tag{7}$$

As can be seen from equation (7), the average Δave of the relative correction values is the differential between an average of the deviation amounts δS, δM relating to the small and medium dots and the deviation amount δL relating to the reference dots.

As can be understood from this example, relative correction values do not have to relate to target dots of one specific size, but can be averaged for plural types of dots. The term "target dots" as used herein means one or plural types of dots subject to positional deviation correction. Target dots may include reference dots.

When printing in monochrome, positional deviation of large dots can have a larger effect on image quality. As such, in monochrome printing it is preferable to correct positional deviation using only the reference correction value for black dots, as shown in FIG. 37(B). Therefore, a configuration is desirable whereby, when the computer 88 communicates to the printer control circuit 40 (actually, the positional deviation correction section 210 of FIG. 17) that a printing operation is monochrome printing, just a reference correction value is used to correct positional deviation during bi-directional printing, while when the printing operation is color printing, positional deviation during bi-directional printing is corrected using both reference and relative correction values.

It may be possible, even in color printing, that positional deviation of the reference dots is particularly noticeable. In this case, it is preferable to correct the positional deviation using the reference correction value itself as an adjustment value. That is, the positional deviation correction section (adjustment value determination section) 210 can determine an adjustment value in accordance with either a first adjustment mode in which an adjustment value is determined from reference and relative correction values, or a second adjustment mode in which the reference correction value itself is employed as an adjustment value.

As described in the foregoing, in accordance with this fifth embodiment an adjustment value for correcting positional deviation of small and medium dots is determined by correcting a large dot reference correction value with a relative correction value prepared beforehand, thereby making it possible to improve the image quality of halftone regions. Since the test pattern for the user's adjustment is formed of large dots, the user can accurately determine an adjustment value to correct the positional deviation.

H. Sixth Embodiment (Setting of Head ID Based on Pre-assembly Check)

In accordance with the sixth embodiment, printing positional deviation arising from manufacturing tolerance with respect to the actuator chips is measured before the print head unit 60 is assembled onto the printer to ascertain whether the print head unit 60 can pass inspection. Equipping printers 20 with print head units 60 that pass the inspection makes it possible to manufacture printers able to provide high printing quality.

Figure 38:
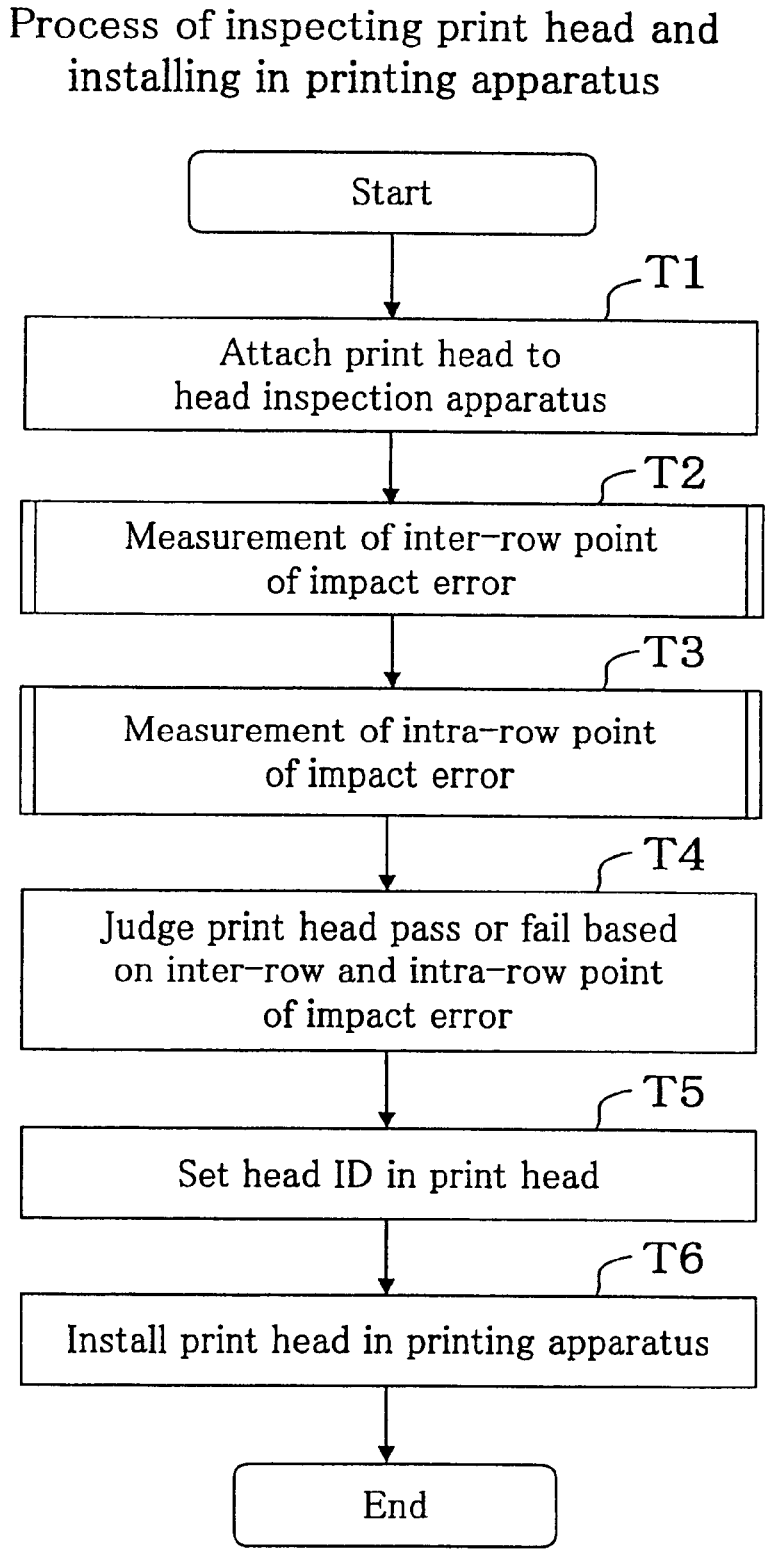
FIG. 38 is a flow chart of the procedure used in the sixth embodiment to inspect the print head unit and install it in the printer.

FIG. 38 is a flow chart of the procedure used to inspect the print head unit and assemble it on the printer. In step T1, print head unit 60 (FIG. 3) is mounted on a head inspection apparatus.

Figure 39:
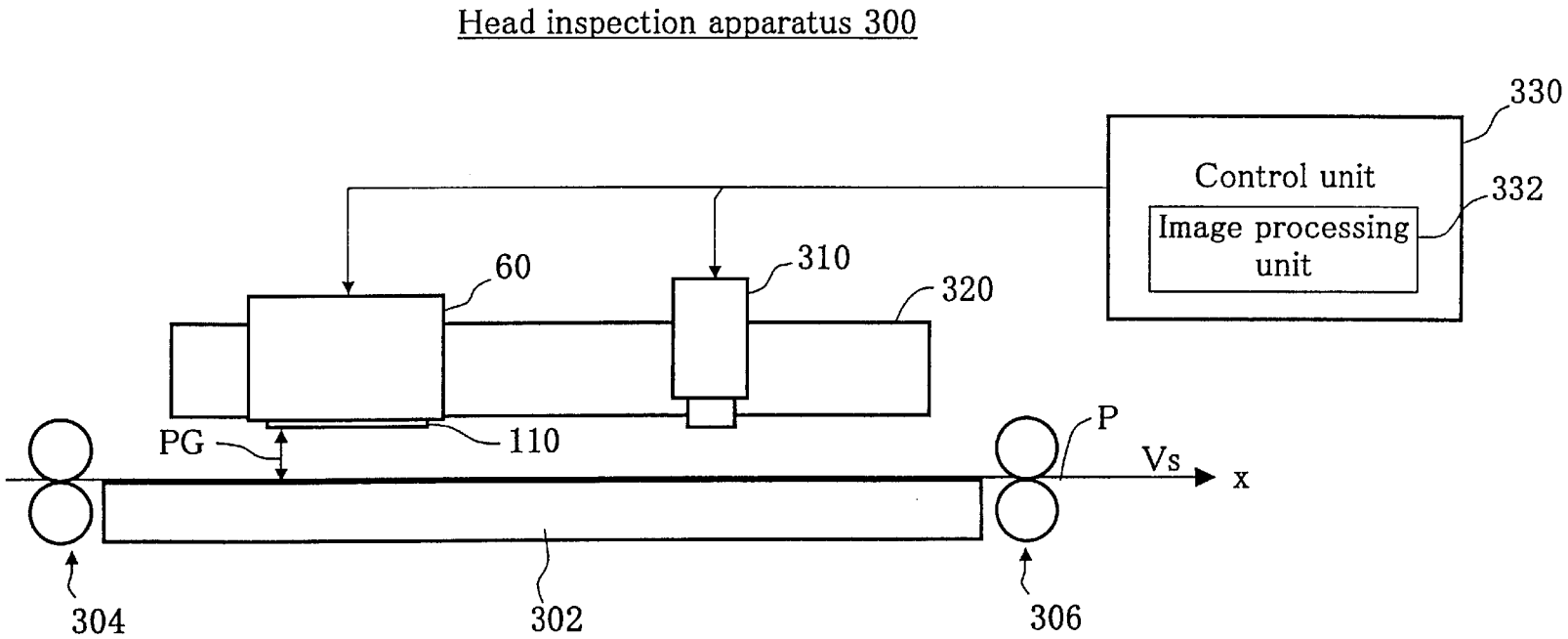
FIG. 39 is a general view of the head inspection apparatus 300.

FIG. 39 is a general view of the head inspection apparatus 300. The head inspection apparatus 300 comprises a stage 302 that serves to simulate a printer platen, transport rollers 304 and 306 for moving paper P over the stage 302, a CCD camera 310 and a control unit 330. A support section 320 holds the print head unit 60 and CCD camera 310 over the stage 302.

The control unit 330 is constituted by an ordinary computer system that includes CPU and memory, and functions to print a test pattern on the paper P by supplying drive signals that cause the print head unit 60 to emit ink, and to use the CCD camera 310 to acquire an image of the test pattern. By means of the image processing unit 332, the control unit 330 also functions to perform image processing relating to the test pattern image.

With the print head unit 60 attached to the support section 320, the distance PG between the underside of the nozzle plate 110 (that is, the nozzle surface) and the stage 302 is set to be the same as the distance between the nozzle plate 110 and the platen 26 (FIG. 1). This distance PG is called the platen gap.

Figure 40:
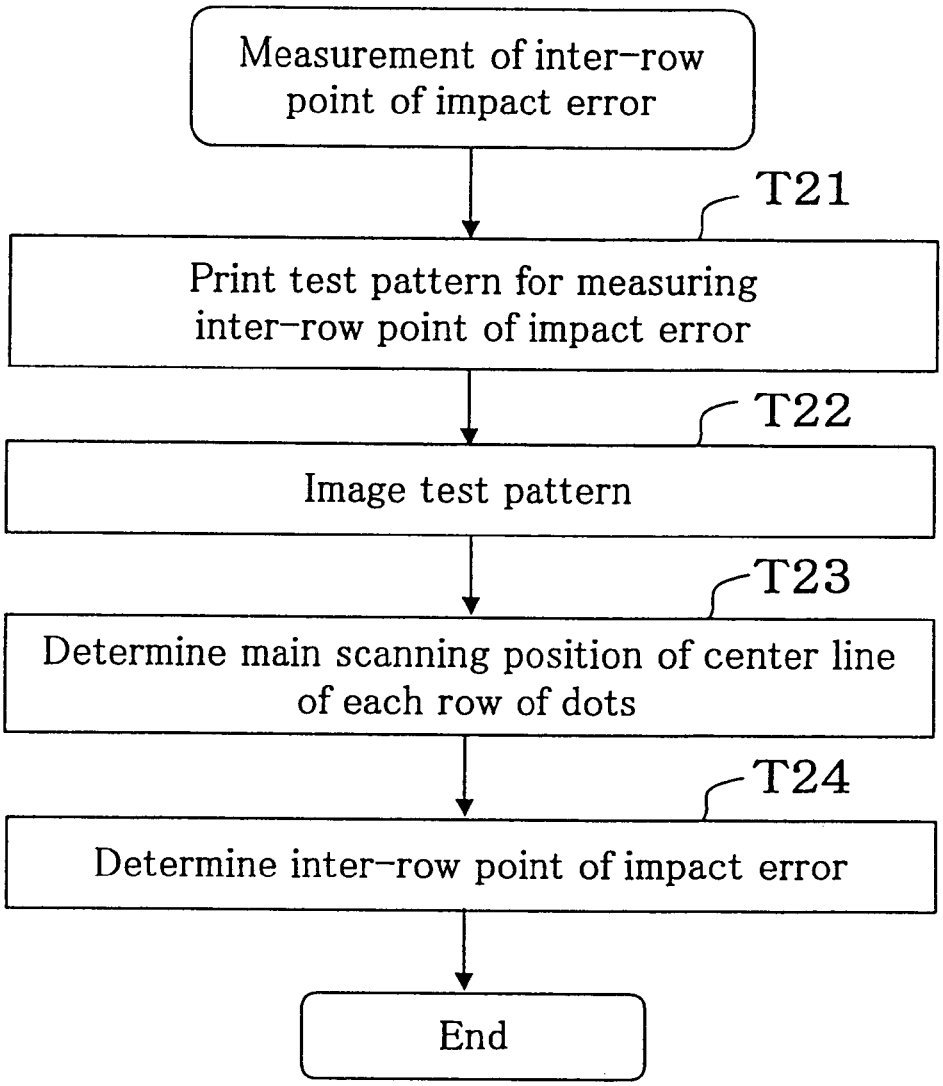
FIG. 40 is a flow chart of the procedure for measuring inter-row point of impact error.

The inter-row point of impact error, meaning the point of impact error between rows, is measured in step T2 of FIG. 38. FIG. 40 is a flow chart of the steps of the measurement procedure. In step T21, a test pattern is printed for measuring the point of impact error between rows.

Figure 41:
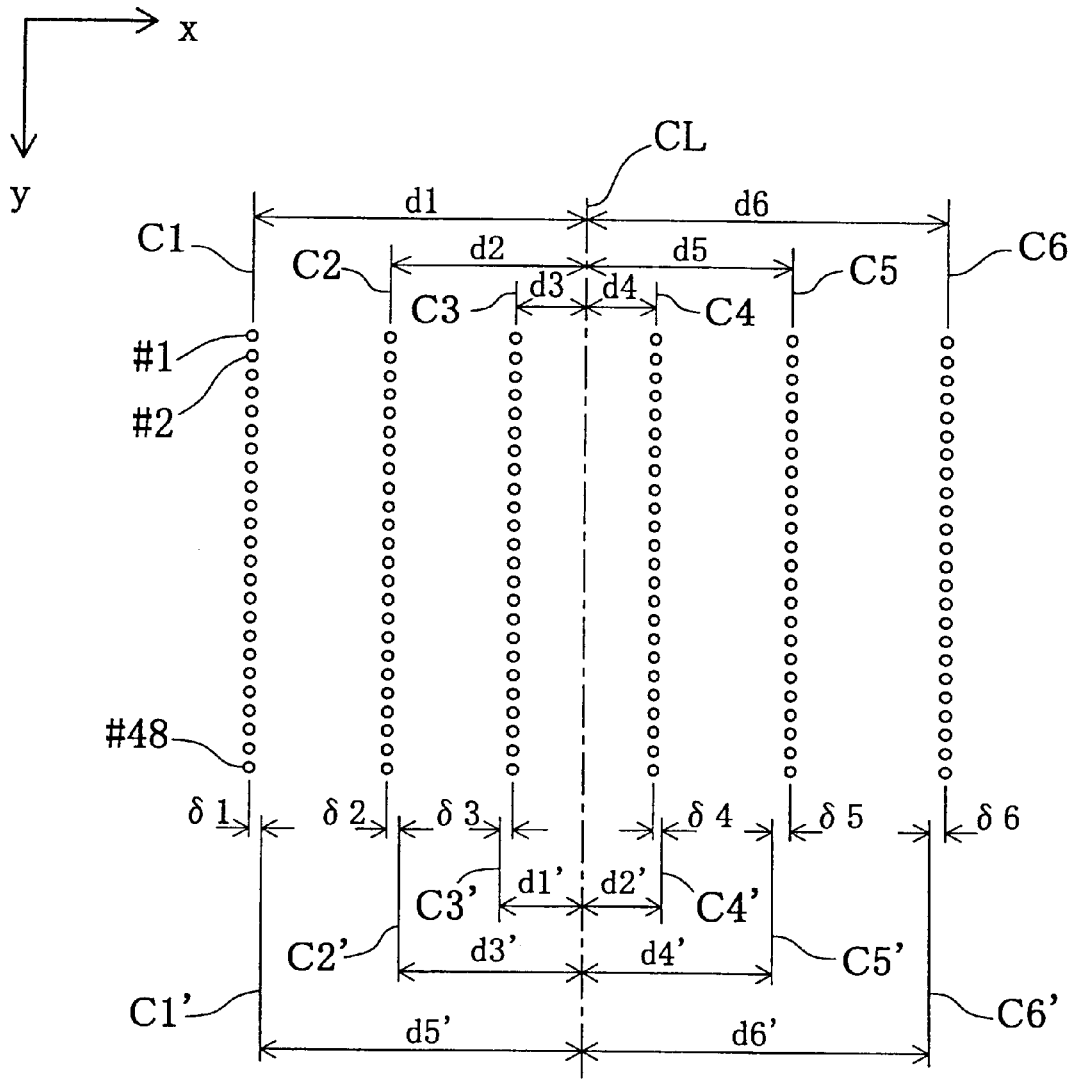
FIG. 41 illustrates the method of measuring inter-row point of impact error.

FIG. 41 illustrates the test pattern for measuring inter-row point of impact error. The test pattern consists of six rows of dots. The test pattern was printed by moving the paper P at a fixed velocity Vs in the main scanning direction x of the head inspection apparatus 300 (FIG. 39) while using one at a time of the six nozzle rows shown in FIG. 6 to emit ink at the same time from all of the 48 nozzles in the row. The nozzles are arrayed in the sub-scanning direction y at a pitch of several dots, so the 48 dots formed by the nozzles of one row are arrayed at a substantially constant spacing in the sub-scanning direction y. Ink may also be emitted at the same time from all six rows of nozzles.

The test pattern of FIG. 41 is printed using the same type of ink (cyan ink, for example) for all six rows of nozzles. However, during the head testing procedure, the same inks may be used as are used when the head is actually mounted on the printer 20, which is to say, black, cyan, light cyan, magenta, light magenta, and yellow.

In printing the test pattern, it is preferable to use dots of the size used most frequently in halftone regions (regions of a density ranging from approximately 10 to approximately 50%). This is because image degradation caused by point of impact deviation tends to be most noticeable in halftone regions. If, for example, one nozzle can be used to print dots of three different sizes (small, medium, large) at each pixel position, and medium sized dots are the dots used with the highest frequency in halftone regions, then it would be preferable to use medium dots to print the test pattern.

In step T22, the CCD camera 310 (FIG. 39) is used to image the test pattern. In step T23, based on the test pattern image, the image processing unit 332 determines the position in the main scanning direction of the center lines C1 to C6 of the rows of dots, by averaging the centroids of the 48 dots of each row. The first center line C1 can be used as the starting point for measurement purposes. Even if a different center line is used as the starting point, the outcome of the processing described below will still be the same.

In step T24, the positions of the six center lines C1 to C6 along the main scanning direction are used to determine the inter-row point of impact error. For this, first the positions of C1 to C6 are averaged to obtain an overall center line CL for all rows. Then, the distance from CL to each of the center lines C1 to C6 is calculated, resulting in distances d1 to d6.

C1' to C6' shown at the bottom of FIG. 41 are the design center lines. Usually the actual center lines C1 to C6 deviate slightly from the design center lines C1' to C6'. This deviation error is labelled $\delta 1$ to $\delta 6$. When the deviation is to the right of a design center line it is treated as a plus value, and as a minus value when it is to the left of a design center line. The maximum absolute value $\max(|\delta|)$ of the deviation error $\delta 1$ to $\delta 6$ is used as the inter-row point of impact error Ea.

As can be understood from the above explanation, when the actual relative relationship of the points of impact of the six nozzle rows of the print head unit 60 deviates from the design points of impact, error Ea shows the amount of the deviation. That is, a large inter-row point of impact error Ea signifies a large mutual deviation (hence image degradation) in the main scanning direction of the rows of dots formed by the different rows of nozzles. As such, from the standpoint of image quality, it is preferable that the impact error Ea be as small as possible.

Figure 42:
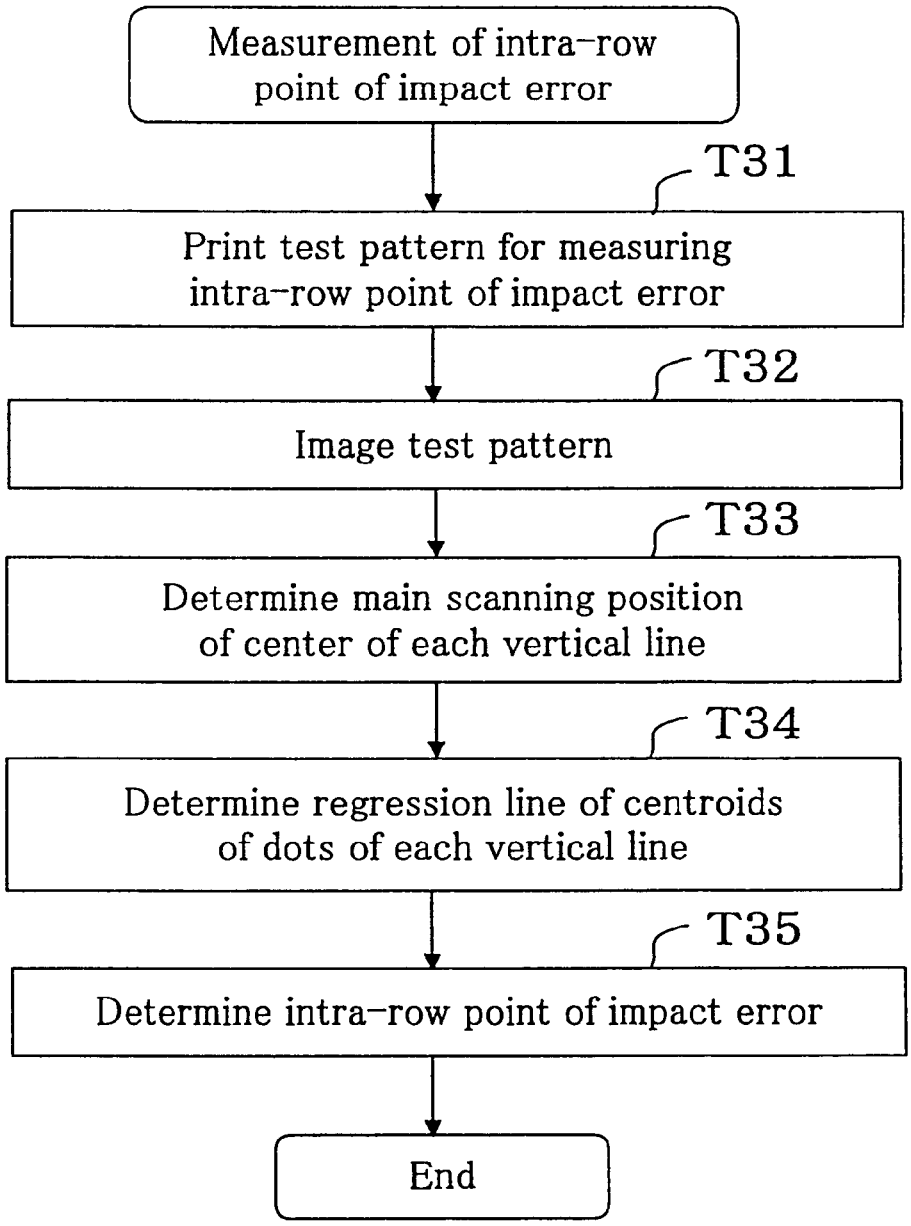
FIG. 42 is a flow chart of the procedure for measuring intra-row point of impact error.

In step T3 of FIG. 38, the intra-row points of impact, meaning the points of impact along one line of dots, are measured. FIG. 42 is a flow chart of the procedure used to measure the intra-row point of impact error. In step T31, a test pattern for measuring the intra-row point of impact error is printed.

Figures 43A, 43B, 43C:
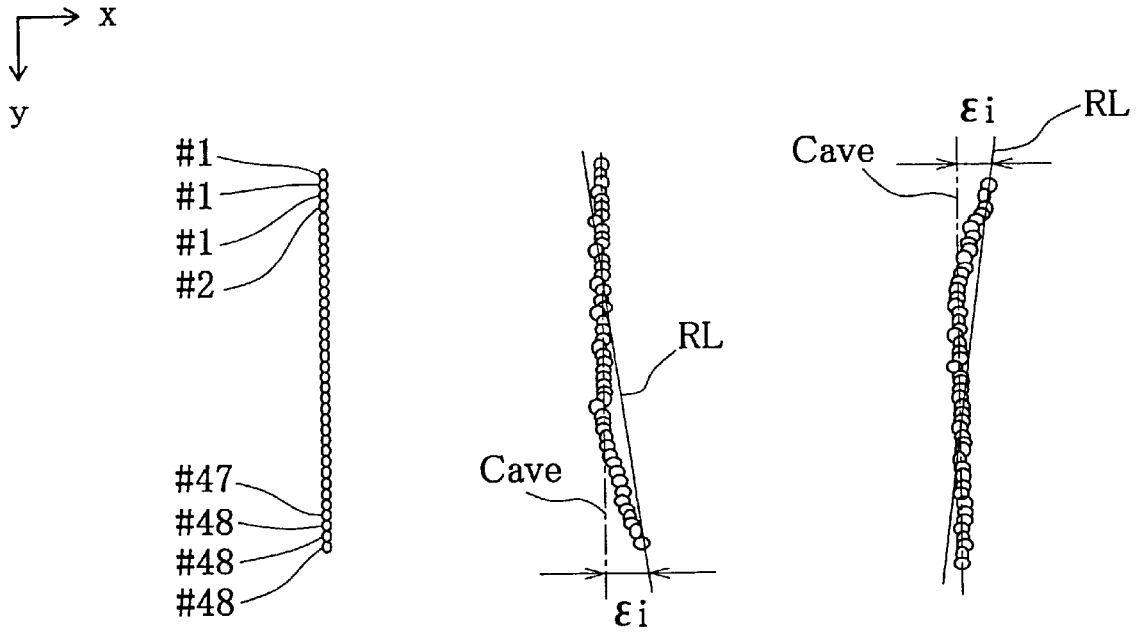
FIGS. 43(*a*)–43(*c*) illustrate the method of measuring intra-row point of impact error.

FIGS. 43(*a*)–43(*c*) illustrate the method of measuring intra-row point of impact error. Each row of nozzles is used to print a vertical line such as the line of FIG. 43(*a*). Thus, the test pattern for measuring such intra-row point of impact error includes six such vertical lines (not shown).

The vertical lines are each comprised of a continuous line of dots. If in each nozzle row the nozzles are provided at a pitch of three dots, for example, then as shown in FIG. 43(*a*), each nozzle is used to print three dots in a row, so the feed amount for one dot in the sub-scanning direction is performed two times to print the vertical line in three main scanning passes. If the nozzle pitch is k dots (where k is an integer), then, using each nozzle, to continuously print k dots, the sub-scanning feed amount for one dot is repeated (k−1) times to print a vertical line in k main scanning passes.

For the test pattern for measuring the intra-row point of impact error, the same type of ink (cyan, for example) is supplied to all six nozzle rows. Here too, however, the same inks may be used that are used when the head is actually mounted on the printer 20. Moreover, the test pattern for measuring inter-row point of impact error of FIG. 41 can also be used as the test pattern for measuring intra-row point of impact error. Conversely, the test pattern for measuring intra-row point of impact error of FIG. 43(*a*) can also be used as the test pattern for measuring inter-row point of impact error. In other words, inter-row point or intra-row of impact error can be measured using a pattern that includes continuous lines of dots extending in the sub-scanning direction, and a pattern may also be used that includes separate lines of dots extending in the sub-scanning direction.

FIG. 43(*a*) shows an ideal condition in which there is no intra-row point of impact deviation. In most cases, however, there is some curvature, as in FIGS. 43(*b*) and (*c*). Measurement of intra-row point of impact error will now be described with reference to the lines as shown in FIGS. 43(*b*) and (*c*).

In step T32, the CCD camera 310 (FIG. 39) is used to image the vertical line. Based on the vertical line image, in step T33 the image processing unit 332 determines the position of the center line Cave of the vertical line in the main scanning direction. The position of the center line Cave is determined based on the average values of the centroids of the dots comprising the vertical line.

In step T34, the regression line RL of the dot centroids is determined. In step T35, the deviation Ei between the center line Cave and regression line RL are used to determine intra-row point of impact error Eb. The deviation amount $\epsilon i$ is the larger of the deviation amounts between the center line Cave and the regression line RL at the top and bottom of the vertical line. The deviation value $\epsilon i$ may be larger at the bottom of the line, as in FIG. 43(*b*), or at the top of the line, as in FIG. 43(*c*). The "i" of $\epsilon i$ signifies the value relates to the i-th of the six vertical lines included in the test pattern. The maximum value max($\epsilon i$) of the deviation amount $\epsilon i$ of the regression line RL with respect to the six vertical lines is used as the intra-row point of impact error Eb.

As explained in the foregoing, therefore, intra-row point of impact error E represents the actual deviation that the points of impact of dots formed using the nozzles of the particular row concerned exhibit in the main scanning direction. That is, a large intra-row point of impact error Eb signifies a large mutual deviation (hence image degradation) in the main scanning direction among dots formed by different nozzles of the same row. As such, from the standpoint of image quality, it is preferable that the impact error Eb be as small as possible.

When the inter-row point of impact error Ea and intra-row point of impact error Eb have been measured in respect of a print head unit 60, in step T4 of FIG. 38, Ea and Eb are used to judge whether the print head unit 60 is good or bad.

Figure 44:
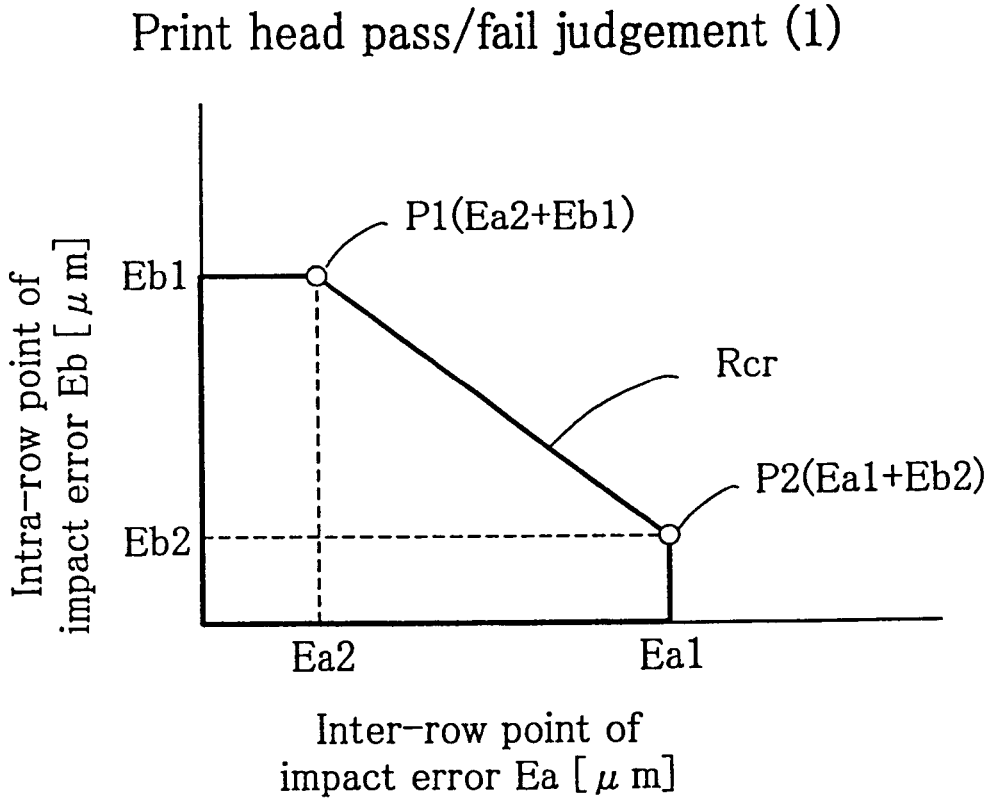
FIG. 44 illustrates an example of reference criteria used to judge a print head unit.

FIG. 44 shows an example of the criteria used to judge a print head unit. In FIG. 44 the horizontal axis is inter-row point of impact error Ea and the vertical axis is intra-row point of impact error Eb. To fall within the acceptable range Rcr, the following three conditions must be satisfied at the same time.

(1) Ea must not exceed maximum permissible value Ea1.

(2) Eb must not exceed maximum permissible value Eb1.

(3) A point prescribed by Ea and Eb must be below a straight line joining points P1 and P2.

Point P1 is equal to a prescribed reference value Ea2 that is smaller than the maximum permissible value Ea1 for the inter-row point of impact error Ea, and is also equal to a prescribed reference value Eb2 for the intra-row point of impact error Eb. Point P2 is equal to the maximum permissible value Ea1 for the inter-row point of impact error Ea, and is also equal to the prescribed reference value Eb2 that is smaller than the maximum permissible value Eb1 for the intra-row point of impact error Eb.

If the inter-row and intra-row point of impact errors Ea and Eb for a particular print head unit are within the acceptable range Rcr the print head unit is deemed to have passed inspection, and if the error values are outside the range, the head unit is deemed as not passing inspection. Thus using error values Ea and Eb as the criteria for judging whether print head units are good or bad makes it possible to reject print heads exhibiting a large point of ink impact error, and to use only good print heads to manufacture printers.

Figure 45:
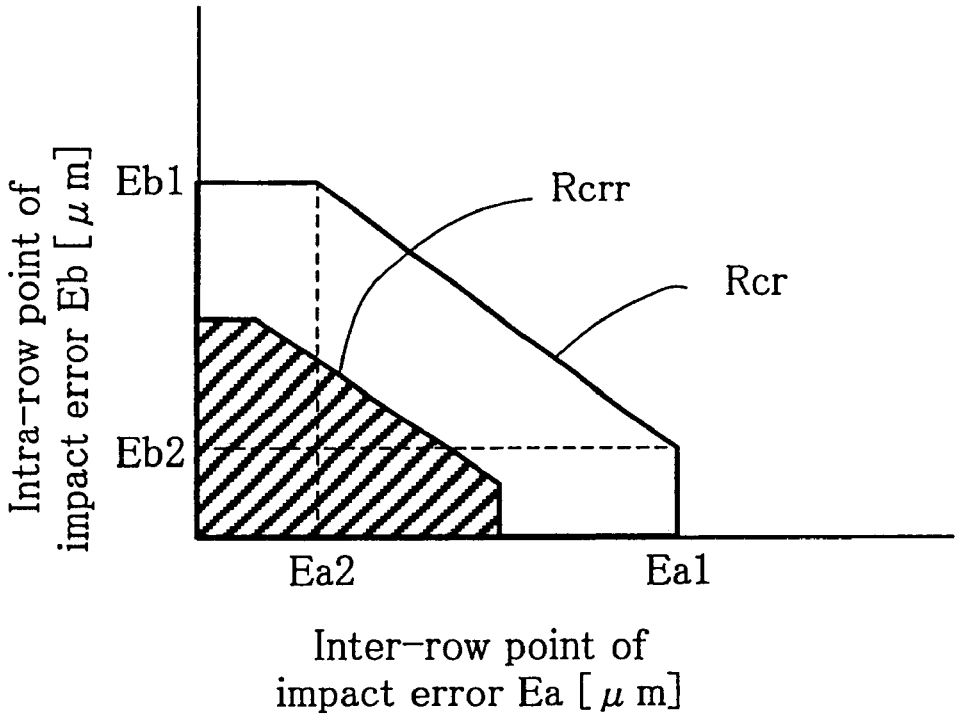
FIG. 45 illustrates an example of reference criteria used to judge a print head unit.

FIG. 45 shows another example of the criteria used to judge a print head unit. The acceptable range in this case is within the second acceptance range Rcrr, which is within the acceptable range Rcr of FIG. 44. Thus, Rcrr is a more stringent reference range than Rcr. These two reference criteria can be applied to print heads used in different ways. For example, the relatively lower standard Rcr can be applied just to heads using four ink colors (cyan, magenta, yellow, black), and the relatively higher standard Rcrr can be applied to six-color heads that also use light cyan and light magenta.

When the print head of FIG. 6 is used for six-color printing, image quality requirements are higher than in the case of four-color printing using the print head of FIG. 20. Thus, in inspecting the six-color head, it is preferable to apply the more stringent Rcrr of FIG. 45, and to apply the relatively lower Rcr of FIG. 45 for four-color heads.

Thus using different judgement criteria according to how a print head is used makes it possible to manufacture printers using print heads that provide the necessary performance level for the print head application concerned.

In step T5 of FIG. 38, a head ID is set for print head units that have passed inspection. The head ID consists of information representing various characteristics relating to the print head unit. Here, the method of setting head ID information relating to inter-row deviation will be described.

FIG. 46 shows details of head ID data relating to inter-row deviation. Six head ID values are set, corresponding to the six inter-row deviation errors $\delta$1 to $\delta$6 shown in FIG. 41. If, for example, the inter-row deviation $\delta i$ of the i-th nozzle row is −30 to −25 $\mu$m, a head ID value of A is set as the inter-row deviation for that row, while if the deviation is 25 to 30 μm, the head ID value is set at L. In FIG. 46, the ○ marked head ID values are the six head ID values set for a particular print head unit. In this example, the inter-row deviation δ1 of the first nozzle row is −5 to 0 μm and the inter-row deviation δ2 of the second nozzle row is 15 to 20 μm. As shown at the bottom of FIG. 46, the six head ID values set for inter-row deviation on this print head unit are FJHGEC.

These head IDs for inter-row deviation can be used to correct point of impact deviation during printing. For example, as shown in FIGS. 9 and 10, when there is mutual point of impact deviation between black and cyan dots during bi-directional printing, the head ID values (F and J in FIG. 46) relating to inter-row deviation of the black and cyan nozzle rows (in the examples of FIGS. 6 and 41, the first and second rows) can be used to correct the deviation during bidirectional printing.

Head ID values relating to inter-row deviation correspond not to a single value of inter-row deviation δ but to a range of inter-row deviation δ. Thus, when correcting deviation during printing, a difference of representative values (center values) of the range of inter-row deviation corresponding to the head ID value is used. For example, the inter-row deviation of the second nozzle row relative to the first nozzle row, would be the representative value (17.5 μm) of the range of inter-row deviation of the second nozzle row minus the representative value (−2.5 μm) of the range of inter-row deviation of the first nozzle row, meaning 20 μm. In this way, the relative deviation from the reference first nozzle row (the black nozzle row in the case of FIG. 6) to the second nozzle row (cyan nozzle row) can be readily determined. Also, this relative inter-row deviation can be used to correct positional deviation during bi-directional printing.

With the black nozzle row as the reference, the head ID values of FIG. 46 can be used to obtain the average inter-row deviation of the cyan and magenta nozzle rows. That is, using FIG. 46, the inter-row deviation of the magenta nozzle row relative to the black nozzle row (first row) is 5 μm (=2.5−(−2.5)). As described above, the relative inter-row deviation of the cyan nozzle row is 20 μm. Therefore, when the black nozzle row is used as the reference, the average inter-row deviation of the cyan and magenta nozzle rows is 12.5 μm. When positional deviation of cyan and magenta dots has a major effect on image quality, using this average deviation as the basis for correcting deviation during printing enables image quality to be improved. The average inter-row deviation of the light cyan and light magenta nozzle rows, using the black nozzle row as reference, can be calculated. Since light cyan and light magenta dots have a particularly large influence on image quality in halftone regions, using the inter-row deviation values thereof to correct deviation during printing is particularly effective for improving the image quality of halftone regions.

It is usually possible to use the head ID values relating to the six nozzle rows to calculate inter-row deviation relating to a desired one or more nozzle rows out of the six and to use the calculated deviation value to correct positional deviation during bi-directional printing.

When the head ID information is thus determined, a head ID seal 100 displaying the head ID can be provided on the print head unit 60. Alternatively, a non-volatile memory such as a programmable ROM can be provided in the driver IC 126 (FIG. 7) of the print head unit 60 and the head ID stored in the non-volatile memory. Generally, the head ID (head identification information) should be set in a readable form in print head unit 60. Providing the head ID in a readable form makes it possible to set the right head ID in the printer 20 when the print head unit 60 is being installed on the printer 20.

A print head unit 60 that has passed inspection is sent to the printer assembly line. In step T6 (FIG. 38), the print head unit 60 is installed in the printer 20.

As described in the foregoing, in accordance with this embodiment printers 20 can be manufactured using only print heads that satisfy reference criteria with respect to both inter-row point of impact error and intra-row point of impact error. As a result, printers can be obtained that provide high-quality output with little point of impact error.

The procedure used with reference to the first and second embodiments shown in FIGS. 11 and 12 may be used to set head ID based on inter-row deviation measured after the print head unit is installed in the printer. Alternatively, as in the sixth embodiment, a head ID may be set corresponding to inter-row deviation measured prior to installation of the print head unit. However, inter-row deviation measured prior to installation will not include mechanical printer error, while such mechanical printer error will be included in deviation measured after installing the print head unit in the printer. As such, when error arising during the manufacture of the print head itself is the main factor in positional deviation during bi-directional printing, the head ID may be set based on inter-row deviation measured prior to the print head unit being installed in the printer. However, when the main factor in positional deviation during printing is mechanical error in the printer, it is preferable to set the head ID after the print head unit has been installed in the printer.

The head ID information is not limited to inter-row deviation, but can also be set with respect to deviation between large and medium dots or between large and small dots. A head ID should be set beforehand according to the characteristics of each print head unit with respect to positional deviation of dots formed in the main scanning direction.

I. Modifications:

The present invention is in no way limited to the details of the embodiments and examples described in the foregoing but may be changed and modified in various ways to the extent that such changes and modifications do not depart from the essential scope thereof. For example, the modifications described below are possible.

I1. Modification 1:

In case of correcting deviation during bi-directional printing using reference and relative correction values, with respect to a printer in which the carriage can be moved at different main scanning velocities (speeds), it is preferable that a relative correction value relating to a row of nozzles should be set for each of such main scanning velocities. As can be understood from the explanation made with reference to FIG. 9, changing the main scanning velocity Vs also changes the degree of relative positional deviation between the rows of nozzles. As such, setting a relative correction value for each main scanning velocity makes it possible to achieve a further decrease in positional deviation during bi-directional printing.

I2. Modification 2:

In case of correcting deviation during bi-directional printing using reference and relative correction values, with respect to a multi-tone printer which is capable of printing dots of the same color in different sizes, it is preferable to set a relative correction value for each dot size. The emission velocity changes according to dot size. Setting a relative correction value for each dot size makes it possible to achieve a further decrease in positional deviation during bi-directional printing. Sometimes a multi-tone printer is only able to form dots of the same size in one main scanning pass using one row of nozzles. When this is the case, a dot size is selected for each main scanning pass, so with respect also to the relative correction value used to correct the positional deviation, for each main scanning pass a suitable value is selected in accordance with the dot size concerned.

The printing operations each produces dots of different size may be thought to be different printing modes that emit ink at mutually different velocities. The above modification therefore would mean setting relative correction values with respect to each of the plural printing modes in which dots are formed using ink emitted at different velocities.

I3. Modification 3:

In the case of the first and second embodiments it is preferable to set relative correction values independently for each row of nozzles other than the reference row of nozzles as the third embodiment. This makes it possible to further decrease positional deviation. Relative correction values can also be separately set for each group of nozzle rows that emit ink of the same color. For example, if the head is provided with two rows of nozzles that emit a specific ink, the same relative correction value can be applied to the nozzles of both rows for the specific ink.

I4. Modification 4:

In the first to fifth embodiments the row of black ink nozzles is selected as the reference row of nozzles when determining the reference and relative correction values. However, it is also possible to select a different row of nozzles as the reference. However, selecting a low density color ink such as light cyan or light magenta makes it harder for a user to read the test pattern used during determination of a reference correction value. Therefore, it is preferable to select as the reference a row of nozzles used to emit a relatively high density ink such as black, dark cyan, and dark magenta.

I5. Modification 5:

In the first to fifth embodiments positional deviation is corrected by adjusting the position (or timing) at which dots are printed. However, positional deviation may be corrected by other methods, for example by adjusting the frequency of the drive signals.

I6. Modification 6:

In the fifth embodiment, it is assumed that a single nozzle can print any one of three dots of different sizes at a single pixel position. Generally, the concept of this embodiment can be applied to a printer that can use one nozzle, for at least one type of ink, to print any one of N sizes of dots (where N is an integer at least 2) at each pixel position. In this case, as the dots targeted for adjustment to correct positional deviation, there can be selected at least one type of dots among the N types of dots. The at least one type of dots preferably includes relatively small dots other than the largest dots. The adjustment value used to correct deviation of the target dots can be applied in common to the N types of dots.

The smallest among the N types of dots can be selected as the target dots, and so can the dots of medium size. Selecting these as the target dots would improve the quality of halftone image regions.

"Dots of a medium size among the N types of dots" refers to $\{(N+1)/2\}$-th largest dots when N is an odd number, and to $\{N/2\}$-th or $\{N/2+1\}$-th largent dots when N is an even number. Instead, as medium sized dots, there may be employed the dots that are used in the greatest numbers when the image signal indicates a density level of 50%.

I7. Modification 7:

In each of the foregoing embodiments positional deviation is corrected by adjusting the positioning (or timing) of dots printed during a reverse pass. However, positional deviation may be corrected by adjusting the positioning of dots printed during a forward pass, or by adjusting the positioning of dots printed during both forward and reverse passes. Thus, all that matters is that the positions at which dots are printed be adjusted during at least one selected from a forward pass and a reverse pass.

I8. Modification 8:

The above embodiments were each described with respect to an inkjet printer. However, the present invention is not limited thereto and may be applied to any of various printing apparatuses that print using a print head. Similarly, the present invention is not limited to an apparatus or method for emitting ink droplets, but can also be applied to apparatuses and methods used to print dots by other means.

I9. Modification 9:

While the configurations of the above embodiments have been implemented in terms of hardware, the configurations may be partially replaced by software. Conversely, software-based configurations may be partially replaced by hardware. For example, some of the functions of the head drive circuit 52 shown in FIG. 2 may be implemented in software.

I10. Modification 10:

In the sixth embodiment described above, the inspection target was the print head unit 60 shown in FIG. 3. However, as the inspection target, there may be used the print head 28 without the ink cartridge.

I11. Modification 11:

Each of the foregoing embodiments describes a method of reducing positional deviation of dots in a main scanning direction during bi-directional printing, but the invention can be similarly applied with respect to reducing positional deviation of dots in a main scanning direction during uni-directional printing.

For example, in the second embodiment (FIG. 21), each group comprising rows of nozzles for two colors is provided with its own, independent head drive circuit, so that during unidirectional printing it is possible to reduce positional deviation of dots in a main scanning direction arising between groups. Specifically, at least one out of, for example, black (K) and cyan (C) dot positions, and light cyan (LC) and magenta (M) dot positions is adjusted, enabling mutual positional deviation therebetween to be reduced.

In the third embodiment (FIG. 23), too, head drive circuits are independently provided for each color, enabling reduction of dot positional deviation between each color, during unidirectional printing.

In the fourth embodiment (FIGS. 30(*a*)–(*f*)), too, distribution of adjustment data for each color can be adjusted, enabling reduction of dot positional deviation between each color, during unidirectional printing.

Industrial Applicability

This invention can be applied to printers and facsimile apparatuses and the like that emit ink from nozzles.

What is claimed is:

1. A printing apparatus that prints on a print medium during main scanning, comprising:

a print head unit having a print head configured to print dots at each of pixel positions on the print medium;

a main scanning drive section configured to effect main scanning by moving at least one of the print medium and the print head unit;

a sub-scanning drive section configured to effect sub-scanning by moving at least one of the print medium and the print head unit;

a head drive section configured to apply drive signals to the print head to effect printing on the print medium; and a control section configured to control printing, the control section comprising:

a printing position adjustment section configured to use an adjustment value for reducing positional deviation of dots to be formed by the print head in a main scanning direction to adjust positioning of dots in the main scanning direction;

wherein the print head unit includes readable head identification information set in accordance with characteristics relating to the positional deviation of dots to be formed by the print head in the main scanning direction, and wherein the head identification information is set based on premeasured positional deviation values;

wherein the printing position adjustment section determines the adjustment value according to the head identification information.

2. A printing apparatus as described in claim 1, wherein the printing apparatus includes a bi-directional printing function for printing in both forward and reverse pass directions; and the printing position adjustment section uses the adjustment value to adjust the position of dots in the main scanning direction during bi-directional printing.

3. A printing apparatus as described in claim 1, wherein the printing apparatus has a unidirectional printing function for printing during either one of a forward pass and a reverse pass; and the printing position adjustment section uses the adjustment value to adjust the position of dots in the main scanning direction during unidirectional printing.

4. A printing apparatus as described in claim 2, wherein the print head comprises:

a plurality of nozzles; and a plurality of emission drive elements configured to emit ink droplets from the plurality of respective nozzles, wherein the plurality of emission drive elements are divided into a plurality of groups;

and wherein the head drive section includes:

a base drive signal generator configured to generate a plurality of base drive signals corresponding to the plurality of groups; and a plurality of drive signal supply sections provided corresponding to the plurality of groups and configured to shape each of the plurality of base drive signals in response to given printing signals and supply the drive signals to each of respective of the plurality of emission drive elements;

the base drive signal generator using the adjustment value supplied from the printing position adjustment section to output the plurality of base drive signals that have been individually phase adjusted.

5. A printing apparatus as described in claim 4, wherein the plurality of emission drive elements are divided into groups corresponding to plural groups of emission drive elements, and each group of emission drive elements corresponds to a plurality of nozzles arrayed in the sub-scanning direction.

6. A printing apparatus as described in claim 4, wherein the plurality of emission drive elements are divided into groups according to type of ink emitted by corresponding nozzles.

7. A printing apparatus as described in claim 2, wherein the printing position adjustment section includes:

a first memory configured to store a reference correction value for correcting printing positional deviation in the main scanning direction with respect to designated reference dots formed by the print head;

a second memory configured to store a relative correction value for correcting the reference correction value; and an adjustment value determination section configured to determine the adjustment value by using the relative correction value to correct the reference correction value, the relative correction value being determined in accordance with the head identification information.

8. A printing apparatus as described in claim 1, wherein the head identification information is stored in a non-volatile memory provided in the print head unit.

9. A printing apparatus as described in claim 1, wherein the head identification information is displayed on an outer surface of the print head unit.

10. A printing control apparatus that generates printing data to be supplied to a printing section that performs printing;

the printing section comprising:

a print head unit having a print head configured to print dots at each pixel position on the print medium;

a main scanning drive section configured to effect main scanning by moving at least one of the print medium and the print head unit;

a sub-scanning drive section configured to effect sub-scanning by moving at least one of the print medium and the print head unit;

a head drive section configured to apply drive signals to the print head to effect printing on the print medium in response to input printing data; and a print control apparatus configured to control printing;

the print head unit being provided with readable head identification information that is set in accordance with characteristics relating to positional deviation of dots formed in a main scanning direction by the print head, and wherein the head identification information is set based on premeasured positional deviation values;

the printing control apparatus comprising:

a printing data generation section configured to generate the printing data, which includes dot data representing dots to be formed at each of pixel positions on each main scanning line on the print medium, and adjustment data for adjusting, in pixel units, the printing position of dots to be formed in accordance with the dot data in a main scanning direction;

the printing data generation section comprising:

an adjustment data determination section configured to determine the adjustment data to reduce positional deviation of dots in the main scanning direction in accordance with the head identification information.

11. A printing control apparatus as described in claim 10, wherein the printing data includes, as the adjustment data, a prescribed number of adjustment pixel data corresponding to a prescribed number of pixels; and the adjustment data determination section distributes the prescribed number of adjustment pixel data to opposite ends of the dot data.

12. A computer-readable recording medium on which is recorded a computer program for generating printing data for a computer equipped with a printing apparatus that includes a print head unit having a print head to print dots at each of pixel positions on the print medium, a main scanning drive section to effect main scanning by moving at least one of the print medium and the print head unit, a sub-scanning drive section to effect sub-scanning by moving at least one of the print medium and the print head unit, a head drive section to apply drive signals to the print head to effect printing on the print medium, a control section to control printing, the print head unit being provided with readable head identification information set in accordance with characteristics relating to positional deviation of dots to be formed by the print head in a main scanning direction, and wherein the head identification information is set based on premeasured positional deviation values, the computer-readable recording medium comprising a computer program for causing the computer to implement functions of:

generating the printing data that includes dot data representing dots to be formed at each of pixel positions on each main scanning line on the print medium, and adjustment data for adjusting, in pixel units, the printing position of dots to be formed in accordance with the dot data in a main scanning direction; and determining the adjustment data to reduce positional deviation of dots in the main scanning direction in accordance with the head identification information.

13. A method of manufacturing a printing apparatus equipped with a print head having a plurality of nozzle rows for emitting ink, comprising the steps of:

(a) inspecting a first plurality of dot rows formed using respective plural nozzle rows or a target print head that is a target of inspection, and measuring mutual positional deviation of the first plurality of dot rows in a main scanning direction to determine an inter-row point-of-impact error with respect to the target print head;

(b) inspecting a second plurality of dot rows formed using respective plural nozzle rows of the target print head, and measuring mutual positional deviation of dots in the main scanning direction in each of the dot rows of the second plurality of dot rows to determine an intra-row point-of-impact error with respect to the target print head;

(c) judging if the target print head is acceptable based on the determined inter-row and intra-row point-of-impact errors; and (d) assembling a printing apparatus using a print head that passed as acceptable in step (c).

14. A method of manufacturing a printing apparatus as described in claim 13, wherein said step (*c*) includes the sub-steps of:

(ci) setting a first judgement criterion for a first type of print head that emits ink of a single density with respect to each of a plurality of hues, and setting a second judgement criterion for a second type of print head that emits a plurality of types of inks having different densities with respect to at least one hue; and (cii) with respect to the target print head, performing at least one of the judging step for the first type of print head according to the first judgement criterion and the judging step for the second type of print head according to the second judgement criterion.

15. A method of manufacturing a printing apparatus as described in claim 14, wherein the second judgement criterion is set with a narrower acceptance range than the first judgement criterion.

16. A method of inspecting a print head having a plurality of nozzle rows for emitting ink, comprising the steps of:

(a) inspecting a first plurality of dot rows formed using respective plural nozzle rows of a target print head that is a target of inspection, and measuring mutual positional deviation of the first plurality of dot rows in a main scanning direction to determine an inter-row point-of-impact error with respect to the target print head;

(b) inspecting a second plurality of dot rows formed using respective plural nozzle rows of the target print head, and measuring mutual positional deviation of dots in the main scanning direction in each of the dot rows of the second plurality of dot rows to determine an intra-row point-of-impact error with respect to the target print head; and (c) judging if the target print head is acceptable based on the inter-row and intra-row point-of-impact errors.

17. A method of inspecting a print head as described in claim 16, wherein the step (c) includes the steps of:

(ci) setting a first judgement criterion for a first type of print head that emits ink of a single density with respect to each of a plurality of hues, and setting a second judgement criterion for a second type of print head that emits a plurality of types of inks having different densities with respect to at least one hue; and (cii) with respect to the target print head, performing at least one of the judging step for the first type of print head according to the first judgement criterion and the judging step for the second type of print head according to the second judgement criterion.

18. A method of inspecting a print head as described in claim 16, wherein the second judgement criterion is set with a narrower acceptance range than the first judgement criterion.

19. A printing apparatus that prints on a print medium during main scanning, comprising:

a print head unit having a print head configured to print dots at each of pixel positions on the print medium;

a main scanning drive section configured to effect main scanning by moving at least one of the print medium and the print head unit;

a sub-scanning drive section configured to effect sub-scanning by moving at least one of the print medium and the print head unit;

a head drive section configured to apply drive signals to the print head to effect printing on the print medium; and a control section configured to control printing, the control section comprising:

a printing position adjustment section configured to use an adjustment value for reducing positional deviation of dots to be formed by the print head in a main scanning direction, which occurs due to velocity of ink droplets according to type of ink, so as to adjust positioning of dots in the main scanning direction;

wherein the print head unit includes readable head identification information set in accordance with characteristics relating to the positional deviation of dots to be formed by the print head in the main scanning direction;

wherein the printing position adjustment section determines the adjustment value according to the head identification information.

20. A printing apparatus as described in claim 19, wherein the printing apparatus includes a bi-directional printing function for printing in both forward and reverse pass directions; and the printing position adjustment section uses the adjustment value to adjust the position of dots in the main scanning direction during bi-directional printing.

21. A printing apparatus as described in claim 19, wherein the printing apparatus has a unidirectional printing function for printing during either one of a forward pass and a reverse pass; and the printing position adjustment section uses the adjustment value to adjust the position of dots in the main scanning direction during unidirectional printing.

22. A printing apparatus as described in claim 20, wherein the print head comprises:

a plurality of nozzles; and a plurality of emission drive elements configured to emit ink droplets from the plurality of respective nozzles, wherein the plurality of emission drive elements are divided into a plurality of groups;

and wherein the head drive section includes:

a base drive signal generator configured to generate a plurality of base drive signals corresponding to the plurality of groups; and a plurality of drive signal supply sections provided corresponding to the plurality of groups and configured to shape each of the plurality of base drive signals in response to given printing signals and supply the drive signals to each of respective of the plurality of emission drive elements;

the base drive signal generator using the adjustment value supplied from the printing position adjustment section to output the plurality of base drive signals that have been individually phase adjusted.

23. A printing apparatus as described in claim 22, wherein the plurality of emission drive elements are divided into groups corresponding to plural groups of emission drive elements, and each group of emission drive elements corresponds to a plurality of nozzles arrayed in the sub-scanning direction.

24. A printing apparatus as described in claim 22, wherein the plurality of emission drive elements are divided into groups according to type of ink emitted by corresponding nozzles.

25. A printing apparatus as described in claim 20, wherein the printing position adjustment section includes:

a first memory configured to store a reference correction value for correcting printing positional deviation in the main scanning direction with respect to designated reference dots formed by the print head;

a second memory configured to store a relative correction value for correcting the reference correction value; and an adjustment value determination section configured to determine the adjustment value by using the relative correction value to correct the reference correction value, the relative correction value being determined in accordance with the head identification information.

26. A printing apparatus as described in claim 19, wherein the head identification information is stored in a non-volatile memory provided in the print head unit.

27. A printing apparatus as described in claim 19, wherein the head identification information is displayed on an outer surface of the print head unit.

28. A printing apparatus that prints on a print medium during main scanning, comprising:

a print head unit having a print head configured to print dots at each of pixel positions on the print medium;

a main scanning drive section configured to effect main scanning by moving at least one of the print medium and the print head unit;

a sub-scanning drive section configured to effect sub-scanning by moving at least one of the print medium and the print head unit;

a head drive section configured to apply drive signals to the print head to effect printing on the print medium; and a control section configured to control printing, the control section comprising:

a printing position adjustment section configured to use an adjustment value for reducing positional deviation of dots to be formed on the print medium by the print head in a main scanning direction to adjust positioning of dots in the main scanning direction;

wherein the print head unit includes readable head identification information set in accordance with characteristics relating to the positional deviation of dots to be formed on the print medium by the print head in the main scanning direction;

wherein the printing position adjustment section determines the adjustment value according to the head identification information.

* * * * *